US005317134A

United States Patent [19]

Edamura

[11] Patent Number: 5,317,134

[45] Date of Patent: May 31, 1994

[54] MICROWAVE OVEN HAVING PREPARATION OF MENU ASSISTING FUNCTION

[75] Inventor: Kaoru Edamura, Nara, Japan

[73] Assignee: Sharp Kabushiki Kaisha, Osaka, Japan

[21] Appl. No.: 948,631

[22] Filed: Sep. 23, 1992

[30] Foreign Application Priority Data

Sep. 25, 1991 [JP] Japan ..... 3-245764

[51] Int. Cl.[5] ..... H05B 6/68

[52] U.S. Cl. ..... 219/720; 219/714; 219/506

[58] Field of Search ..... 219/10.55 B, 10.55 E, 219/10.55 R, 10.55 M, 506, 492; 99/325

[56] References Cited

U.S. PATENT DOCUMENTS

| | | | |
|---|---|---|---|
| 4,375,586 | 3/1983 | Ueda | 219/10.55 B |
| 4,488,026 | 12/1984 | Tanabe | 219/10.55 B |
| 4,780,588 | 10/1988 | Edamura | 219/10.55 B |
| 4,814,588 | 3/1989 | Hotta et al. | 219/10.55 B |
| 4,874,928 | 10/1989 | Kasai | 219/10.55 B |
| 4,914,277 | 4/1990 | Gugkin et al. | 219/506 |
| 4,933,527 | 6/1990 | Edamura | 219/10.55 B |
| 4,972,060 | 11/1990 | Edamura | 219/10.55 B |

FOREIGN PATENT DOCUMENTS

| | | |
|---|---|---|
| 0329111 | 8/1989 | European Pat. Off. . |
| 62-19501 | 2/1987 | Japan . |

*Primary Examiner*—Phil Leung

[57] ABSTRACT

A microwave oven includes a cooking unit for cooking a food according to a cooking program and a memory slot to which a first type of external memory and a second type of external memory are detachably attached. These memories respectively store main cooking information and sub-cooking information. Each main cooking information is related to at least one sub-cooking information. The microwave oven further includes a main cooking information selection unit for use in selection of main cooking information stored in the external memory attached to the memory slot, a sub-cooking information selection unit for assisting user selection of sub-cooking information stored in the second type of external memory attached to the memory slot and related to the selected main cooking information to prepare a menu, a menu memory for storing a series of cooking programs selected by the user as a menu, a cooking controller for applying the cooking programs stored in the cooking memory to the cooking unit in a predetermined order and executing the programs, and a display for displaying information required for the user to prepare a menu by the main cooking and the sub-cooking information selection units and displaying information relating to the cooking program to be executed prior to execution of the cooking program by the cooking controller.

20 Claims, 45 Drawing Sheets

FIG.5 PRIOR ART

① MAIN DISH SEARCH DATA AREA

| ADDRESS | MENU CODE | MAIN MATERIAL CODE | SUB-MATERIAL CODE 1 | SUB-MATERIAL CODE 2 | PICTURE INFORMATION CODE |
|---|---|---|---|---|---|
| 10 | M-01 | SM 01 | SS04 | SS02 | V-01 |
| 20 | M-02 | SM 02 | SS02 | SS04 | V-02 |
| 30 | M-03 | SM 03 | SS01 | SS09 | V-03 |
| 40 | M-04 | SM 04 | SS05 | SS07 | V-04 |
| 50 | M-05 | SM 05 | SS03 | SS04 | V-05 |
| 60 | M-06 | SM 06 | SS07 | SS02 | V-06 |
| 70 | M-07 | SM 07 | SS02 | SS03 | V-07 |
| | | | | | V-08 |

55

② SUB-DISH SEARCH DATA AREA

| | | SUB-DISH DESIGNATION | | SOUP DESIGNATION | |
|---|---|---|---|---|---|
| | | MAIN DISH CODE | | | PICTURE INFORMATION CODE |
| 510 | MS 01 | M-02 | ○ | ○ | V 55 |
| 520 | MS 02 | M-04 | ○ | × | V 57 |
| 530 | MS 03 | M-06 | × | ○ | V 59 |
| 540 | MS 04 | M-02 | ○ | ○ | V 61 |
| 550 | MS 05 | M-01 | × | ○ | V 56 |
| 560 | MS06 | M-03 | ○ | × | V 58 |
| 570 | MS07 | M-05 | ○ | ○ | |

56

③ PICTURE INFORMATION DATA AREA

| | PICTURE INFORMATION CODE | PICTURE INFORMATION | COOKING PROGRAM CODE |
|---|---|---|---|
| 1010 | V-01 | - - - - - - - - - - - - - - - - | P-01 |
| 1020 | V-02 | —·—·—·—·—·—·— | P-03 |
| 1030 | V-03 | - - - - - - - - - - - - - - - - | P-07 |
| 1040 | V-04 | ——··——··——··—— | P-04 |
| 1050 | V-05 | ————·————·— | P-05 |
| 1060 | V-06 | —···—···—···— | P-07 |
| 1070 | V-07 | | P-02 |

57

④ COOKING PROGRAM DATA AREA

| | COOKING PROGRAM CODE | COOKING PROGRAM INFORMATION |
|---|---|---|
| 1510 | P-01 | * * * * * * * * * * * * * * * |
| 1520 | P-02 | - - - - - - - - - - - - - - - |
| 1530 | P-03 | + + + + + + + + + + + + + + + |
| 1540 | P-04 | —·—·—·—·—·—·—·—·—·—·—·— |
| 1550 | P-05 | △ △ △ △ △ △ △ △ △ △ △ △ △ △ △ |
| 1560 | P-06 | - - - - - - - - - - - - - - - - - - - - |
| 1570 | P-07 | ——·——·——·——·— |

58

FIG. 23

PROPOSED MENUS

COOKED FOOD PICTURE CODE

DISH CODE

FREQUENCY OF USE

| ADDRESS | | | | | | | |
|---|---|---|---|---|---|---|---|
| 1501 | SD-01 | J01= | SV-01 | 25 | CP-01 | HEAVY | NON-SOUP |
| 1502 | -03 | J03= | -03 | 15 | -03 | | |
| 1503 | -05 | J05= | -05 | 19 | -05 | | |
| 1504 | -07 | J08= | -07 | 23 | -07 | | |
| 1505 | -09 | J09= | -09 | 25 | -09 | | |
| 1506 | -11 | J11= | -11 | 27 | -11 | | |
| 1507 | -13 | J13= | -13 | 15 | -13 | | |
| 1508 | -15 | J15= | -15 | 10 | -15 | | |
| 1509 | -17 | J17= | -17 | 20 | -17 | | |
| 1510 | -19 | J19= | -19 | 10 | -19 | | |
| 1511 | -21 | J21= | -21 | 23 | -21 | | |
| 1512 | -23 | J23= | -23 | 15 | -23 | LIGHT | DISH REQUIRING COOKING TIME LESS THAN 30 MIN. |
| 1513 | -25 | J25= | -25 | 9 | -25 | | |
| 1514 | -27 | J27= | -27 | 27 | -27 | | |
| 1515 | -29 | J29= | -29 | 23 | -29 | | |
| 1516 | -31 | J31= | -31 | 19 | -31 | | |
| 1517 | -33 | J33= | -33 | 26 | -33 | | |
| 1518 | -35 | J35= | -35 | 21 | -35 | | |
| 1519 | -37 | J37= | -37 | 17 | -37 | | |
| 1520 | -39 | J39= | -39 | 16 | -39 | | |
| 1521 | -41 | J41= | -41 | 22 | -41 | | |
| 1522 | -43 | J43= | -43 | 30 | CP-43 | HEAVY | DISH REQUIRING COOKING TIME NOT LESS THAN 30 MIN. |
| 1523 | -45 | J45= | -45 | 50 | -45 | | |
| 1524 | -47 | J47= | -47 | 35 | -47 | | |
| 1525 | -49 | J49= | -49 | 45 | -49 | | |
| 1526 | -51 | J51= | -51 | 55 | -51 | | |
| 1527 | -53 | J53= | -53 | 60 | -53 | | |
| 1528 | -55 | J55= | -55 | 30 | -55 | | |
| 1529 | -57 | J57= | -57 | 45 | -57 | | |
| 1530 | -59 | J59= | -59 | 55 | -59 | | |
| 1531 | -61 | J61= | -61 | 45 | -61 | | |
| 1532 | -63 | J63= | -63 | 40 | -63 | LIGHT | |
| 1533 | -65 | J65= | -65 | 30 | -65 | | |
| 1534 | -67 | J67= | -67 | 50 | -67 | | |
| 1535 | -69 | J69= | -69 | 40 | -69 | | |
| 1536 | -71 | J71= | -71 | 60 | -71 | | |
| 1537 | -73 | J73= | -73 | 50 | -73 | | |
| 1538 | -75 | J75= | -75 | 45 | -75 | | |
| 1539 | -77 | J77= | -77 | 35 | -77 | | |
| 1540 | -79 | J79= | -79 | 40 | -79 | | |
| 1541 | -81 | J81= | -81 | 55 | -81 | | |
| 1542 | -83 | J83= | -83 | 45 | -83 | | |
| 1543 | -85 | J85= | -85 | 10 | CP-85 | HEAVY | SOUP DISH |
| 1544 | -87 | J87= | -87 | 15 | -87 | | |
| 1545 | -89 | J89= | -89 | 10 | -89 | | |
| 1546 | -91 | J91= | -91 | 20 | -91 | | |
| 1547 | -93 | J93= | -93 | 15 | -93 | LIGHT | DISH REQUIRING COOKING TIME LESS THAN 30 MIN. |
| 1548 | -95 | J95= | -95 | 15 | -95 | | |
| 1549 | -97 | J97= | -97 | 10 | -97 | | |
| 1550 | -99 | J99= | -99 | 20 | -99 | | |

COOKING PROGRAM CODE

REQUIRED TIME

FIG.24

ALTERNATIVE MENU

COOKED FOOD PICTURE CODE

DISH CODE

FREQUENCY OF USE

| ADDRESS | | | | | | | |
|---|---|---|---|---|---|---|---|
| 1551 | SD-02 | J02= | SV-02 | 20 | CP-02 | HEAVY | DISH REQUIRING COOKING TIME LESS THAN 30 MIN. |
| 1552 | -04 | J04= | -04 | 15 | -04 | | |
| 1553 | -06 | J06= | -06 | 25 | -06 | | |
| 1554 | -08 | J08= | -08 | 21 | -08 | | |
| 1555 | -10 | J10= | -10 | 10 | -10 | | |
| 1556 | -12 | J12= | -12 | 15 | -12 | | |
| 1557 | -14 | J14= | -14 | 19 | -14 | | |
| 1558 | -16 | J16= | -16 | 23 | -16 | | |
| 1559 | -18 | J18= | -18 | 15 | -18 | | |
| 1560 | -20 | J20= | -20 | 13 | -20 | | |
| 1561 | -22 | J22= | -22 | 27 | -22 | | |
| 1562 | -24 | J24= | -24 | 19 | -24 | LIGHT | |
| 1563 | -26 | J26= | -26 | 20 | -26 | | |
| 1564 | -28 | J28= | -28 | 16 | -28 | | |
| 1565 | -30 | J30= | -30 | 13 | -30 | | |
| 1566 | -32 | J32= | -32 | 21 | -32 | | |
| 1567 | -34 | J34= | -34 | 23 | -34 | | |
| 1568 | -36 | J36= | -36 | 27 | -36 | | |
| 1567 | -38 | J38= | -38 | 20 | -38 | | |
| 1570 | -40 | J40= | -40 | 25 | -40 | | |
| 1571 | -42 | J42= | -42 | 21 | -42 | | |
| 1572 | -44 | J44= | -44 | 45 | CP-43 | HEAVY | DISH REQUIRING COOKING TIME NOT LESS THAN 30 MIN. |
| 1573 | -46 | J46= | -46 | 45 | -46 | | |
| 1574 | -48 | J48= | -48 | 30 | -48 | | |
| 1575 | -50 | J50= | -50 | 50 | -50 | | |
| 1576 | -52 | J52= | -52 | 45 | -52 | | |
| 1577 | -54 | J54= | -54 | 35 | -54 | | |
| 1578 | -56 | J56= | -56 | 50 | -56 | | |
| 1579 | -58 | J58= | -58 | 30 | -58 | | |
| 1580 | -60 | J60= | -60 | 40 | -60 | | |
| 1581 | -62 | J62= | -62 | 50 | -62 | | |
| 1582 | -64 | J64= | -64 | 35 | -64 | LIGHT | |
| 1583 | -66 | J66= | -66 | 35 | -66 | | |
| 1584 | -68 | J68= | -68 | 45 | -68 | | |
| 1585 | -70 | J70= | -70 | 45 | -70 | | |
| 1586 | -72 | J72= | -72 | 55 | -72 | | |
| 1587 | -74 | J74= | -74 | 55 | -74 | | |
| 1588 | -76 | J76= | -76 | 30 | -76 | | |
| 1589 | -78 | J78= | -78 | 40 | -78 | | |
| 1590 | -80 | J80= | -80 | 35 | -80 | | |
| 1591 | -80 | J82= | -82 | 60 | -82 | | |
| 1592 | -84 | J84= | -84 | 40 | -84 | | |
| 1593 | -86 | J86= | -86 | 10 | CP-86 | HEAVY | DISH REQUIRING COOKING TIME LESS THAN 30 MIN. |
| 1594 | -88 | J88= | -88 | 20 | -88 | | |
| 1595 | -90 | J99= | -90 | 15 | -90 | | |
| 1596 | -92 | J92= | -92 | 10 | -92 | | |
| 1597 | -94 | J94= | -94 | 25 | -94 | LIGHT | |
| 1598 | -96 | J96= | -96 | 20 | -96 | | |
| 1599 | -98 | J98= | -98 | 15 | -98 | | |
| 1600 | -100 | J100= | -100 | 10 | -100 | | |

COOKING PROGRAM CODE

REQUIRED TIME

NON-SOUP

SOUP DISH

FIG. 25

| ADDRESS | MAIN DISH CORNER | ONE SOUP | ONE DISH | ONE SOUP ONE DISH | TWO DISHES | INTERVIEW 1 (NUMBER OF ITEMS) ① | ② | ③ | ④ | ⑤ | INTERVIEW 2 (REQUIRED TIME) ① | ② | ③ | INTERVIEW 3 (APPETITE) ① | ② | ③ | INTERVIEW 4 (FREQUENCY OF USE) ① | ② | ③ | COMBINATION OF PREPARED SUB-DISHES AND DATA OF FREQUENCY OF USE (ONE SOUP→ONE DISH→ONE DISH) PROPOSED MENU | ONE SOUP | ONE DISH | ONE DISH | COMBINATION DETERMINATION |
|---|---|---|---|---|---|---|---|---|---|---|---|---|---|---|---|---|---|---|---|---|---|---|---|---|
| 2001 | MD-01 | ○ | | ○ | | ○ | | | | | | | | ○ | | | ○ | | | J85=L J86=S J01=L J02=S J87=L J88=S J03=S J04=L J89=S J90=L J05=S J06=L ALTERNATIVE MENU | SD-86 | DD-01 | | |
| 2002 | | ○ | | ○ | | ○ | | | | | | | | ○ | | | ○ | | | | -88 | -03 | | |
| 2003 | | ○ | | ○ | | ○ | | | | | | | | ○ | | | ○ | | | | -90 | -06 | | |
| 2004 | | | | | | | | | | | | | | | | | | | | | -94 | -09 | | |
| 2005 | | | | | | | | | | | | | | | | | | | | | -96 | -05 | | |
| 2006 | | | | | | | | | | | | | | | | | | | | | -97 | -27 | | |
| 2007 | | | | | | | | | | | | | | | | | | | | | -91 | -07 | | |
| 2008 | | | | | | | | | | | | | | | | | | | | | -99 | -29 | | |
| 2009 | | | | | | | | | | | | | | | | | | | | | | | | |
| 2010 | | ○ | | ○ | | ○ | | | | | | | | ○ | | | ○ | | | J85=L J86=S J43=L J44=S J87=L J88=S J45=S J46=L J89=S J90=L J27=S J48=L | SD-85 | SD-43 | | |
| 2011 | | ○ | | ○ | | ○ | | | | | | | | ○ | | | ○ | | | | -87 | -46 | | |
| 2012 | | ○ | | ○ | | ○ | | | | | | | | ○ | | | ○ | | | | -90 | -48 | | |
| 2013 | | | | | | | | | | | | | | | | | | | | | -94 | -64 | | |
| 2014 | | | | | | | | | | | | | | | | | | | | | -75 | -65 | | |
| 2015 | | | | | | | | | | | | | | | | | | | | | -97 | -67 | | |
| 2016 | | | | | | | | | | | | | | | | | | | | | -92 | -50 | | |
| 2017 | | | | | | | | | | | | | | | | | | | | | -89 | -69 | | |
| 2018 | | | | | | | | | | | | | | | | | | | | | -85 | -52 | | |
| 2019 | | ○ | | ○ | | ○ | | | | | | | | ○ | | | ○ | | | J85=L J86=S J01=L J02=S J87=L J88=S J43=L J44=S J89=S J90=L J03=S J04=L | SD-85 | SD-01 | | |
| 2020 | | ○ | | ○ | | ○ | | | | | | | | ○ | | | ○ | | | | -88 | -44 | | |
| 2021 | | ○ | | ○ | | ○ | | | | | | | | ○ | | | ○ | | | | -90 | -04 | | |
| 2022 | | | | | | | | | | | | | | | | | | | | | -98 | -63 | | |
| 2023 | | | | | | | | | | | | | | | | | | | | | -96 | -24 | | |
| 2024 | | | | | | | | | | | | | | | | | | | | | -98 | -65 | | |
| 2025 | | | | | | | | | | | | | | | | | | | | | -91 | -06 | | |
| 2026 | | | | | | | | | | | | | | | | | | | | | -99 | -67 | | |
| 2027 | | | | | | | | | | | | | | | | | | | | | -86 | -08 | | |

TWO IC CARDS AT THE SAME TIME FLOW CHART

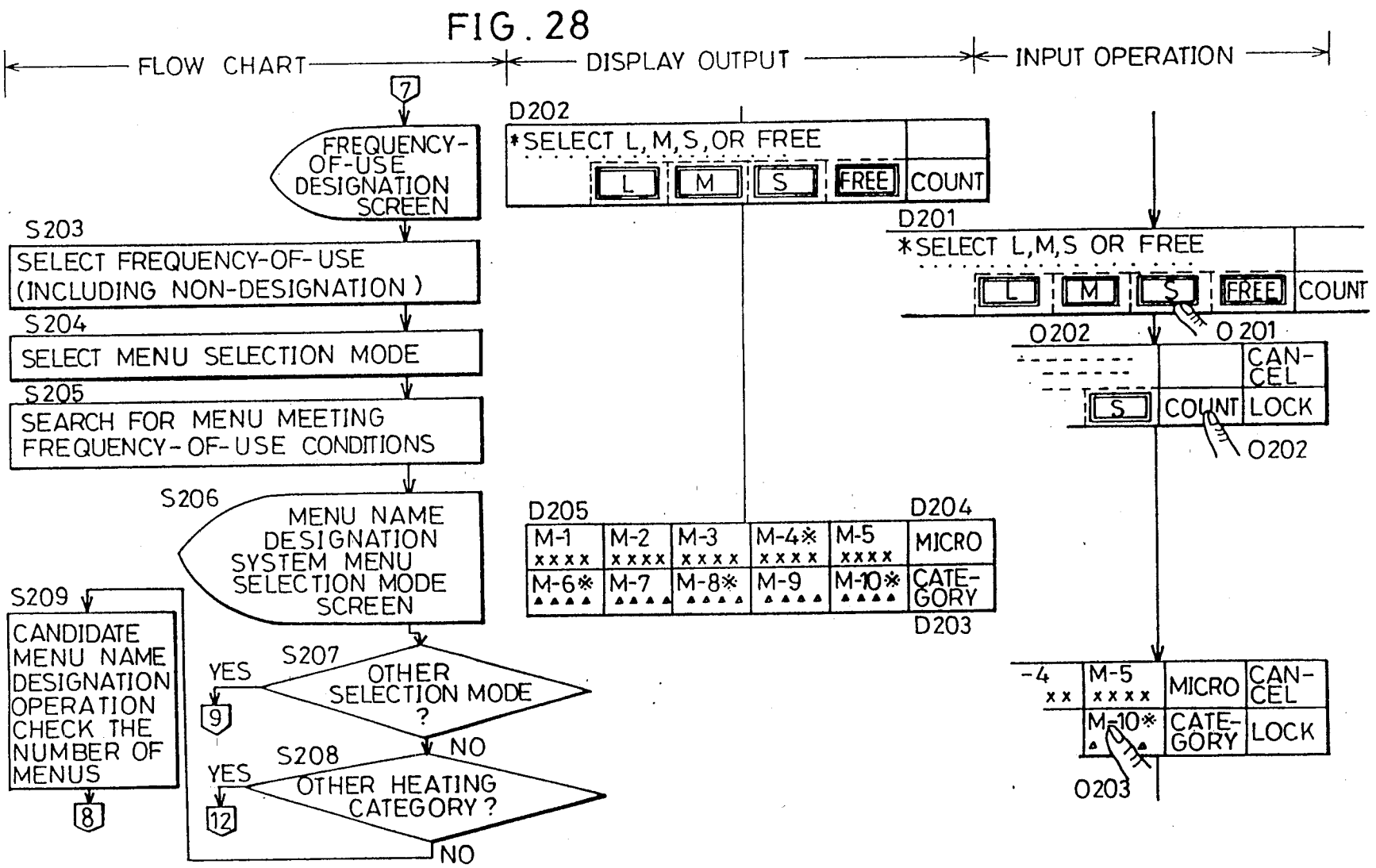
FIG. 28
FLOW CHART
DISPLAY OUTPUT
INPUT OPERATION
7
FREQUENCY-OF-USE DESIGNATION SCREEN
S203
SELECT FREQUENCY-OF-USE (INCLUDING NON-DESIGNATION)
S204
SELECT MENU SELECTION MODE
S205
SEARCH FOR MENU MEETING FREQUENCY-OF-USE CONDITIONS
S206
MENU NAME DESIGNATION SYSTEM MENU SELECTION MODE SCREEN
S207
OTHER SELECTION MODE ?
YES
9
NO
S208
OTHER HEATING CATEGORY ?
YES
12
NO
S209
CANDIDATE MENU NAME DESIGNATION OPERATION CHECK THE NUMBER OF MENUS
8
D202
*SELECT L,M,S,OR FREE
L
M
S
FREE
COUNT
D201
*SELECT L,M,S OR FREE
O202
O201
CAN-CEL
LOCK
COUNT
D204
D205
D203
M-1
M-2
M-3
M-4※
M-5
M-6※
M-7
M-8※
M-9
M-10※
MICRO
CATE-GORY
-4
O203

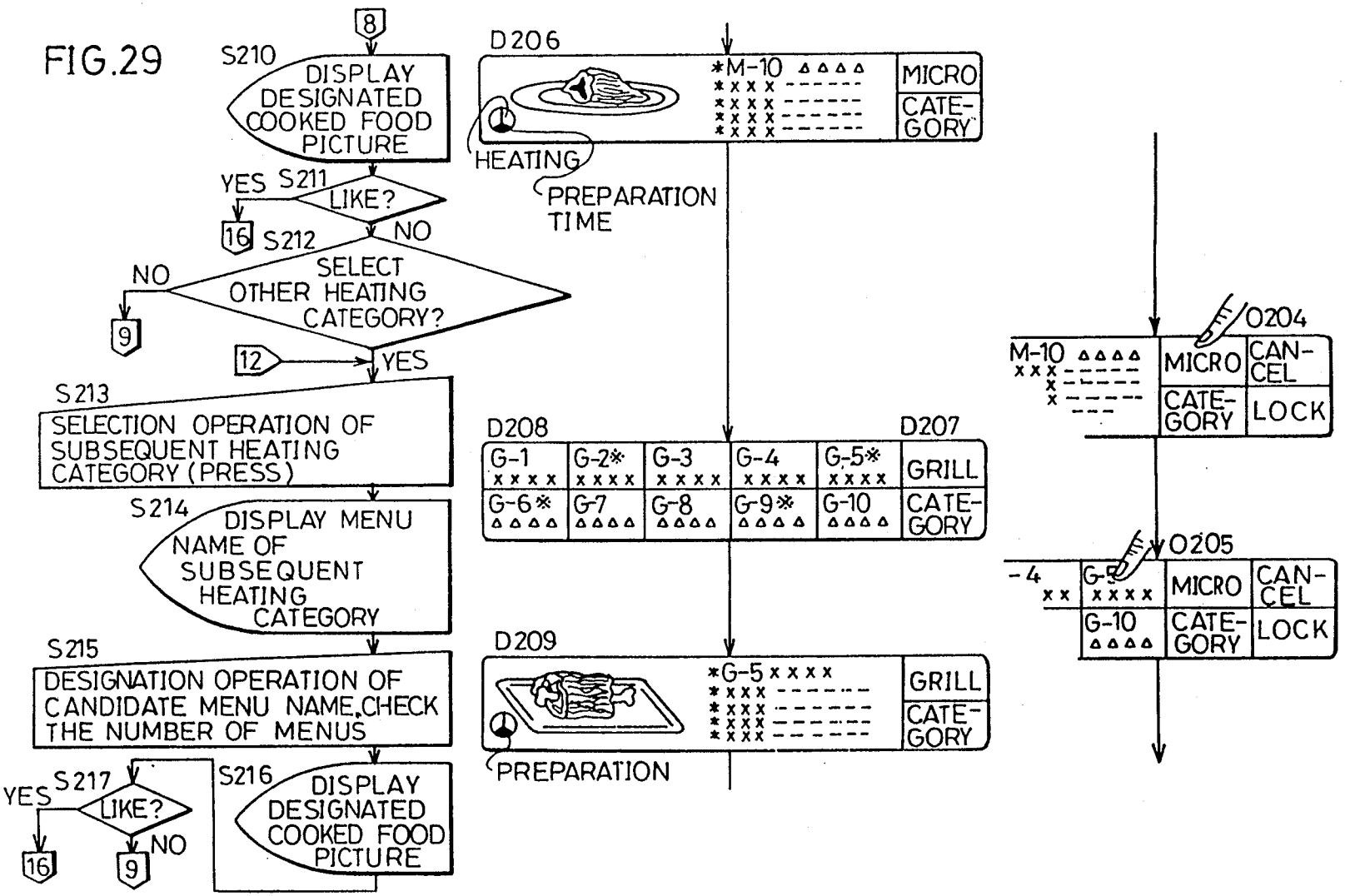
FIG.29
8
S210
DISPLAY DESIGNATED COOKED FOOD PICTURE
YES
S211
LIKE?
NO
16
S212
SELECT OTHER HEATING CATEGORY?
NO
9
YES
12
S213
SELECTION OPERATION OF SUBSEQUENT HEATING CATEGORY (PRESS)
S214
DISPLAY MENU NAME OF SUBSEQUENT HEATING CATEGORY
S215
DESIGNATION OPERATION OF CANDIDATE MENU NAME, CHECK THE NUMBER OF MENUS
S216
DISPLAY DESIGNATED COOKED FOOD PICTURE
S217
LIKE?
YES
16
NO
9
D206
*M-10
MICRO
CATE-GORY
HEATING
PREPARATION TIME
D208
G-1
G-2*
G-3
G-4
G-5*
G-6*
G-7
G-8
G-9*
G-10
D207
GRILL
CATE-GORY
D209
*G-5
GRILL
CATE-GORY
PREPARATION
M-10
MICRO
CAN-CEL
CATE-GORY
LOCK
O204
-4
G-9
G-10
MICRO
CAN-CEL
CATE-GORY
LOCK
O205

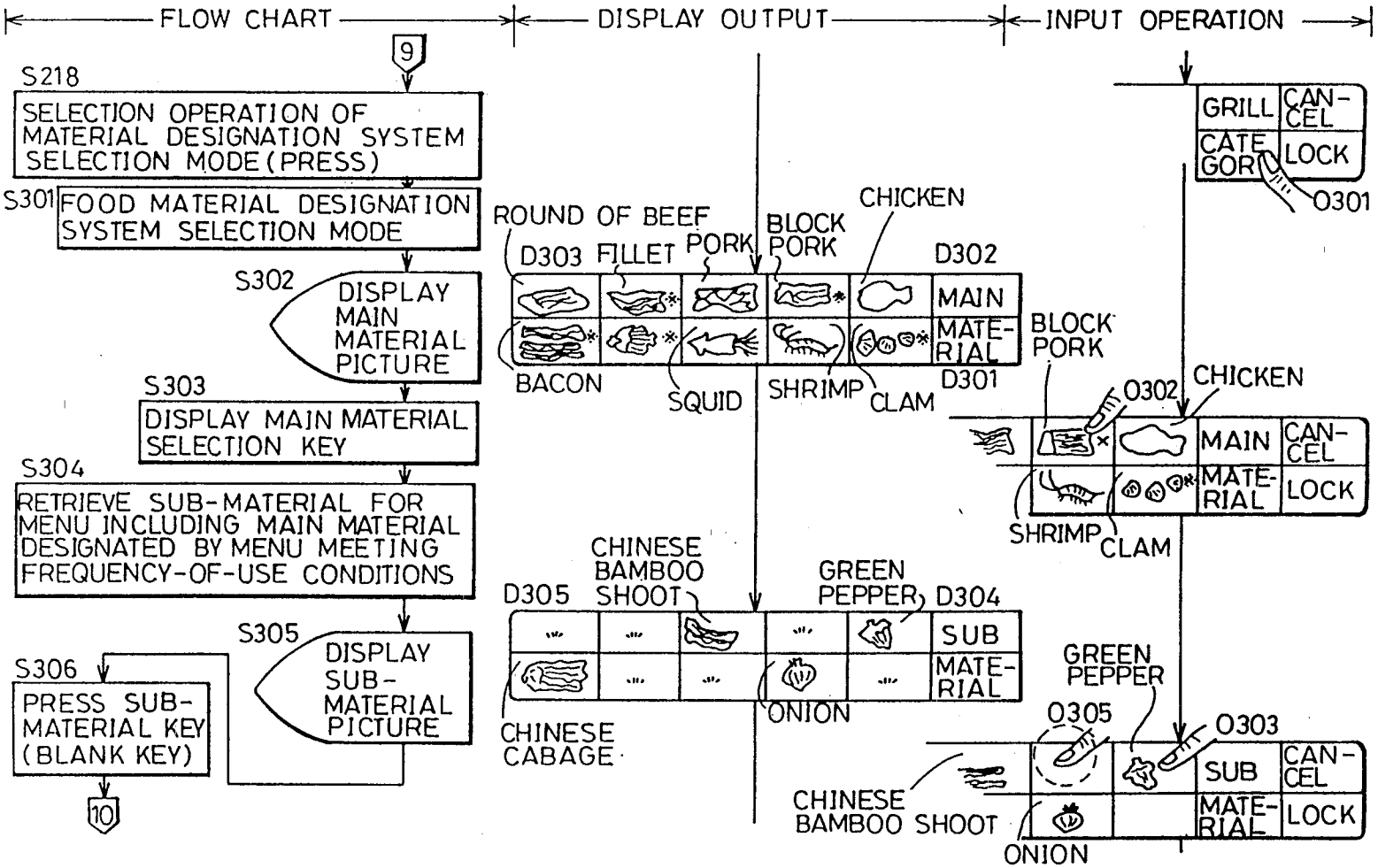
FIG. 30
FLOW CHART
DISPLAY OUTPUT
INPUT OPERATION
9
S218
SELECTION OPERATION OF MATERIAL DESIGNATION SYSTEM SELECTION MODE (PRESS)
S301
FOOD MATERIAL DESIGNATION SYSTEM SELECTION MODE
S302
DISPLAY MAIN MATERIAL PICTURE
S303
DISPLAY MAIN MATERIAL SELECTION KEY
S304
RETRIEVE SUB-MATERIAL FOR MENU INCLUDING MAIN MATERIAL DESIGNATED BY MENU MEETING FREQUENCY-OF-USE CONDITIONS
S305
DISPLAY SUB-MATERIAL PICTURE
S306
PRESS SUB-MATERIAL KEY (BLANK KEY)
10
GRILL
CATE GOR
CAN-CEL
LOCK
O301
MAIN
MATE-RIAL
CAN-CEL
LOCK
CHICKEN
O302
BLOCK PORK
SHRIMP
CLAM
D302
D301
ROUND OF BEEF
D303
FILLET PORK
BACON
SQUID
SUB
MATE-RIAL
D304
GREEN PEPPER
ONION
CHINESE BAMBOO SHOOT
D305
CHINESE CABAGE
O303
O305
CHINESE BAMBOO SHOOT

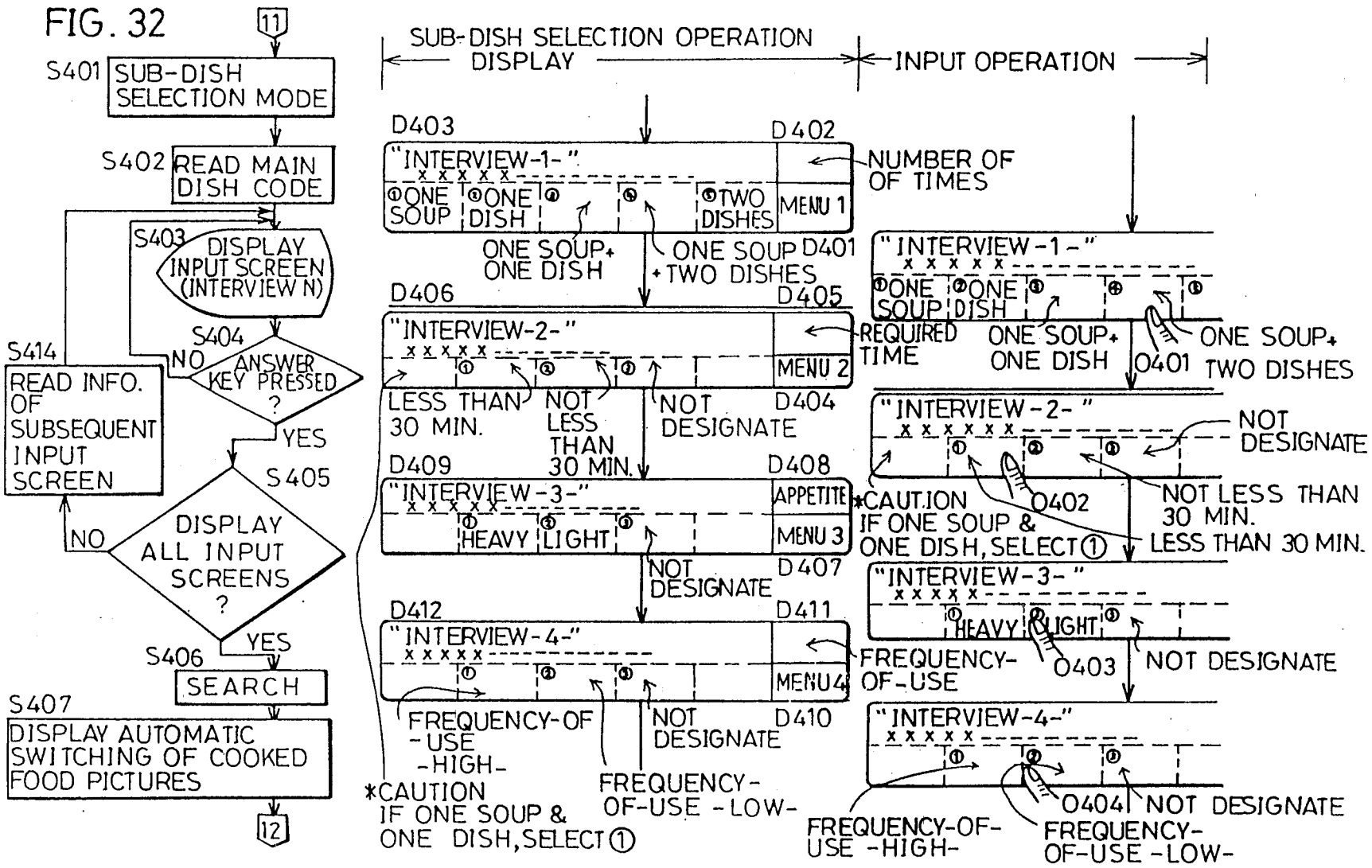
FIG. 32
S401
SUB-DISH SELECTION MODE
11
S402
READ MAIN DISH CODE
S403
DISPLAY INPUT SCREEN (INTERVIEW N)
S404
ANSWER KEY PRESSED ?
YES
NO
S405
DISPLAY ALL INPUT SCREENS ?
YES
NO
S406
SEARCH
S407
DISPLAY AUTOMATIC SWITCHING OF COOKED FOOD PICTURES
12
S414
READ INFO. OF SUBSEQUENT INPUT SCREEN
SUB-DISH SELECTION OPERATION DISPLAY
INPUT OPERATION
D403
"INTERVIEW-1-"
ONE SOUP
ONE DISH
TWO DISHES
D402
NUMBER OF OF TIMES
MENU 1
D406
"INTERVIEW-2-"
LESS THAN 30 MIN.
NOT LESS THAN 30 MIN.
ONE SOUP + TWO DISHES
ONE SOUP + ONE DISH
D401
D405
REQUIRED TIME
MENU 2
D404
NOT DESIGNATE
D409
"INTERVIEW-3-"
HEAVY
LIGHT
APPETITE
MENU 3
D408
*CAUTION IF ONE SOUP & ONE DISH, SELECT ①
D407
NOT DESIGNATE
D412
"INTERVIEW-4-"
FREQUENCY-OF -USE -HIGH-
FREQUENCY-OF-USE -LOW-
MENU 4
D411
FREQUENCY-OF-USE
D410
NOT DESIGNATE
*CAUTION IF ONE SOUP & ONE DISH, SELECT ①
"INTERVIEW-1-"
ONE SOUP + ONE DISH
ONE SOUP + ONE DISH
ONE SOUP + TWO DISHES
O401
"INTERVIEW-2-"
NOT DESIGNATE
NOT LESS THAN 30 MIN.
LESS THAN 30 MIN.
O402
"INTERVIEW-3-"
HEAVY
LIGHT
O403
NOT DESIGNATE
"INTERVIEW-4-"
FREQUENCY-OF-USE -HIGH-
FREQUENCY-OF-USE -LOW-
O404
NOT DESIGNATE

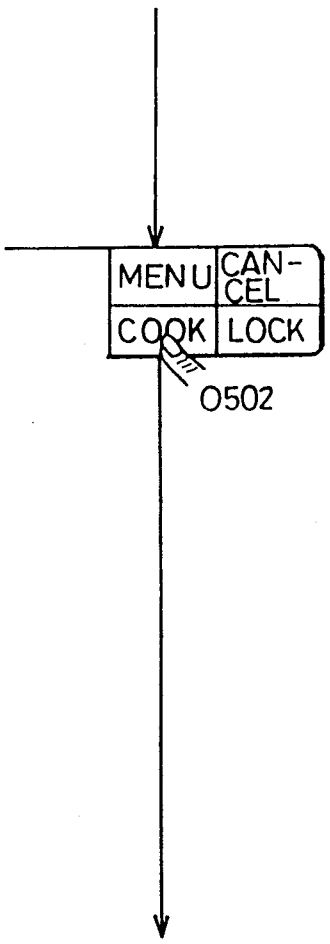
FIG. 35
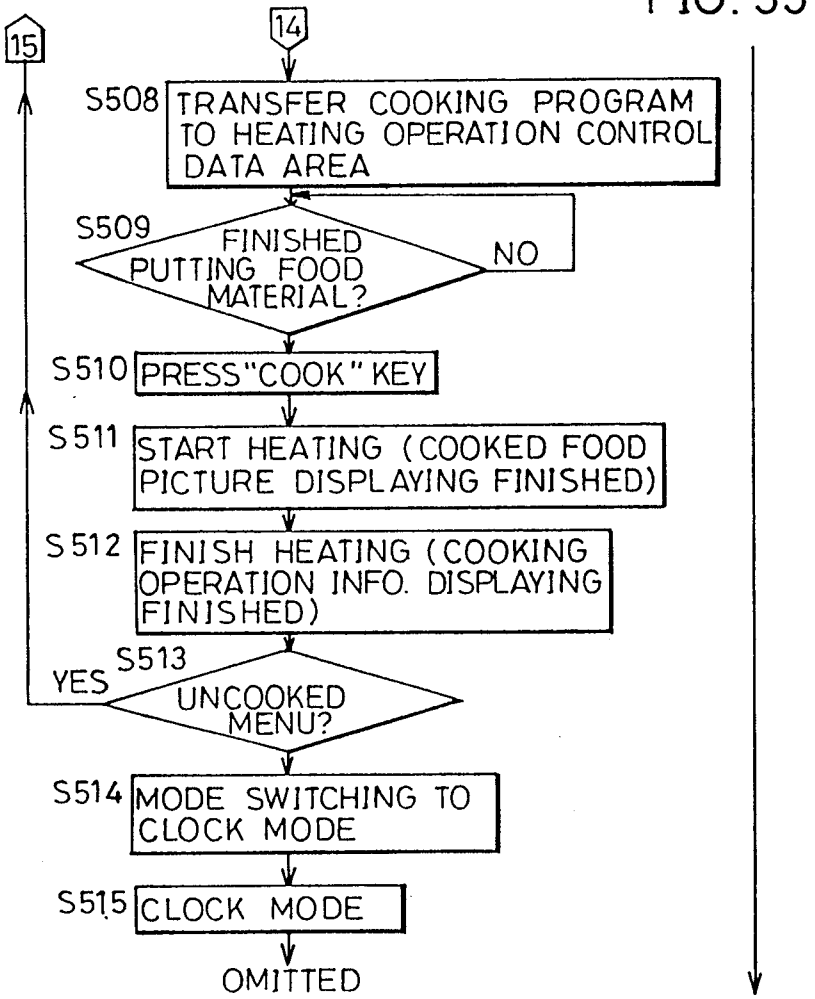

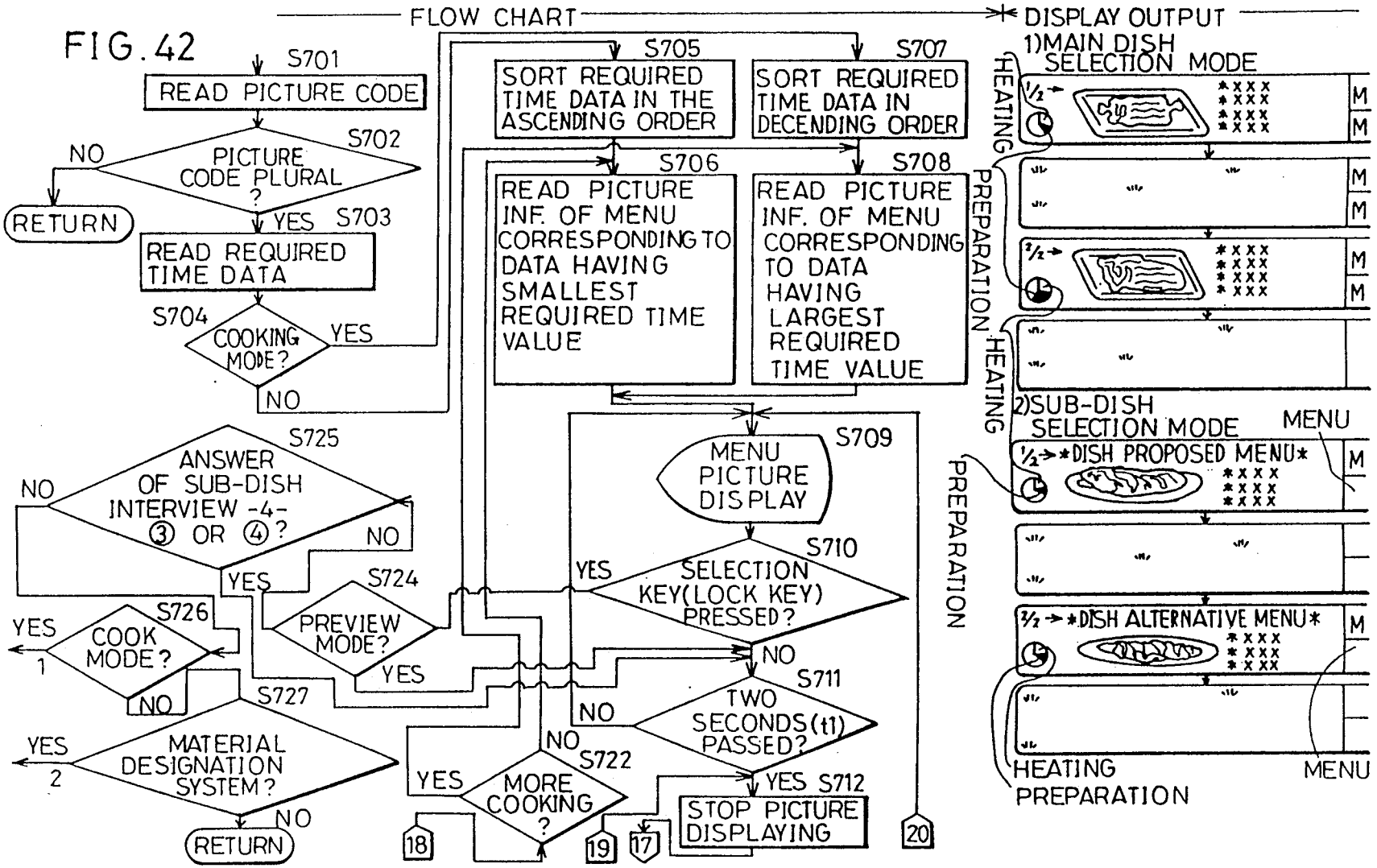
FIG. 42
FLOW CHART
DISPLAY OUTPUT
1)MAIN DISH SELECTION MODE
HEATING
PREPARATION
HEATING
2)SUB-DISH SELECTION MODE
MENU
DISH PROPOSED MENU
PREPARATION
DISH ALTERNATIVE MENU
MENU
HEATING
PREPARATION
S701
READ PICTURE CODE
S702
PICTURE CODE PLURAL ?
NO
RETURN
YES
S703
READ REQUIRED TIME DATA
S704
COOKING MODE?
YES
NO
S705
SORT REQUIRED TIME DATA IN THE ASCENDING ORDER
S706
READ PICTURE INF. OF MENU CORRESPONDING TO DATA HAVING SMALLEST REQUIRED TIME VALUE
S707
SORT REQUIRED TIME DATA IN DECENDING ORDER
S708
READ PICTURE INF. OF MENU CORRESPONDING TO DATA HAVING LARGEST REQUIRED TIME VALUE
S709
MENU PICTURE DISPLAY
S710
SELECTION KEY(LOCK KEY) PRESSED?
YES
NO
S711
TWO SECONDS(t1) PASSED?
NO
YES
S712
STOP PICTURE DISPLAYING
20
17
19
18
S722
MORE COOKING ?
NO
YES
S724
PREVIEW MODE?
YES
NO
S725
ANSWER OF SUB-DISH INTERVIEW -4- ③ OR ④ ?
NO
YES
S726
COOK MODE ?
YES
NO
1
S727
MATERIAL DESIGNATION SYSTEM?
YES
NO
2
RETURN

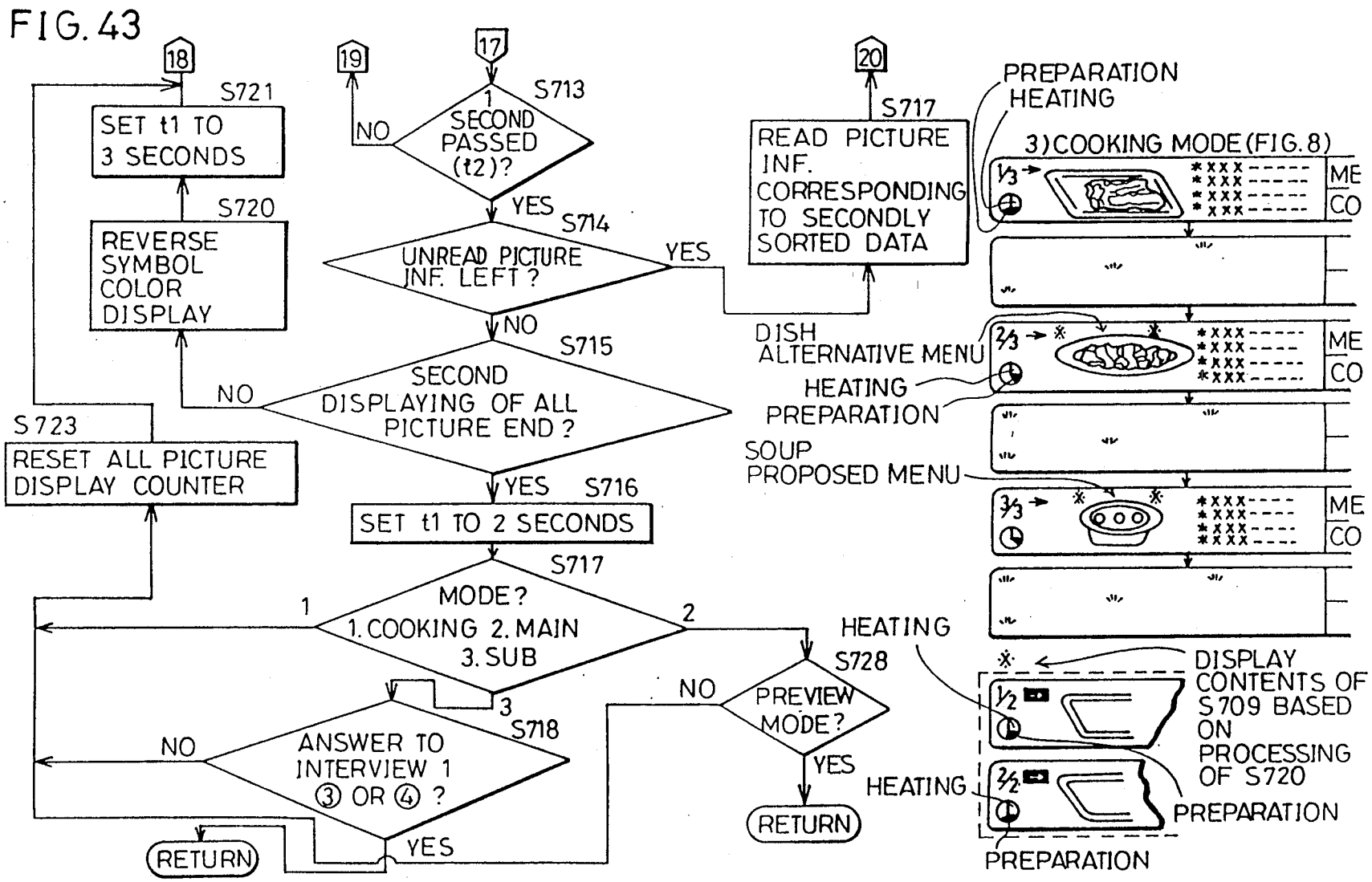
FIG. 43
17
18
19
20
S713
SECOND PASSED (t2)?
YES
NO
S714
UNREAD PICTURE INF. LEFT?
YES
NO
S715
SECOND DISPLAYING OF ALL PICTURE END?
YES
NO
S716
SET t1 TO 2 SECONDS
S717
MODE? 1.COOKING 2.MAIN 3.SUB
1
2
3
S718
ANSWER TO INTERVIEW 1 ③ OR ④?
YES
NO
RETURN
S721
SET t1 TO 3 SECONDS
S720
REVERSE SYMBOL COLOR DISPLAY
S723
RESET ALL PICTURE DISPLAY COUNTER
S717
READ PICTURE INF. CORRESPONDING TO SECONDLY SORTED DATA
PREPARATION HEATING
3)COOKING MODE (FIG.8)
ME
CO
DISH ALTERNATIVE MENU
HEATING PREPARATION
SOUP PROPOSED MENU
HEATING
DISPLAY CONTENTS OF S709 BASED ON PROCESSING OF S720
PREPARATION
HEATING
PREPARATION
S728
PREVIEW MODE?
YES
NO
RETURN

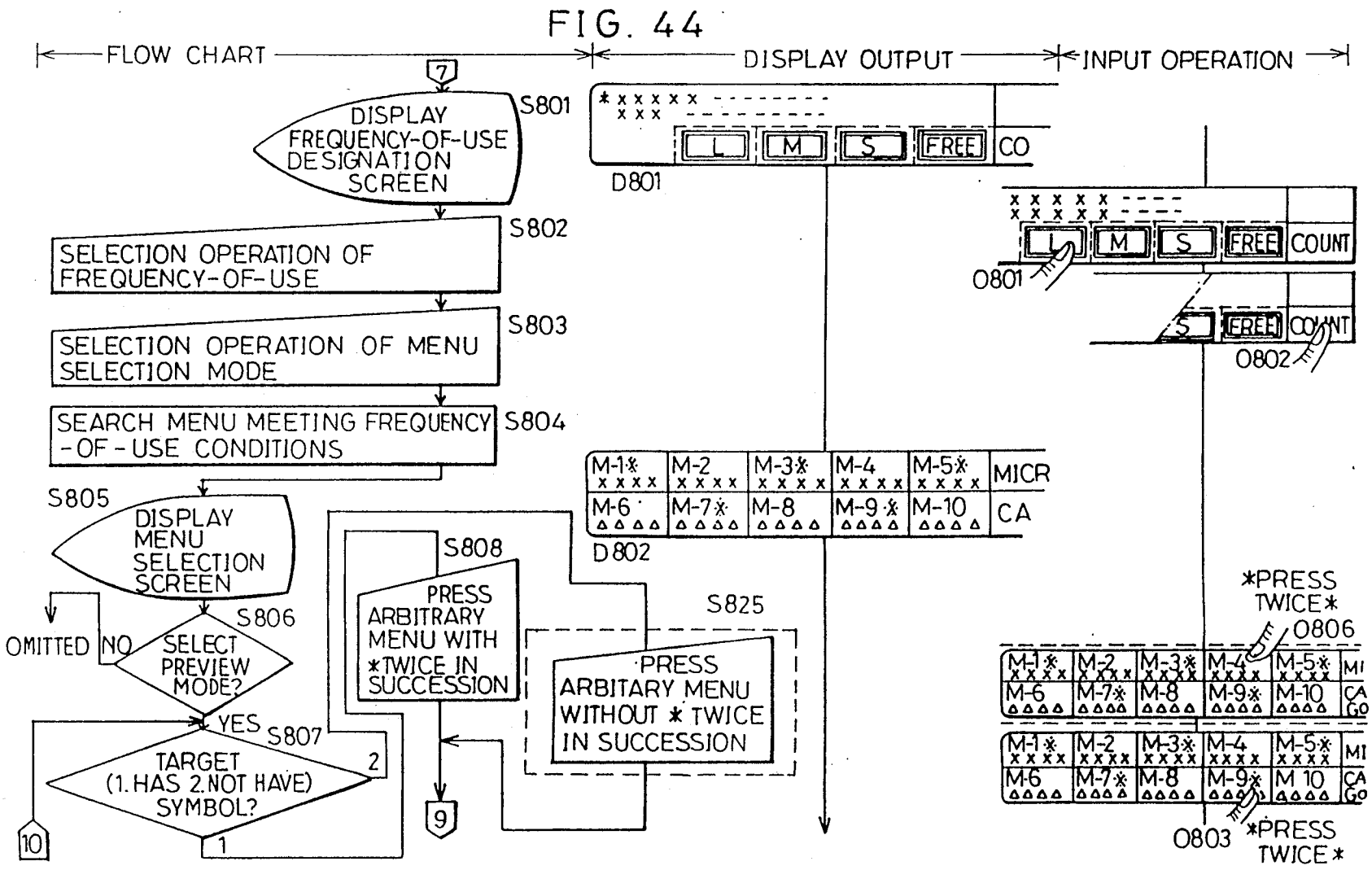
FIG. 44
FLOW CHART
DISPLAY OUTPUT
INPUT OPERATION
S801
DISPLAY FREQUENCY-OF-USE DESIGNATION SCREEN
S802
SELECTION OPERATION OF FREQUENCY-OF-USE
S803
SELECTION OPERATION OF MENU SELECTION MODE
S804
SEARCH MENU MEETING FREQUENCY -OF-USE CONDITIONS
S805
DISPLAY MENU SELECTION SCREEN
S806
SELECT PREVIEW MODE?
NO
OMITTED
YES
S807
TARGET (1.HAS 2.NOT HAVE) SYMBOL?
S808
PRESS ARBITRARY MENU WITH *TWICE IN SUCCESSION
S825
PRESS ARBITARY MENU WITHOUT * TWICE IN SUCCESSION
D801
D802
O801
O802
O803
O806
*PRESS TWICE*
COUNT
FREE
MICR
CO
CA

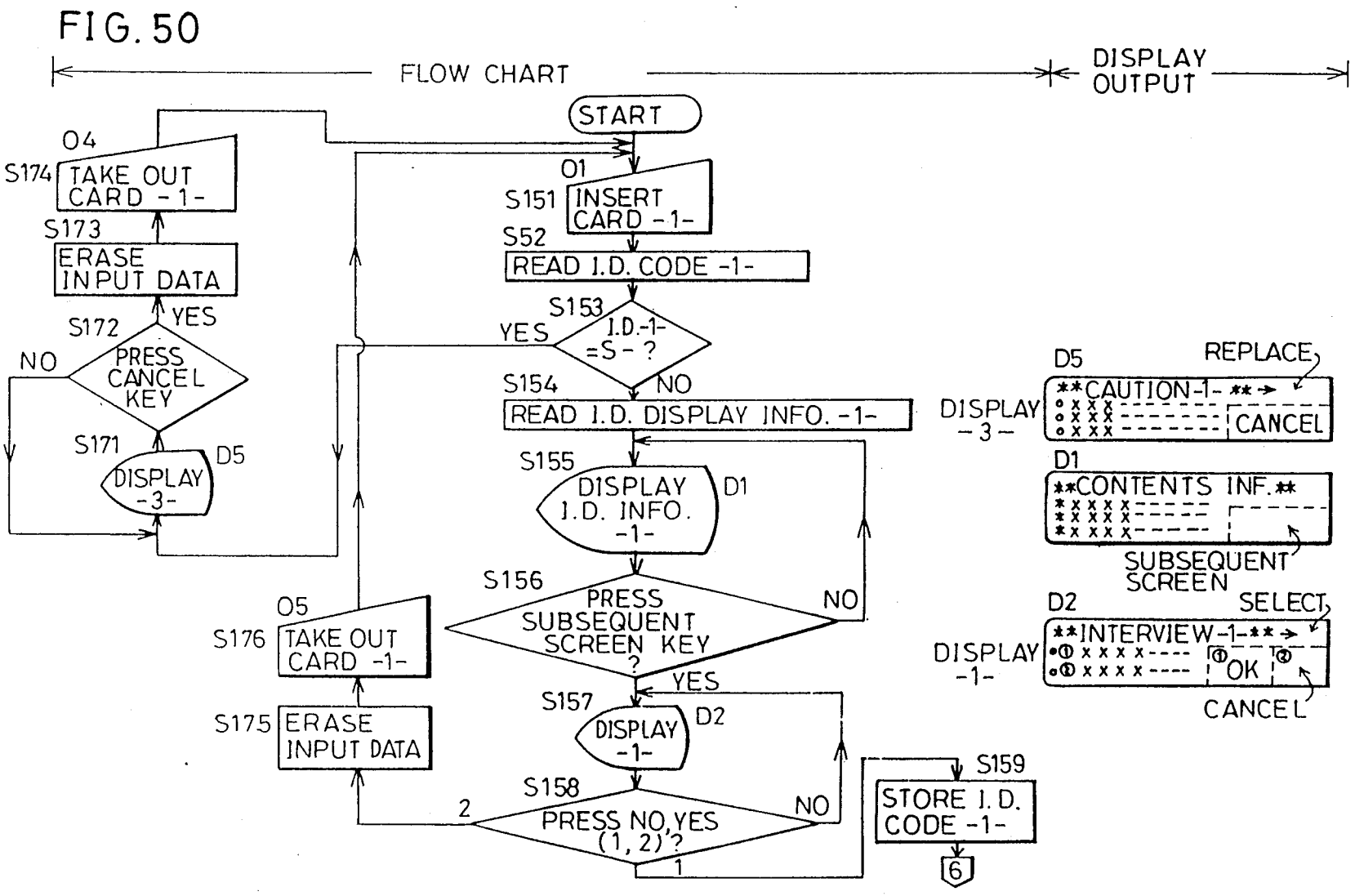
FIG. 50
FLOW CHART
DISPLAY OUTPUT
START
O1
S151
INSERT CARD -1-
S52
READ I.D. CODE -1-
S153
I.D.-1- =S-?
YES
NO
S154
READ I.D. DISPLAY INFO. -1-
S155
DISPLAY I.D. INFO. -1-
D1
S156
PRESS SUBSEQUENT SCREEN KEY?
NO
YES
S157
DISPLAY -1-
D2
S158
PRESS NO,YES (1,2)?
NO
1
2
S159
STORE I.D. CODE -1-
6
O5
S176
TAKE OUT CARD -1-
S175
ERASE INPUT DATA
O4
S174
TAKE OUT CARD -1-
S173
ERASE INPUT DATA
S172
PRESS CANCEL KEY
YES
NO
S171
DISPLAY -3-
D5
D5
DISPLAY -3-
REPLACE
CAUTION-1-
CANCEL
D1
CONTENTS INF.
SUBSEQUENT SCREEN
D2
DISPLAY -1-
INTERVIEW-1-
SELECT
OK
CANCEL

MICROWAVE OVEN HAVING PREPARATION OF MENU ASSISTING FUNCTION

BACKGROUND OF THE INVENTION

The basic foreign application filed in Japan, No. 3-245764, on Sep. 25, 1991 is herein incorporated by reference.

FIELD OF THE INVENTION

The present invention relates generally to microwave ovens which perform heating, based on cooking programs stored in a memory in advance. More particularly, it relates to microwave ovens having a function assisting of a user in preparing a menu, that is, to select a plurality of cooking programs.

DESCRIPTION OF THE RELATED ART

A heating function of a microwave oven has been expanded through application of heating elements as a heating device and introduction of convection heating as heating system. The convection a heating refers to a system of heating food by forcibly circulating heated air in an oven chamber by a fan provided in the rear of a heating element.

Along with such expansion of functions of a microwave oven, grill heating and convection heating by using heating elements have been proposed in addition to microwave heating, which have been provided since microwave ovens were first put onto market. Further proposed is compound heating which combines microwave heating and grill heating or convection heating, which is followed by an increase in the number of possible cooking menus.

Meanwhile, it is necessary to make cooking software (heating programs) for a large number of menus available to anyone, the menus being developed in line with the development of usable cooking software (that is, heating programs) for microwave ovens as described above. In order to meet such a necessity, microcomputers and sensor technology have promoted automation of cooking software (that is, a cooking operation program) for each menu requiring microwave heat cooking, heater heat cooking and compound heat cooking.

A technique for making this cooking software available to a user is disclosed in Japanese Patent Laying-Open No. 01-212827. The technique disclosed in this document is directed to facilitating the handling of a microwave oven under such conditions where a suer lacks information (name of menu and menu code corresponding to the name of the menu) for specifying cooking software to be selected or sufficient knowledge of kinds of prepared cooking software, or that the user himself has not yet decided upon a desired specific menu.

The basic idea of this technique resides in the replacement of an operation of selecting a specific desired menu among numerous cooking menus with a selection subjectively made by a user such as a selection of likes/-dislikes factors constituting the menu, that is, food materials. Such subjective selection requires no knowledge of menus. The microwave oven disclosed in Japanese Patent Laying-Open No. 01-212827 will be described in the following.

In this microwave oven, pictures of cooked foods of a plurality of menus are displayed which are selected by a combination of food materials designated by a user, and the user selects a desired menu by referring to the plurality of pictures of cooked foods, thereby setting a cooking program for the selected menu.

FIG. 1 is a perspective view of a front upper portion of a control unit 42 provided in the front portion of a main body of a conventional microwave oven. FIG. 2 is a partially sectional side view of the control unit 42 shown in FIG. 1.

With reference to FIGS. 1 and 2, the control unit 42 includes a cover panel 43 and a function unit 41 attached inside the cover panel 43.

FIG. 3 is a front over view of the function unit 41. With reference to FIG. 3, the function unit 41 includes a display 44 for displaying information about cooking, a plurality of main material input switches 45 for selecting main materials, a plurality of sub-material input switches 46 for selecting sub-materials and a menu selection mode switch 47. The function unit 41 further includes a memory (not shown). The memory is loaded with a series of cooking information by an external memory such as IC (Integrated Circuit) card or a RAM (Random Access Memory) pack and menu selecting operation is controlled based on this cooking information.

The menu selecting operation will be described in the following with reference to FIG. 4. FIG. 4 is a flow chart showing the menu selecting operation, with steps of operating the respective switches shown on the right hand side and display contents of respective display portions at each step shown on the left hand side. With reference to FIG. 4, when the menu selection mode switch 47 is pressed at the operation step 01, a main material indication lamp 48 provided on the left side of the main material input switch 45 flashes at the display step D1. This commands an operator to select a main material at first.

At the operation step 02, the operator presses a main material input switch 49 corresponding to a main material "beef" to be used with reference to the illustration displayed on the main material input switch 45. As a result, the main material "beef" is selected. This operation results in flashing of a designated main material indication lamp 50 corresponding to the main material "beef" in the display step D2, the lamp being provided for each of the main material input switches 45. Such a flash indicates that "beef" is designated as a main material.

Subsequently, main material information stored in the memory (not shown) of the function unit 41 is searched to read sub-material information relating to the main material "beef" and stored in advance. It is assumed that "Chinese bamboo shoot" and "Chinese cabbage" are related to "beef," for example, as sub-material information. Designation indication lamps 51, 51 corresponding to the read sub-materials "Chinese bamboo shoot" and "Chinese cabbage" flash at step D3. As a result, "Chinese bamboo shoot" and "Chinese cabbage" are presented to the user as sub-materials related to the main material "beef." In response to the flash of the designated sub-material indication lamp, the user presses sub-material input switches 52 and 53 corresponding to the sub-materials "Chinese bamboo shoot" and "Chinese cabbage," thereby designating the sub-materials. As a result, a control unit retrieves a menu meeting the conditions that the designated sub-materials "Chinese bamboo shoot" and "Chinese cabbage" by searching storing means and displays a picture of cooked food of the retrieved menu on the display 44 at step D4.

In this case, if there exists no menu meeting the combination of "beef"—"Chinese bamboo shoot"—"-Chinese cabbage," the menu combining "beef" and "Chinese bamboo shoot" and the menu combining "beef" and "Chinese cabbage" are retrieved and displayed. It is not always necessary to designate a sub-material corresponding to a flashing designated sub-material indication lamp 51. By pressing a sub-material input switch 46 corresponding to an arbitrary designated sub-material indication lamp 51 which is not flashing, a menu using "beef" as a main material is searched.

As described in the foregoing, the user's intention determines a desired main material to be used and a sub-material to accompany the main material or likes/-dislikes of a picture of cooked food of a menu shown on the display 44. Therefore, it is possible to easily select a suitable menu at a stage where the user has not decided as to which menu to be cooked even if he lacks sufficient knowledge of the menu stored in an IC card or a RAM pack.

As described in the foregoing, a conventional microwave oven allows an application of new cooking software developed one after another by the following two measures.

(1) Cooking information (cooking program and information on a picture of cooked food) can be supplied through an external memory, for example, an IC card.

(2) Menus can be subjectively selected by a user based on factors such as a designation of a main material to be used a designation of a sub-material in a range determined by the designated main material, and likes/dislikes of a displayed picture of a cooked food.

The above-described conventional microwave oven further includes measures to enable selection of a menu (sub-dish) to be served together with a selected menu (main dish). FIG. 5 is a data map of an external memory such as an IC card for storing cooking information. With reference to FIG. 5 a data area of the external memory is divided into a data area 55 for storing data for searching main dishes, a data area 56 for storing data for searching sub-dish related to one of the main dishes stored in the data area 55, a picture information data area 57 for storing information about pictures of cooked states of each main dish and each sub-dish and a cooking program code corresponding thereto, and a cooking program data area 58 for storing cooking program information specified by a cooking program code stored in the picture information data area 57 and corresponding to each picture information code.

After the user's operation as described above for designating a main dish, the user operates the oven to designate a sub-dish corresponding to the selected main dish, thereby commencing a retrieval of sub-dish information meeting the condition of selected composition and number of items to be served out of sub-dish information related to the selected main dish. The picture of the cooked state of the retrieved sub-dish is provided to the display 44. Conditions which can designated by a user when in selecting a sub-dish include selection concerning such a determination of composition and the number of items to be served as described in the following:

(1) Designation of "one soup and one dish," that is, a combination of one soup, and one sub-dish, or (2) designation of "one soup" or "one dish" (i.e. a combination of one soup "or" one sub-dish).

The above-described microwave oven of the conventional art selects a menu by a plurality of subjective of decisions made by a user. It is therefore possible to easily select a desired menu even if a user lacks sufficient knowledge of the contents of an external memory storing newly developed cooking software.

The above-described conventional microwave oven, however, has the following problems.

In a conventional microwave oven, new cooking software is supplied through an external memory such as an IC card. Therefore, there is room for making full use of newly developed cooking software in selecting a dish which is the core of the dining, that is, a main dish. However, concerning selection of another dish or a plurality of other dishes constituting a menu for one dining, that is, selection of a sub-dish, the degree of freedom is low. An IC card which stores the above-described main dish cooking information has one block which stores cooking information for sub-dishes. Only those sub-dishes are available, the combination of which with the main dishes is determined at the time of development of cooking software for a main dish. In other words, a conventional microwave oven, when a specific main dish is selected, it has a fixed number and fixed contents of sub-dishes to be combined with the main dish.

In addition, the menu decision by the above microwave oven is made only from a person's point of view who will have the cooked dishes, but not from a viewpoint of an operator as a cook.

In general, the time that a cook can use for cooking. It must be emphasized that even the same cook can have different periods of time. In other words, even the same dish requires various cooking time according to the experience of a cook. If spare time differs from one day to another, a time which can be used for cooking is varied accordingly.

Such restrictions on a cook should be considered when in deciding the constitution of dishes to be served at one dining. By doing so, an appropriate selection order for dishes can be presented in consideration of a possibility of realization of dishes. A conventional microwave oven lacks consideration from such a point of view.

In a conventional microwave oven, an ultimate dish is decided by selecting a dish among displayed pictures of cooked dishes as candidates. However, the order of displayed pictures of the cooked dishes is simply the order of searched picture information. It is more practical if the display order is given orientation toward an object corresponding to an operation to be made. The conventional microwave oven, however, does not have such orientation toward an object. In addition, switching of a plurality of displayed pictures in the conventional microwave oven is carried out by a complicated manual operation by a user. Such problem should be also resolved.

Furthermore, as described in the section of "Description of the Related Art," concerning "sub-materials" among food materials to be designated, a search of the menu is performed even if all of conditions are not designated. However, the less the number of conditions designated becomes, the more the number of displayed pictures of menus to be searched and output becomes. Therefore, switching of displayed pictures by manual operation as described above requires numerous operations for searching all of the candidate materials. In other words, a conventional switching of displayed pictures is not suitable for searching menus by incomplete designation of conditions as described above. Concerning sub-dishes, if a method is adopted of selecting a desired dish among displayed pictures of cooked states of a plurality of candidates dishes, the number of operations for switching displayed pictures of cooked sub-dishes is drastically increased. Such manual display switching operation is a burden on a user, which is to be improved.

The conventional microwave oven has a further problem as follows. It is assumed that all dishes served for one dining are prepared by heat cooking by a microwave oven. In this case, cooking programs for a dish selected by the above-described menu selecting operation are sequentially called according to cooking and heating operations. In order to efficiently carry out the cooking, the order of cooking and heating operations is an important factor. That is, "organization" is important.

The order of switching of displayed pictures of cooked dishes at the time of cooking should correspond to the order of calling of the cooking programs and can be different from the order at the time of selecting dishes. With such difference in the order, it is inefficient to display pictures of cooked dishes in the same order in different operation modes. Such a problem should also be solved.

SUMMARY OF THE INVENTION

Therefore, an object of the present invention is to provide a microwave oven allowing an easy development of a variation of combinations of main dishes and sub-dishes.

Another object of the present invention is to provide a microwave oven allowing an easy development of a variation of combinations of main dishes and sub-dishes and capable of preparing a menu having an appropriate combination.

A further object of the present invention is to provide a microwave oven allowing an easy development of a variation of combinations of main dishes and sub-dishes and capable of reliably preparing a menu having an appropriate combination of main and sub-dishes.

An additional object of the present invention is to easily develop a variation of combinations of main and sub-dishes and reliably prepare, with ease, a menu having an appropriate combination of main and sub-dishes.

Another additional object of the present invention is to provide a microwave oven allowing an easy development of a variation of combinations of main dishes and sub-dishes and capable of efficiently performing processing both in preparation of a menu and execution of cooking programs.

A further object of the present invention is to provide a microwave oven allowing an easy development of a variation of combinations of main dishes and sub-dishes and capable of acknowledging/displaying a menu in an appropriate order according to operation modes of the microwave oven at the time of preparing a menu and executing cooking.

A still further object of the present invention is to provide a microwave oven allowing an easy development of a variation of combinations of main dishes and sub-dishes and capable of designating, in a short processing time period, various dishes by various selection methods with a variation of sub-dish selecting methods at the time of preparing a menu.

An additional object of the present invention is to provide a microwave oven allowing an easy development of a variation of combinations of main dishes and sub-dishes and capable of designating, in a short time period and with ease, various dishes by various selecting methods with a large variation of sub-dish selecting methods at the time of preparing a menu.

The microwave oven according to the present invention includes a cooking unit for cooking food according to cooking programs for specifying a cooking procedure, and an external memory attachment mechanism to which an external memory of a first type for storing a plurality of kinds of main cooking information relating to a main dish, and an external memory of a second type for storing a plurality of kinds of sub-cooking information to be auxiliary combined with the main cooking, are detachably provided. Each of the main cooking information is related to at least one sub-cooking information. The microwave oven further includes a main cooking information selection unit by which a user selects one of the main cooking information stored in the external memory of the first type attached to the external memory attachment mechanism, a sub-cooking information selection unit for assisting a user to select sub-cooking information related to the selected main cooking information and stored in the external memory of the second type attached to the external memory attachment mechanism for preparing a menu, a selected program memory for storing one or a plurality of cooking programs selected by the user, a cooking controller for applying the cooking program stored in the selected program memory to the cooking unit in a predetermined order for execution, and a display device for visually displaying information required for the user's preparation of the menu by using the main cooking information selection unit and the sub-cooking information selection unit and visually displaying information relating to the cooking programs prior to the execution of the cooking programs by the cooking controller.

In this microwave oven, the plurality of kinds of main cooking information are stored in the external memory of the first type and the plurality of kinds of sub-cooking information are stored in the external memory of the second type. These external memories are detachably provided in the attachment mechanism. The main cooking information and the sub-cooking information are separately stored in the external memories. Because a combination of the main cooking information and the sub-cooking information is not fixed, the combination of main cooking and sub-cooking can be more freely developed than by a conventional microwave oven. As a result, a microwave oven can be provided which allows an easy development of a variation of combinations of main dishes and sub-dishes.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 5 is a schematic diagram showing an arrangement of data stored in a main memory (not shown) in the function unit shown in FIG. 3.

FIG. 23 is a schematic diagram of a data storage area for main dishes.

FIG. 24 is a schematic diagram of a data storage area for sub-dishes.

FIG. 25 is a schematic diagram showing an arrangement of a search data area in a data area in the IC card for selecting sub-dishes as shown in FIGS. 6 and 7.

FIGS. 26 to 35 are flow charts of a program to be executed by the microwave oven according to one embodiment of the present invention.

FIG. 42 is a flow chart of a routine for automatically switching and displaying finished dish pictures according to the embodiment of the present invention.

FIG. 43 is a flow chart showing the routine for automatically switching and displaying finished dish pictures.

FIG. 44 is a flow chart of a program necessary for selecting a menu by designating the frequency of uses.

FIG. 50 is a flow chart of a program for checking a combination of two IC cards and the order of insertion in a microwave oven including one slot.

DETAILS DESCRIPTION OF THE PREFERRED EMBODIMENTS

Figure 1:
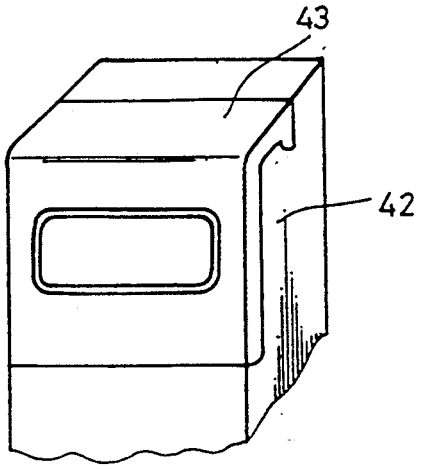
FIG. 1 PRIOR ART
FIG. 1 is a perspective view of an upper portion of a control unit of a conventional microwave oven.
Figure 2:
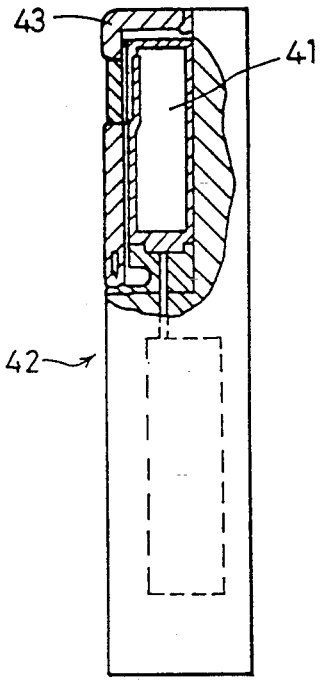
FIG. 2 PRIOR ART
FIG. 2 is a partially sectional side view of the control unit shown in FIG. 1.
Figure 3:
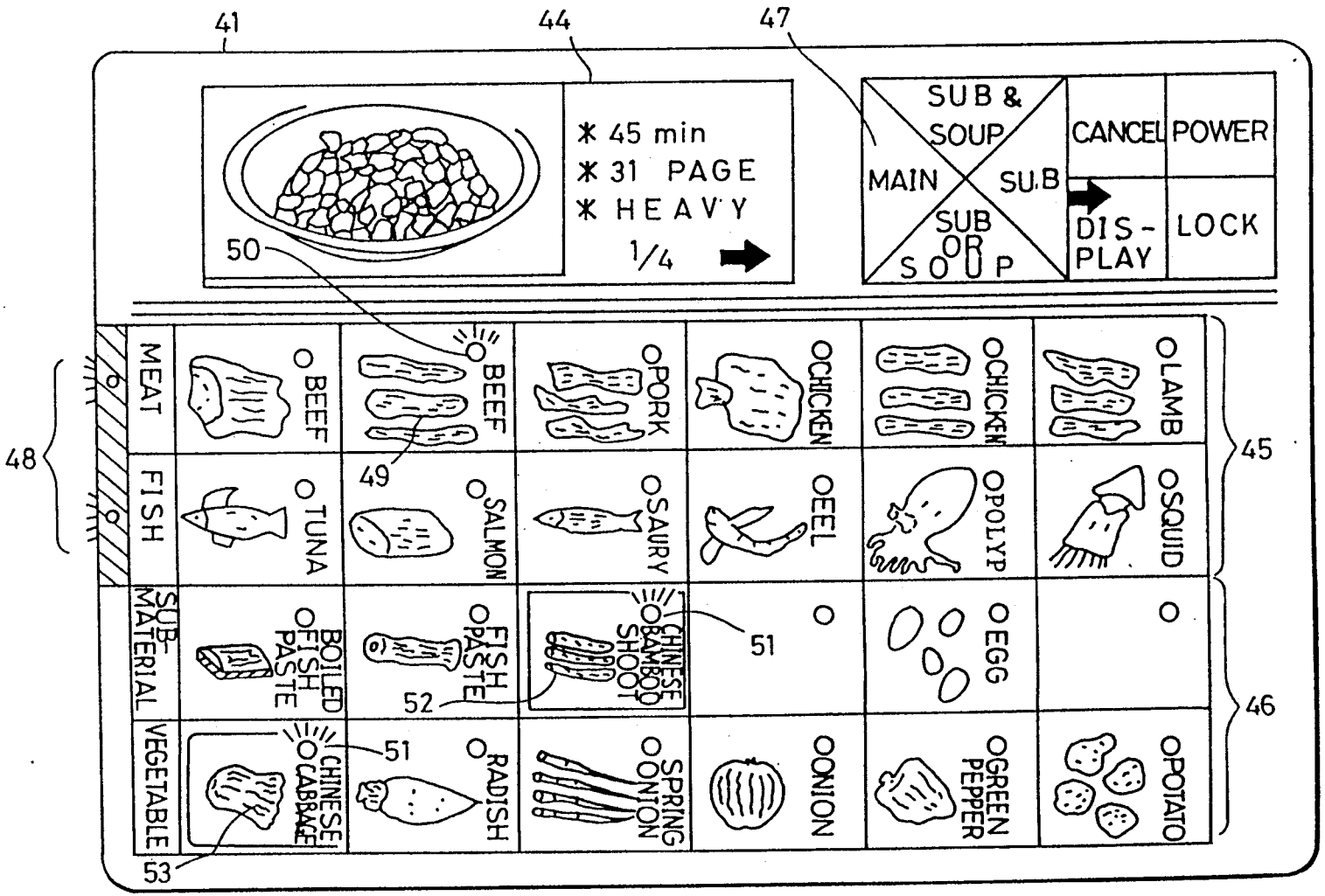
PRIOR ART FIG. 3
FIG. 3 is a front view of a function unit to be attached to the upper portion of control unit shown in FIGS. 1 and 2.
Figure 4:
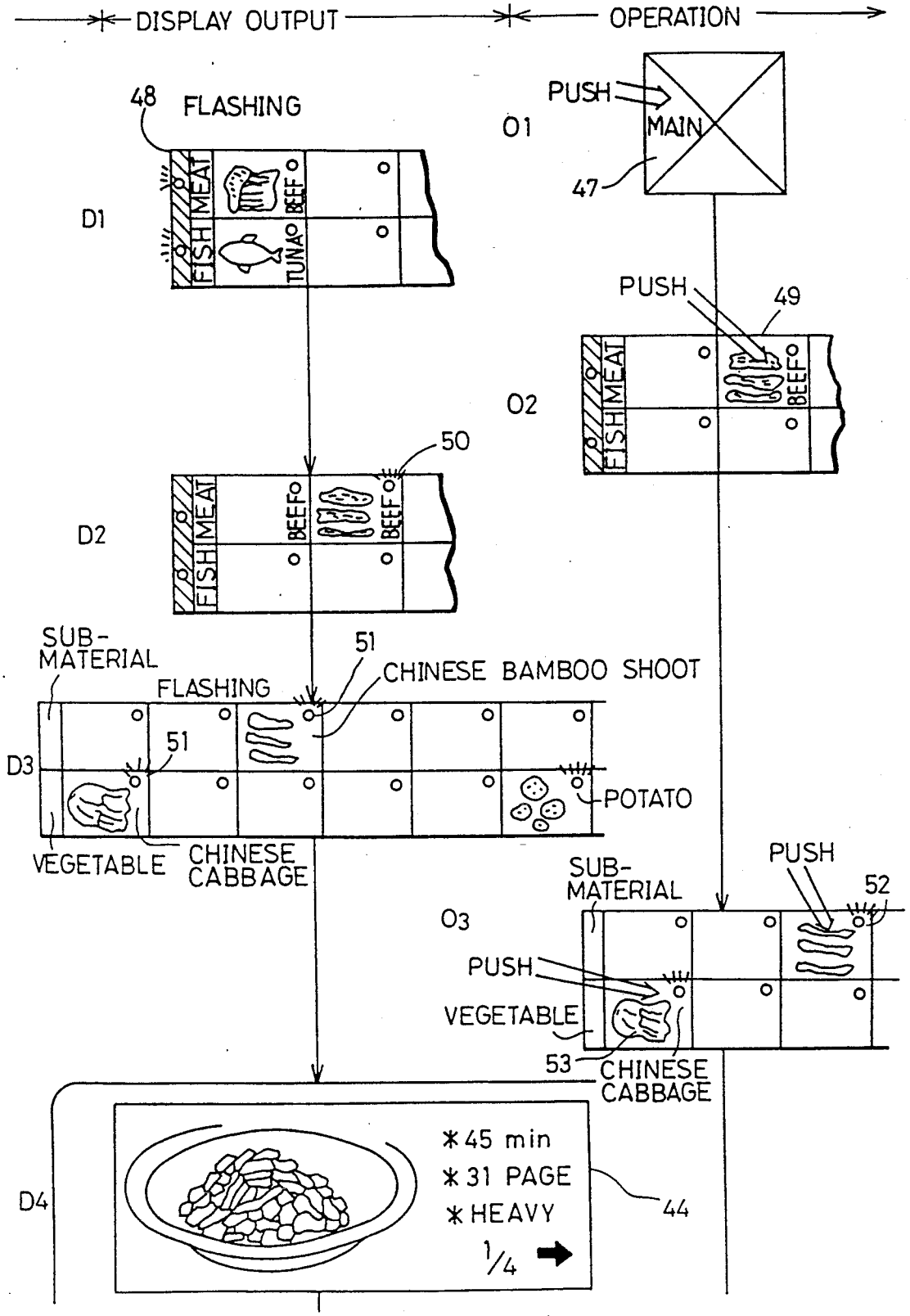
FIG. 4 PRIOR ART
FIG. 4 is a schematic diagram showing an operation procedure of the function unit shown in FIG. 3 and the corresponding display contents.
Figure 6:
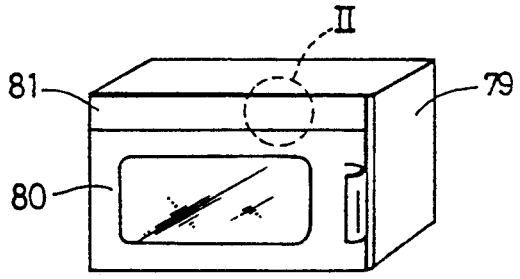
FIG. 6 is a perspective view of a microwave oven according to one embodiment of the present invention.
Figure 7:
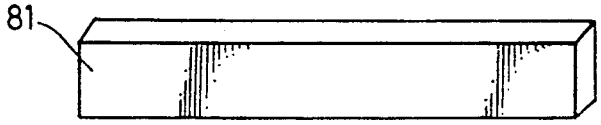
FIG. 7 is a perspective view of the control unit of a microwave oven according to the present invention.

FIG. 6 is a perspective view of a microwave oven according to one embodiment of the present invention. With reference to FIG. 6, the microwave oven includes a main body 79 of the microwave oven, an open door 80 provided at the front of the main body 79, a control unit 81 which is a box large in width and small in thickness as shown in FIG. 7 and is provided at the front of the main body 79, an oven tray (not shown) provided inside the chamber of the main body 79, a magnetron (not shown) for radiating microwave for heating a cooking material placed on the oven tray, and an electric heater provided inside the chamber of the main body 79 for heating the material. The microwave oven performs a heating processing by microwave heating or heater heating.

Figure 8:
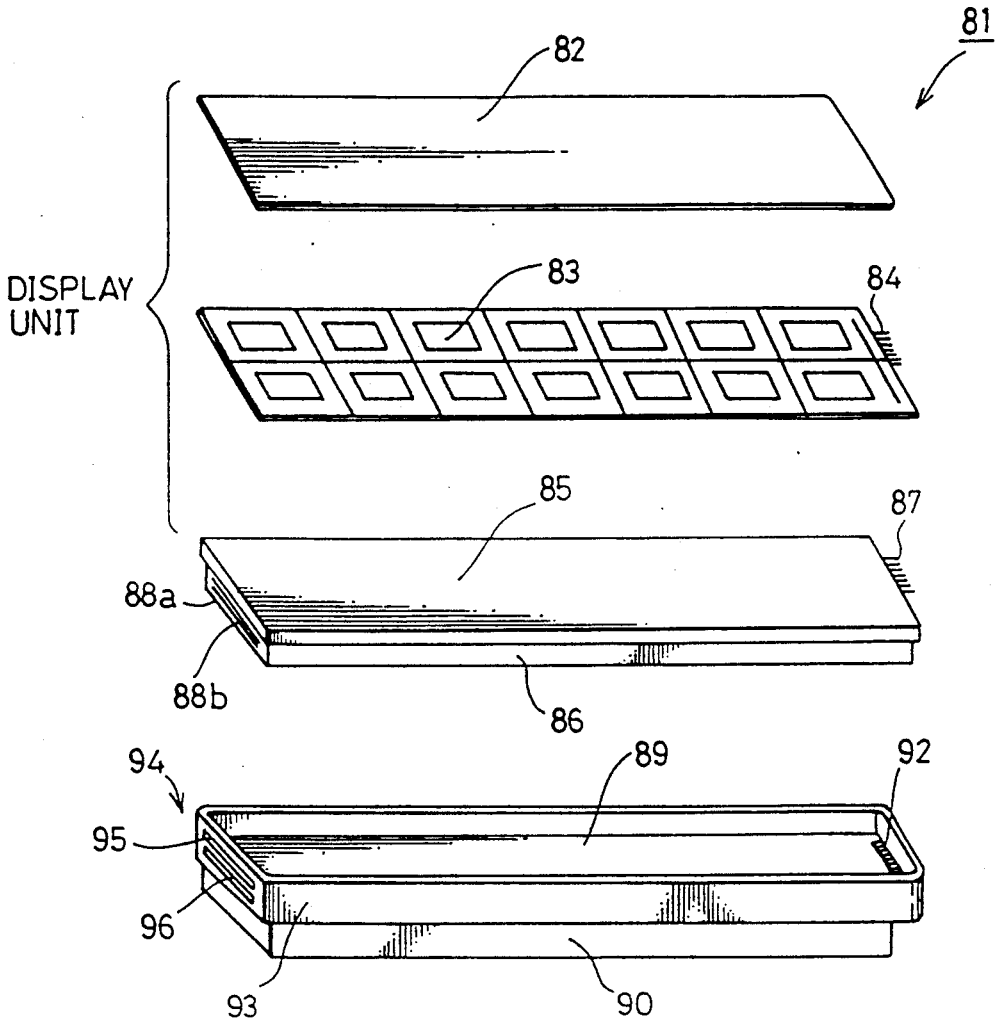
FIG. 8 is an exploded perspective view of a control unit of the microwave oven according to one embodiment of the present invention.

FIG. 8 is an exploded perspective view schematically showing the arrangement of the control unit 81 shown in FIG. 7. The control unit 81 is schematically structured by a display unit for displaying pictures and a control unit controller 90. The display unit includes a display control unit 86, a color liquid crystal display 85 provided stacked on the display control unit 86, a transparent electrode switching sheet 83 stacked on the color liquid crystal display 85 and an overlay 82 stacked on the transparent electrode switching sheet 83.

The overlay 82 is made of a transparent plate with nothing printed on the surface thereof. The transparent electrode switching sheet 83 includes fourteen transparent electrode switches. Each transparent electrode switch is operated at the time of designating a menu, a material or a function.

The color liquid crystal display 85 displays all of the picture information and character information to be displayed by the control unit 81 under the control of the display control unit 86. A terminal (not shown) provided at the right end of the display control unit 86 is connected to one end of a lead line 87. The other end of the lead line 87 is connected to a terminal 84 provided at the right edge of the transparent electrode switching sheet 83.

When the stacked and integrally formed display unit is placed on the upper surface of a control unit panel 89, a terminal (not shown) provided at the right end of the bottom surface of the display control unit 86 is connected to a terminal 92 provided at the right end of the control unit panel 89. Then, the picture information and character information are displayed on the color liquid crystal display 85 under the control of the display control unit 86 by using a picture signal and a character signal from the control unit controller 90.

A selection/command signal from the transparent electrode switches provided on the transparent electrode switching sheets 83 is applied to the controller unit controller 90 through the display control unit 86.

Provided at the left end of the display control unit 86 shown in FIG. 8 are slots 88*a* and 88*b* for an IC card as external storing means. A side 94 at an end 93 of the control unit panel 89 forms an outer wall of the main body 79 of the microwave oven. The side 94 is provided with IC card slots 95 and 96. Two contacts corresponding to the IC card are provided in the deepest part of the slots 88*a* and 88*b* of the display control unit 86. With the control unit panel 89 and the display unit set up, the slot 88*a* and the slot 95, and the slot 88*b* and the slot 96 overlap with each other. Then, the IC card is directly accessed by a CPU (not shown) provided in the control unit controller 90 when the contacts provided at the tip of the IC card inserted in the slots 95 and 96 are connected with the contacts provided at the deepest part of the IC slots 88*a* and 88*b*. The IC card thus constitutes the main part of a main memory in the control system of the present invention.

Figure 9:
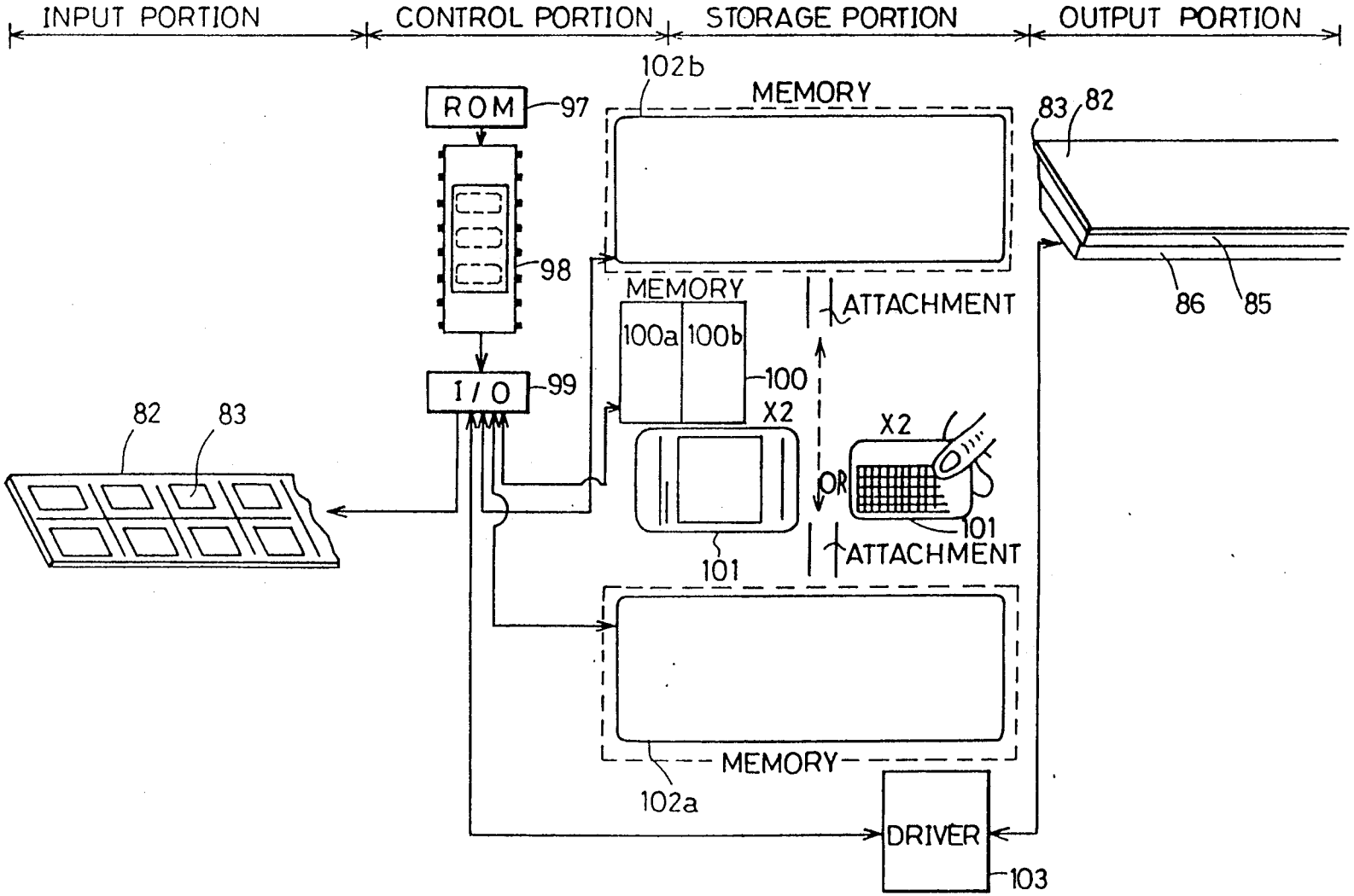
FIG. 9 is a block diagram of a control system of the microwave oven according to one embodiment of the present invention.

FIG. 9 is a block diagram of the control unit 81. In FIG. 9, shown from the left side are an input portion, a control portion, a storage portion and an output portion. The input portion is structured by the transparent electrode switching sheets 83 with the overlay 82 stacked thereon. The control portion and the storage portion correspond to the control unit controller 90 shown in FIG. 8. The output portion includes the color liquid crystal display 85 and the display control unit 86.

With reference to FIG. 9, the control portion includes a CPU (Central Processing Unit) 98 for executing cooking programs and control programs, a ROM (Read-Only Memory) 97 for storing the control programs to be executed by the CPU 98, and an I/0 interface 99 for controlling input/output between the CPU 98 and other devices.

The storage portion includes a memory 100 including a RAM (Random Access Memory) and connected to the I/O 99 and memories 102*a* and 102*b* to be formed by connection to the I/O 99 at an insertion of an IC card 101. Data to be stored in the memories 102*a* and 102*b* will be described later.

Figure 10:
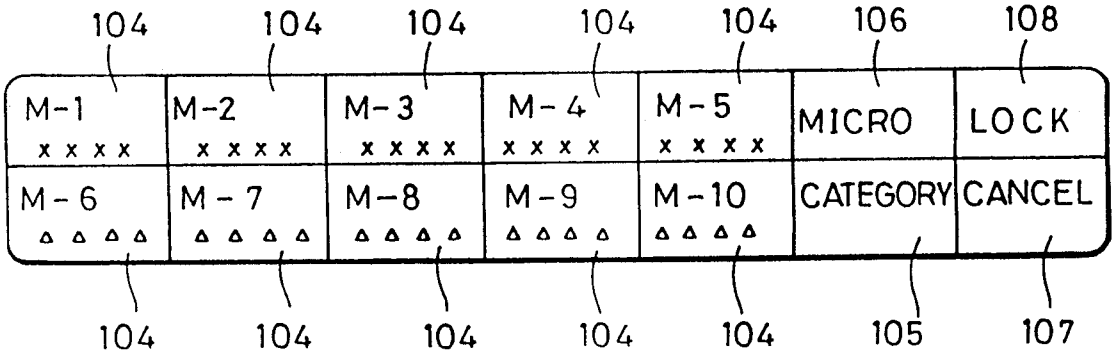
FIG. 10 is a schematic plan view of a display unit of the control unit of the microwave oven according to one embodiment of the present invention.

With reference to FIG. 10, the display surface of the color liquid crystal display 85 includes 14 display regions (segments). These display regions include ten segments 104 for displaying an input screen and an output screen, two segments 105 and 106 for displaying a mode name of an operation key and two segments 107 and 108 for displaying a function key name. The segments 104 are capable of individually displaying menu names as shown in FIG. 10 and also capable of operating as one field to display one picture.

The main dishes and sub-dishes referred to in the above description will be described in the following.

A main dish refers to a core of a plurality of dishes served for one dining. The main dish is generally selected among meat dishes and fish dishes. In addition, it is a common practice that the contents of a main dish are first determined among a plurality of dishes served for one dining.

A sub-dish refers to a dish complementary to the above-described main dish in order to constitute the entire dish, out of the plurality of dishes served for the dining. It is common that a sub-dish is often selected among vegetable dishes and soup dishes. It is also common to determine the contents and a combination of sub-dishes in correspondence with a main dish after selecting the main dish. The decision is made in consideration of balance of nutrition and the total cooking time for one dining.

Figure 11:
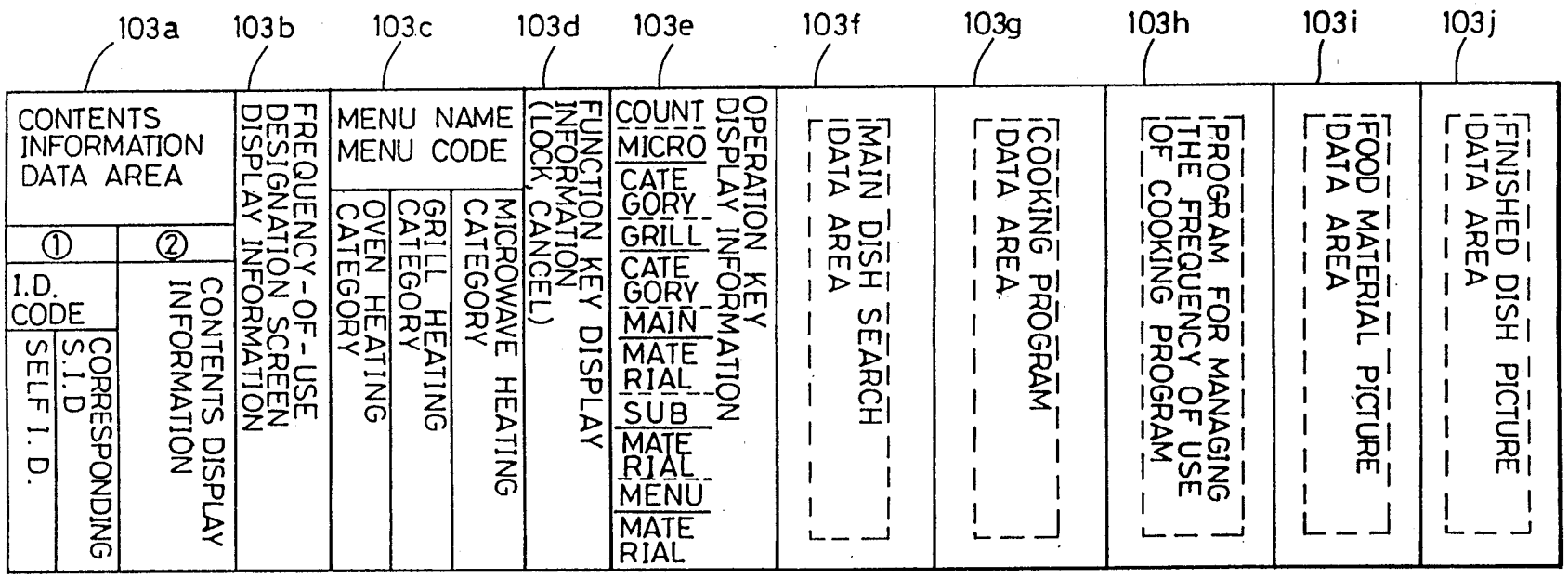
FIG. 11 is a schematic diagram of a data area for storing main dish information in the IC card for use in the microwave oven according to one embodiment of the present invention.

FIG. 11 is a diagram showing a data arrangement of the main memory 102*a* constituted by the IC card 101. The main memory 102*a* stores data for selecting a main dish. The data area of the main memory 102*a* includes a contents information data area 103*a*, a frequency of use designation screen display data area 103*b*, an area 103*c* of input screen data for selecting a menu name, a function key display information data area 103*d*, an operation key display information data area 103*e*, a main dish search data area 103*f*, a cooking program data area 103*g*, an area 103*h* of program data for managing the frequency of a cooking program, a food material picture data area 103*i* and a finished dish picture data area 103*j*. Data stored in the respective areas will be described in detail in the following.

(1) Contents information data (data area 103*a*)

The data is used to identify the contents of the data stored in the IC card 101 constituting the main memory 102*a*.

The contents information data include the following two kinds of information.

(a) I.D. code information

Code information for specifying the first IC card itself and code information for specifying a second IC card to be used in association with the first IC card.

(b) Contents display information

Information represented such that a user can recognize I.D. code information, and information indicative of the contents/constitution of stored cooking programs.

(2) Data for displaying the frequency-of-use designation screen (stored in the date area 103*b*)

The data refers to screen display data for outputting information on a display screen, for designating a cooking program whose frequency of use falls within a predetermined range. The data includes, for example, information for displaying on a display screen a symbol of "LARGE" when the frequency of use is equal to six times, a symbol of "MIDDLE" when the frequency is from three times to five times, a symbol, of "SMALL" when the same is zero to two times, and a symbol of "FREE" when no frequency of use is designated.

(3) Input screen data for menu-name selection (stored in the data area 103*c*)

The data refers to information for use in designating a microwave heating mode, a grill heating mode and a heating mode in searching a menu name. The information is classified according to the respective heating modes associated with the corresponding heating mode.

(4) Function key display information and operation key display information (stored in the data areas 103*d* and The data include the following:

(a) Data for displaying an operation mode name on an operation key for switching the display contents of the color liquid crystal display 85. Character codes indicative of operation modes include "CLOCK", "COUNT", Data for displaying a /picture of a material (main "CATEGORY", and "MATERIAL."

(b) Data for displaying a heating mode name when the operation mode is "CATEGORY." Character codes indicative of heating modes include "MICRO" and "GRILL."

(c) Data for displaying material selection mode names when the operation mode is "MATERIAL." Character codes indicative of material selection mode names include "MAIN" and "SUB."

(d) Data for displaying screen switching mode names for switching pictures of finished dishes when the operation mode is "MATERIAL." A character code indicative of a screen switching mode name includes "MENU."

(e) Data for displaying function mode names of function keys for locking or canceling the contents selected by the user according to the display of the color liquid display 85. The function mode names include "LOCK" and "CANCEL".

(5) Data for searching a main dish (stored in the data area 103*f*)

Data for use in designating a main material name and a sub-material name to search a menu name which needs the designated main material and the sub-material. The data include a main material name code, two kinds of sub-material name codes and a menu name code corresponding to a finished dish picture code.

(6) Cooking program data (stored in the data area 103*g*)

The data include heating programs for controlling microwave heating and heater heating in each menu and programs for controlling cooking including an operation request program for the user.

(7) The frequency of use of cooking program management program (stored in the data area 103*h*)

These programs are used for selecting a menu name by designating the frequency of use. The programs include, for example, a program for outputting the frequency-of-use designation screen according to the data stored in the data area 103*b* and symbol information therefor, and a program for retrieving a cooking program falling in a range of the designated frequency of use and displaying an identification symbol indicating that the cooking program falls in the designated range of the frequency of use.

(8) Food material picture data (stored in the data area 103*i*)

The data represents pictures of the material displayed on the color liquid crystal display 85 in retrieving the menus by designating materials. The data are categorized into the following two kinds.

(a) Main material picture data

Data for displaying a picture of a material (main material) constituting each menu. (b) Sub-material picture data Data for displaying a picture of the typical, but not the main, materials (sub-materials) constituting each menu.

(9) Finished dish picture data

The data refer to information for displaying picture of each of finished dish and correspond to a code of picture of each finished dish.

Figure 12:
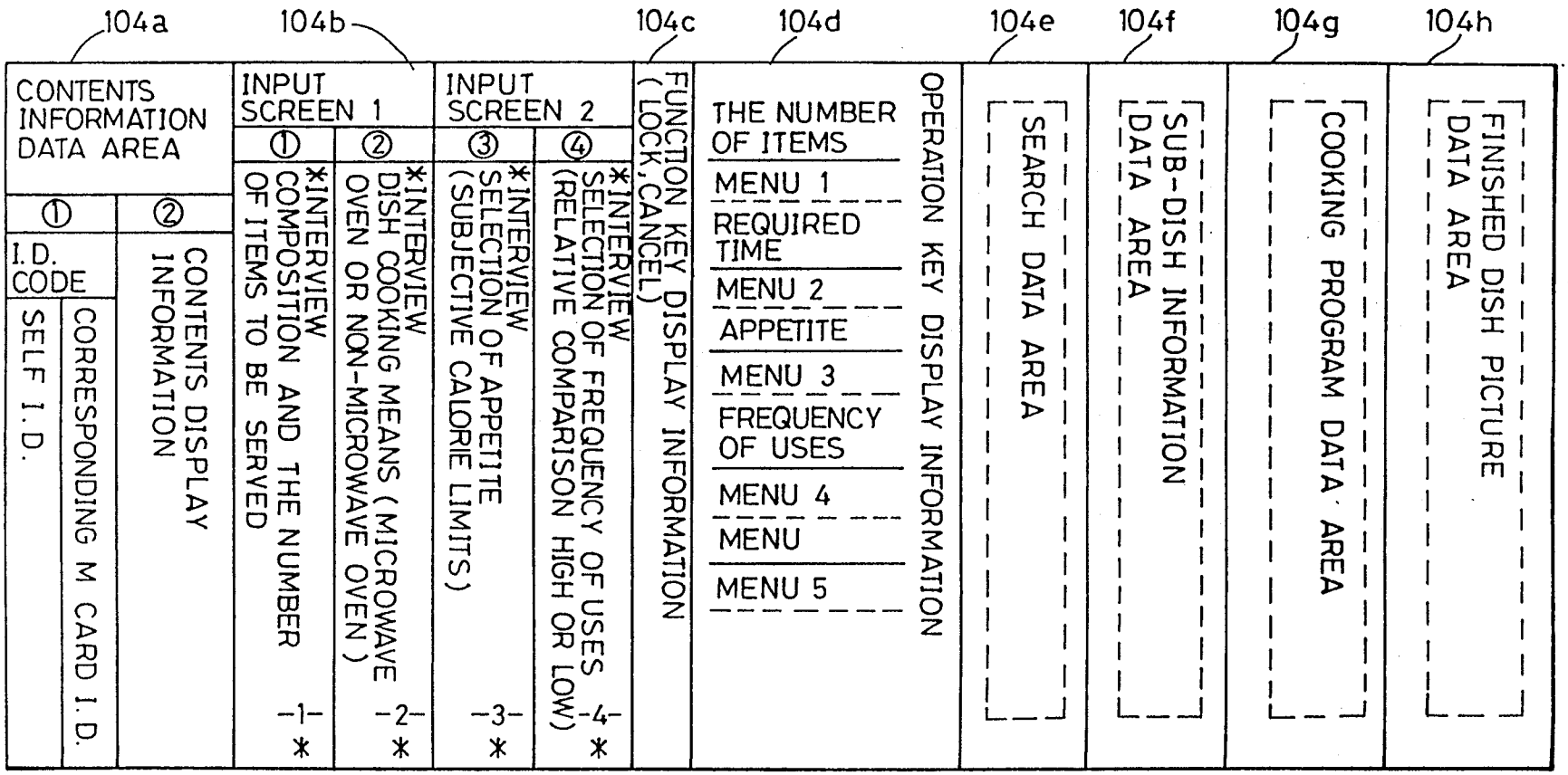
FIG. 12 is a schematic diagram of a data area for storing sub-dish information in the IC card for use in the microwave oven according to one embodiment of the present invention.

With reference to FIG. 12, data arrangement of the main memory 102*b* (IC card 101) storing data for selecting sub-dishes is as follows:

The date area of the main memory 102*b* is divided into a contents information data area 104*a*, an input screen information data area 104*b*, a function key display information data area 104*c*, an operation key display information data area 104*d*, a search data area 104*e*, a sub-dish information data area 104*f*, a cooking program data area 104*g*, and a finished dish picture data area 104*h*. The contents of each data area will be described in the following.

(1) Contents information data area (area 104*a*)

This data area stores the same kind of contents as the contents information data of the data for selecting main dishes as shown in FIG. 11.

(2) Input screen information data area (area 104*b*)

In the microwave oven according to the present embodiment, four kinds of interviews which will be described later are held with a user at the time of selecting a sub-dish. The sub-dish is searched based on his/her answer. This area stores input screen information for holding the interview.

(3) Function key display information data area (area 104*c*)

The area stores function key display information data for implementing approximately the same contents and functions as those of the function key display information stored in data area 103*d* of FIG. 11. The function mode names include "LOCK" and "CANCEL" similar to those shown in FIG. 11. Unlike data for selecting a main dish, the "LOCK" key is allotted with a function peculiar to a sub-dish selection operation mode. The function will be described later.

(4) Operation key display information data area (area 104*d*)

The data serves for displaying each of the operation of the sub-dish selection mode. More specifically, the data include four mode names for displaying an input screen for the above-described interview and a mode name at the time when the finished dish picture retrieved by the input data is displayed.

(5) Sub-dish search data area (area 104*e*)

The area stores data of a selected main dish and data obtained by a user's answer at the above-described four interviews for use in searching a sub-dish. The data include data of an answer in the above-described interview associated with the selected main dish code and menu codes corresponding to codes of the frequency of use. The details will be described later.

(6) Sub-dish data area (area 104*f*)

This area stores data relating to sub-dishes associated with each dish code, data required for searching a corresponding menu by the above-described search data, codes of picture of the cooked state of the retrieved dishes corresponding to a dish code and cooking program codes. The details will be described later.

(7) Cooking program data area (area 104*g*

The data area stores heating programs for controlling microwave heating and heater heating for each menu and programs for control cooking including display information required at a time when operation command is given to a user.

(8) Finished dish picture data area (area 104*h*)

This area stores information for the displaying picture of a cooked state of each dish. Each piece of information is associated with a code of picture of each finished dish.

The main memory 100 shown in FIG. 9 is divided into a data area 100*a* for main dish and a data area 100*b* for sub-dish. The data area 100*a* stores cooking data of a main dish selected by using the memory 102*a*. The cooking data include a menu code of the selected main dish, a cooking program for the selected main dish, and data of finished picture of the selected main dish.

The data area 100*b* stores cooking data of a sub-dish to be cooked. Similarly, the data include a menu code of the similarly sub-dish, a cooking program for the selected sub-dish, and data of finished picture of the selected sub-dish.

The IC card 101 forming the main memories 102*a* and 102*b* remains inserted in the above-described slots 95 and 96, respectively, at the time of a dish selection operation. The cooking program and the finished dish picture data therefore can be obtained by direct access to the memories 102*a* and 102*b* by the CPU 98. Thus, data to be stored in the memory 100 may include only a menu code of a main dish and a menu code of a sub-dish.

Again with reference to FIG. 9, the control system of the microwave oven operates as follows. The CPU 98 operates as described in the following under the control of a controlling program stored in the ROM 97. The CPU 98 reads out necessary information among various cooking information stored in the main memories 102*a*, 102*b*, and 100 through input/output data interface 99, while controlling the input portion and the output portion to execute a menu selecting processing.

The display control portion 86 shown in FIG. 8 controls the color liquid crystal display 85 in response to a display driver signal applied from the CPU 98 through the driver 103. This control makes the color liquid display 85 display various input screens and output screens and operation keys and functions keys stored in the main memories 102*a* and 102*b*.

The data areas 100*a* and 100*b* of the memory 100 shown in FIG. 9 are allowed to store a plurality of menu codes because one to three sub-dishes are prepared corresponding to one main dish as described later. Further, it is possible to select two main dishes by using two IC cards as the main memories 102*a* and 102*b*.

Figure 13:
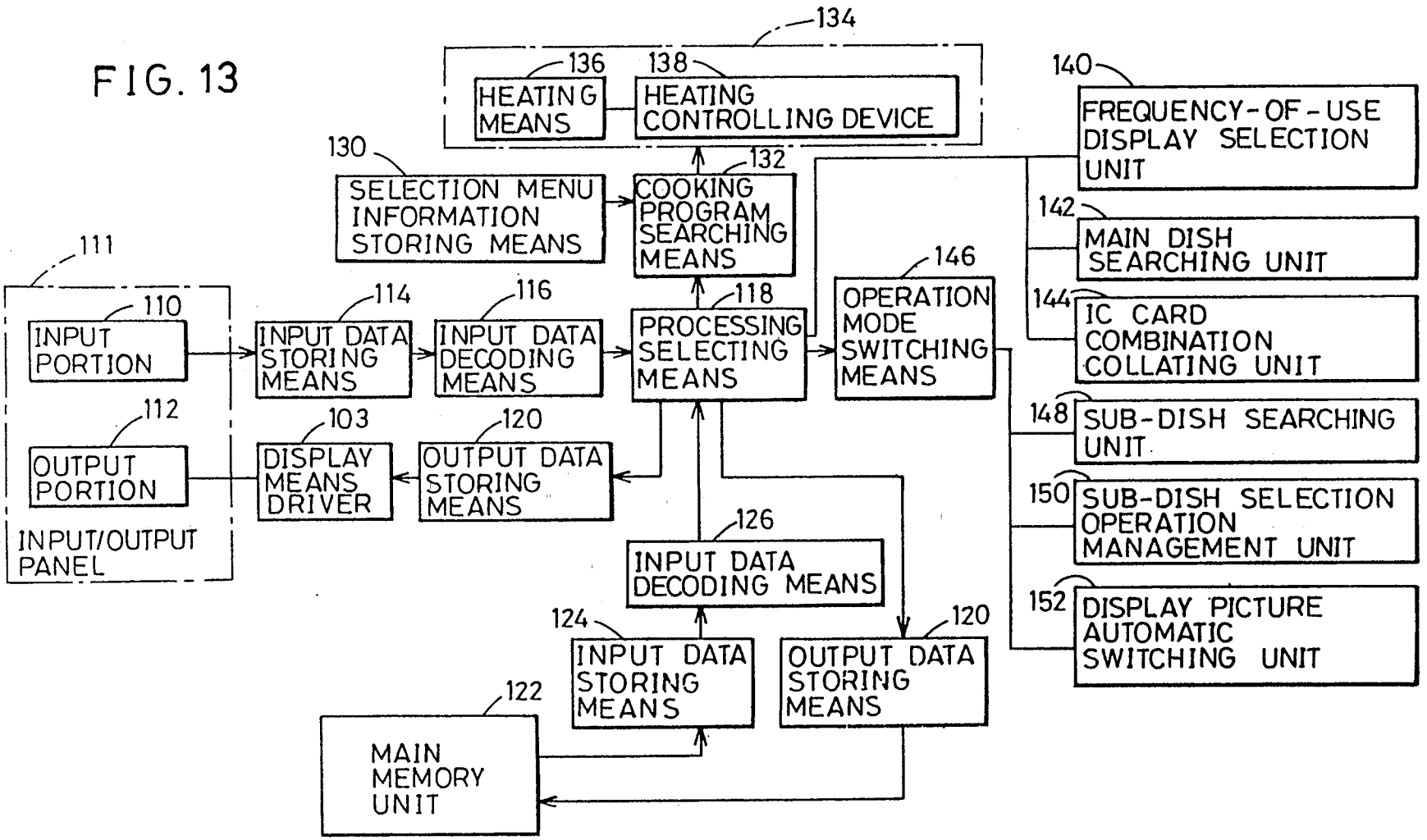
FIG. 13 is a block diagram showing respective function blocks of the control system of the microwave oven according to one embodiment of the present invention.

FIG. 13 is a block diagram showing respective functions of a control system of the microwave oven according to the present invention. Most of the function blocks are implemented by a program and a memory in practice. In an actual device, one memory is capable of storing a plurality of kinds of information. In FIG. 13, however, areas each for storing a specific kind of data are displayed as individual storing means and also as a main memory portion as a whole. The main memory portion is constituted by two IC cards as described above and is detachably attached to the control system.

With reference to FIG. 13, the control system of the microwave oven according to the present invention includes an input/output panel 111 integrally including an input portion 110 and an output portion 112, input data storing means 114 for once storing data provided from the input portion 110, input data decoding means 116 for decoding the input data stored in the input data storing means 114, processing selecting means 118 responsive to a user's command decoded by the input data decoding means 116 for selecting a subsequent processing, output data storing means 120 for temporarily storing output data applied from the processing selecting means 118, and displaying means driver 103 for driving the output portion 112 based on the data written in the output data storing means 120.

The control system further includes a main memory unit 122 for storing in advance a control program for controlling operation of the processing selecting means 118, main dish information, and sub-dish information, input data storing means 124 for reading necessary data from the main memory unit 122 and temporarily storing the same, input data decoding means 126 for decoding the data stored in the input data storing means 124 and applying the decoded data to the processing selecting means 118, and output data storing means 128 for temporarily storing the data output from the processing selecting means 118 and applying the same to the main memory unit 122. The system further includes selected menu information storing means 130 for temporarily storing selected menu information read from the main memory unit 122, cooking program retrieval means 132 for retrieving menus from the selected menu information storing means 130 in a predetermined order based on a command from the processing selecting means 118, and a cooking unit 134 to be controlled by the cooking program retrieval means 132.

The cooking unit 134 includes heating means 136 formed by magnetron etc., and heating controlling device 138 formed by magnetron relay etc. for controlling, for example, oscillation of the magnetron.

The control system further includes a frequency-of-use display selecting means 140 connected to the processing selecting means 118. The frequency-of-use display selecting unit 140 serves to determine a combination of three symbols in a count mode, the frequency-of-use display, or the frequency-of-use selection mode which will be described later for displaying the distribution of the frequency of use of all the main dish cooking programs. Further connected to the processing selecting means 118 is a detachable main dish searching unit 142 for storing main dish information and information for searching main dish information. Connected to the processing selecting means 118 is an IC card combination collating unit 144 for collating the two types of IC cards attached by the user to the control system with a combination on a predetermined rule. Also connected to the means 118 is operational mode switching means 146 for switching operational modes in response to a command of the processing selecting means 118.

The control system further includes sub-dish searching unit 148 connected to the processing selecting means 118 through the operation mode switching means 146 and detachably attached to the means 146. The unit 148 includes sub-dish searching means and sub-dish information storing means. The control system also includes a sub-dish selection operation management unit 150 for managing a sub-dish searching operation of the sub-dish searching unit 148, and a display picture automatic switching unit 152 for sequentially and automatically switching and displaying a plurality of menu pictures read in a sequential read of a plurality of stored cooking programs, when a plurality of menu information are searched and displayed in a menu selection operation or in a cooking mode.

Figure 14:
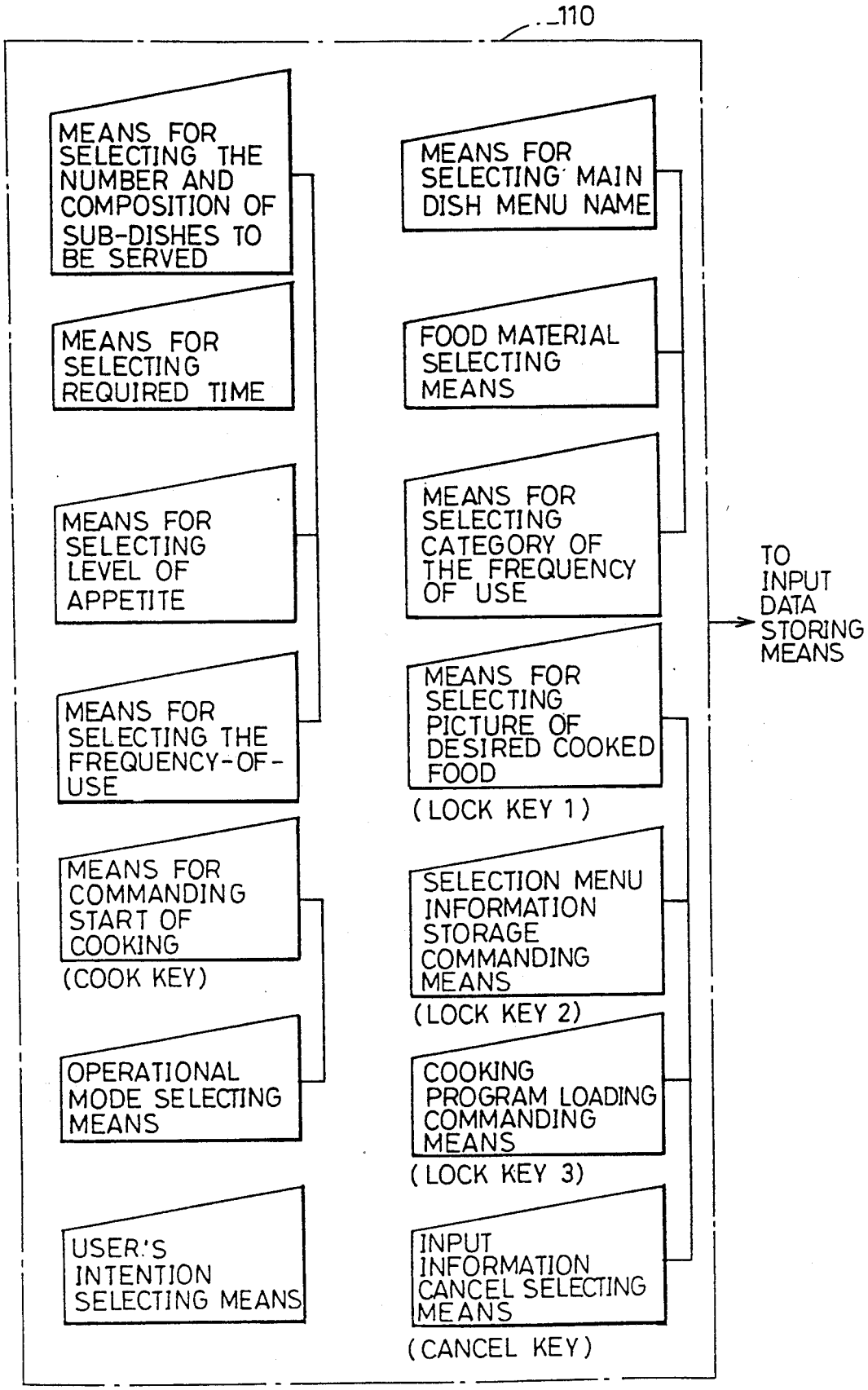
FIG. 14 is a functional block diagram of an input portion.

The input portion 110 includes the transparent electrode switching sheet 83 in the display unit shown in FIG. 8. With reference to FIG. 14, the input portion 110 functions as means for selecting main dish menu name, means for selecting main dish food material, means for selecting category of the frequency of use of main dishes, means for selecting picture of desired cooked food, means for selecting the number and composition of sub-dishes to be served, means for selecting a required time, means for selecting level of appetite for sub-dishes, and means for selecting the frequency-of-use of sub-dishes according to a change of information displayed on the color liquid crystal display 85 of the display unit shown in FIG. 8. The input portion 110 further operates as means for selecting picture of desired cooked food, means for commanding storage of selected menu information, and means for commanding cooking program loading in association with the LOCK key shown in FIG. 8. The portion 110 further functions as input information cancel commanding means which function corresponds to the CANCEL key. The input portion 110 further operates as heating start commanding means, operational mode selecting means and user's intention selecting means.

Figure 15:
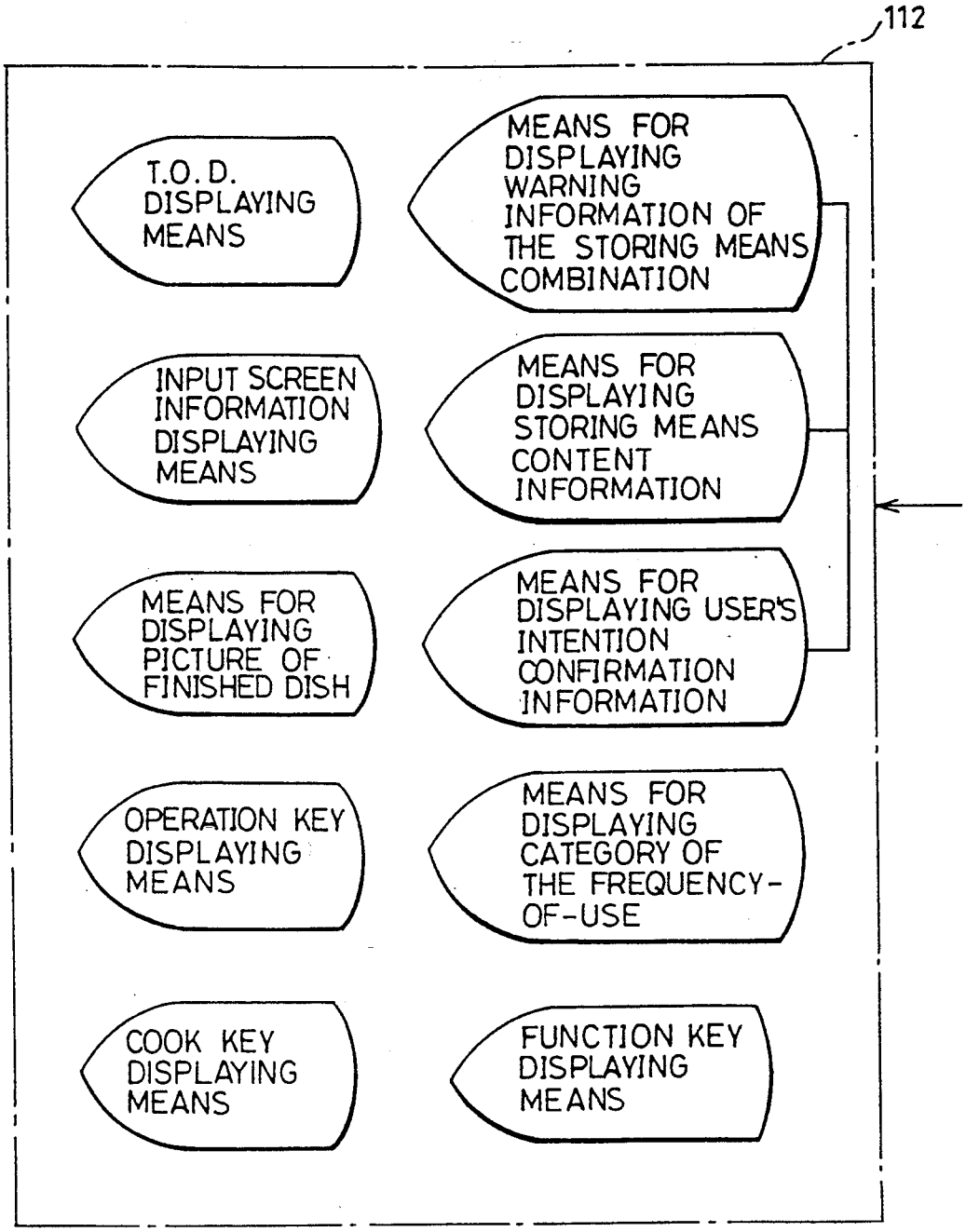
FIG. 15 is a functional block diagram of an output portion.

The output portion 112 includes the color liquid crystal display 85 shown in FIG. 8. With reference to FIG. 15, the output portion 112 operates as time of the day (T.O.D.) displaying means, input screen information displaying means, means for displaying picture of finished dish, operation key displaying means, cook key displaying means, means for displaying warning information of the storing means combination, means for displaying storing means content information, means for displaying user's intention confirmation information, means for displaying category of the frequency-of-use and function key displaying means.

Figure 16:
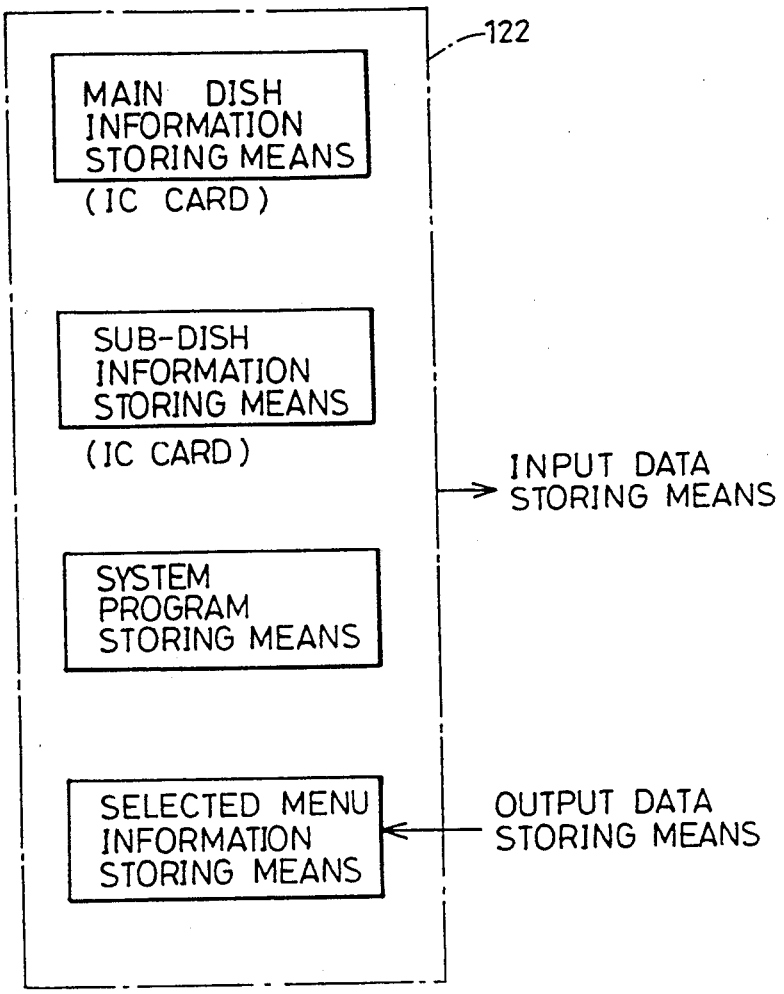
FIG. 16 is a function block diagram of a main memory unit.

With reference to FIG. 16, the main memory unit 122 includes main dish information storing means comprised of an IC card, sub-dish information storing means also comprised of the IC card, system program storing means comprised of ROM etc., and selected menu information storing means comprised of RAM etc. Of the respective blocks shown in FIG. 13, the selected menu information storing means is incorporated in the main memory unit 122.

Figure 17:
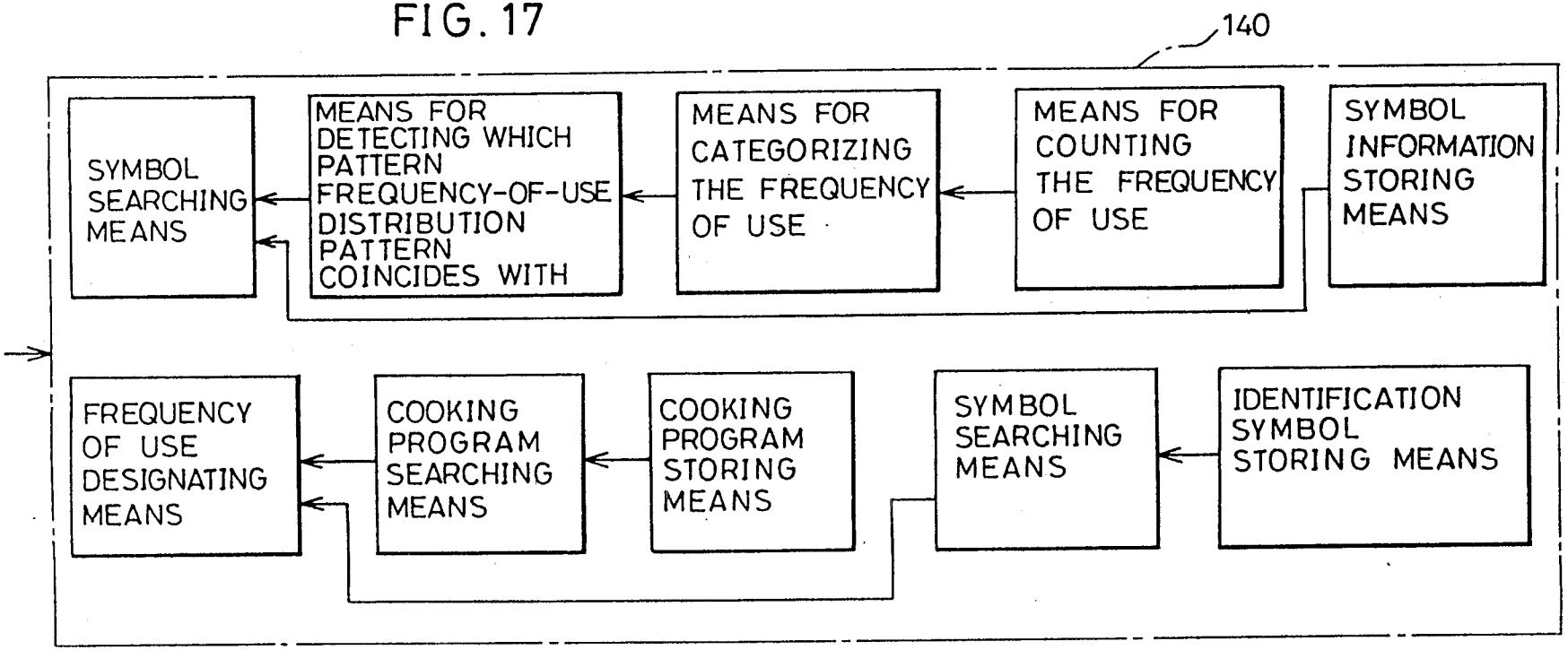
FIG. 17 is a functional block diagram of a unit for selecting the frequency-of-use display.

With reference to FIG. 17, the frequency-of-use display selecting unit 140 is a block for determining a combination of three symbols at the time of displaying distribution of the frequency of use of all the cooking programs for the main dishes in a count mode, and the frequency of use display/selection mode. The frequency of use display selecting unit 140 includes means for counting the frequency of use and storing the number of times of use of the respective cooking programs, frequency of use categorizing means for categorizing the cooking programs into a plurality of groups according to the frequency of use, means for detecting which pattern, out of predetermined patterns, the frequency-of-use distribution pattern coincides with, as a result of the categorizing, means for storing symbol information to be used in pattern display, and symbol searching means for searching and retrieving a predetermined symbol from the symbol information storing means based on the output of the means for detecting frequency-of-use distribution pattern coincidence.

The frequency of use display selecting unit 140 further has a function of applying, to display information of a cooking program corresponding to a range of the frequency of use designated by a user, an identification symbol indicating that the cooking program falls in the designated range of the frequency of use, based on the frequency of uses information displayed as described above. Therefore, the frequency-of-use in use display selecting unit 140 includes means for user's designating the frequency-of-use for designating a desired range of the frequency-of-use, means for storing cooking programs, means for searching a cooking program corresponding to the designated frequency of use out of the cooking programs, stored in the cooking program storing means, means for storing identification symbols to be added to the corresponding cooking program name, and means for searching an appropriate symbol from the identification symbol storing means. By combining these means, the name of the cooking program designated by the user with a specific symbol added to the same is displayed.

Figure 18:
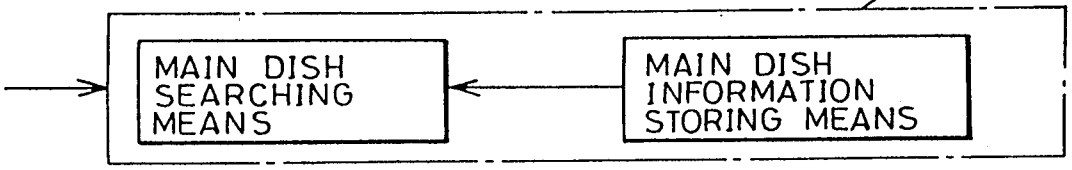
FIG. 18 is a functional block diagram of a main dish search unit.

With reference to FIG. 18, the main dish search unit 142 includes main dish information storing means and main dish searching means. The main dish search unit is formed as storing means to be selected by a user's intention and attached to the control system as required.

Figure 19:
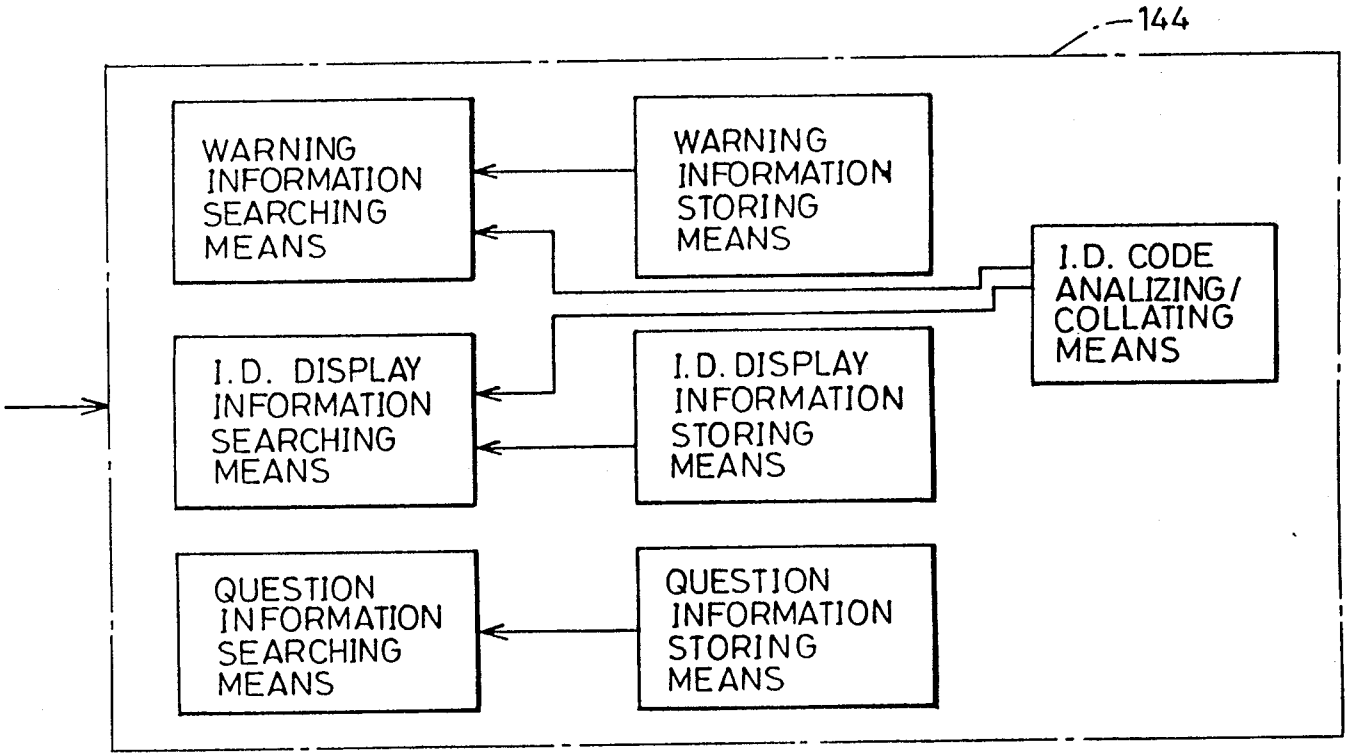
FIG. 19 is a functional block diagram of an IC card combination collation unit.

With reference to FIG. 19, the IC card combination collating unit 144 includes I.D. code analyzing/collating means for reading I.D. codes of two IC cards to determine whether the two cards designate with each other as applicable cards, I.D. display information storing means for storing I.D. display information to be displayed when a determination is made that a combination of the I.D. codes is appropriate. This unit 144 further includes means for storing warning information indicative of a present state according to the circumstances and a method of solving the same when a determination is made that the combination of the I.D. codes is inappropriate. The unit 144 also includes I.D. means for reading I.D. display information from the I.D. display information storing means when a determination is made that a combination of the I.D. codes is appropriate, warning information searching means for reading warning information from the warning information storing means when a determination is made that a combination of the I.D. codes is inappropriate, question information storing means for storing questions in advance, for confirming a user'intention at the time of insertion of the IC card, and question information searching means for reading the questions in the question information storing means at the time of insertion of the IC card. The questions have, for example, two types. One type for confirming the number of the IC cards to be inserted and the other type for confirming the user's intention as to whether a menu selection operation is to be performed with the inserted IC card or not.

Figure 20:
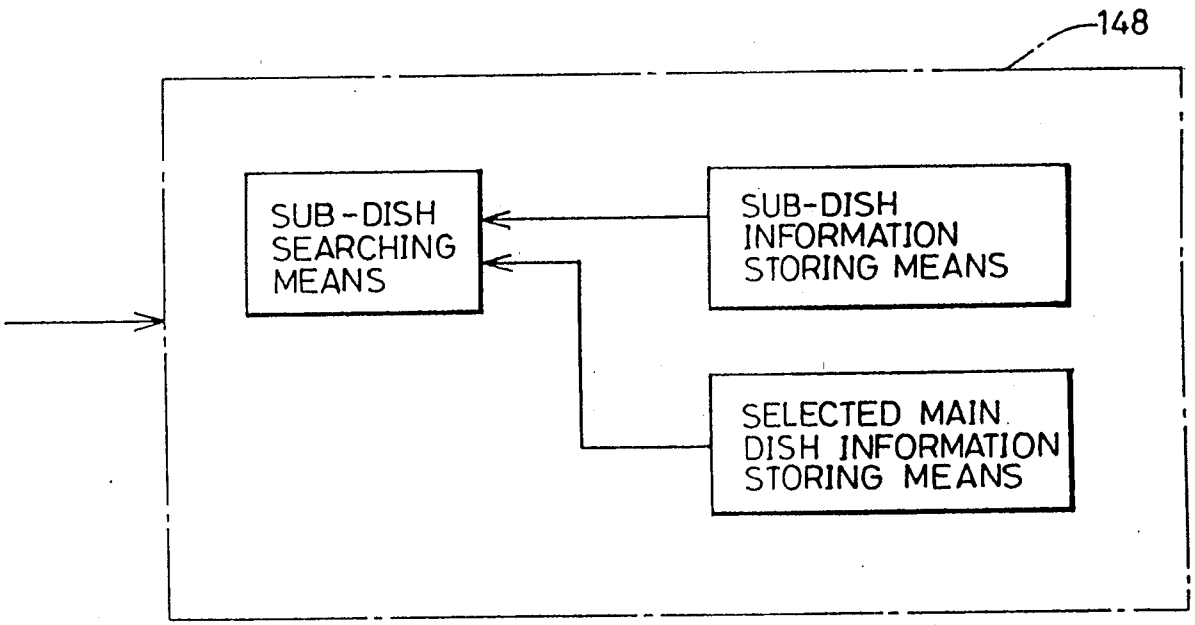
FIG. 20 is a functional block diagram of a sub-dish search unit.

With reference to FIG. 20, the sub-dish search unit 148 includes means for storing sub-dish information, storing means for storing selected main dish information and means for searching the sub-dish information storing means based on the storage contents of the selected menu information storing means to retrieve necessary sub-dish information. The sub-dish searching means and the sub-dish information storing means are incorporated in the above-described IC card. The selected menu information storing means corresponds to the memory 100 as shown in FIG. 9.

Figure 21:
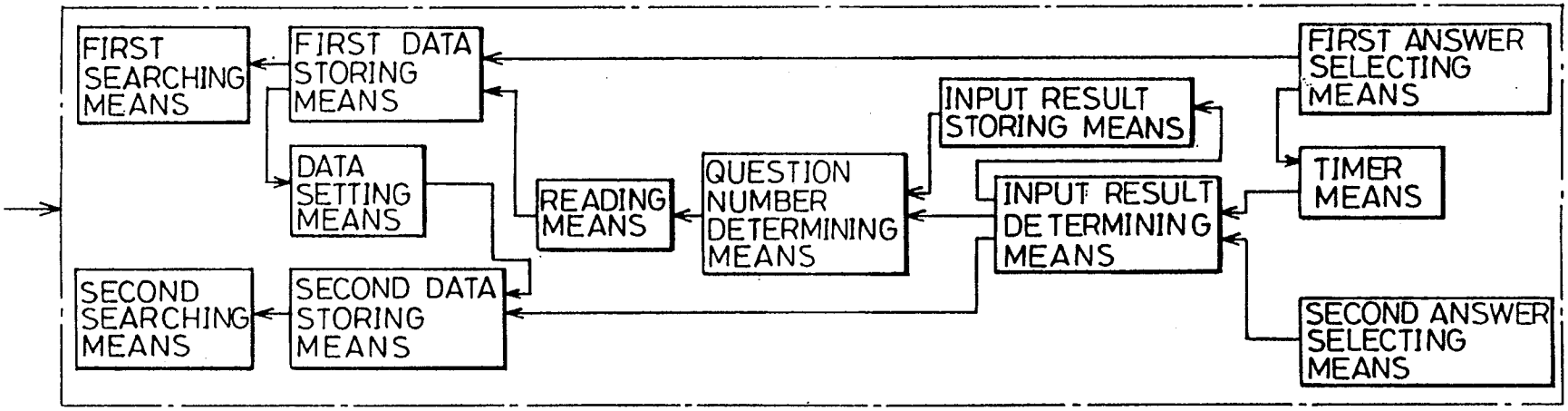
FIG. 21 is a functional block diagram of a unit for controlling sub-dish selection operation.

With reference to FIG. 21, the sub-dish selection operation management unit 150 serves to execute menu selection operation for completing input of answers for two items in one cycle of input screen display. For this purpose, the unit 150 reduces, menu selection operation under a condition of "one soup and one dish" to separate two selection operations for one soup and one dish, respectively, in a sub-dish selection operation, and performing an answer selection operation on each input screen for two items in succession.

With reference to FIG. 21, the sub-dish selection operation management unit 150 includes means for inputting a first answer to a question in each input screen, means for storing data input by the first answer selecting means, means for first performing menu search based on data stored in the first data storing means and main dish information stored in the selected menu information storing means (see FIG. 20) of the sub-dish search unit 148, means for inputting a second answer to the same question following the operation of the first answer selecting means and timer means for managing time necessary for rendering the input operation and the data input by the second answer selecting means effective after the operation of the first answer selecting means. The timer means starts its time-counting at the time of the completion of the input processing by the first answer selecting means.

The sub-dish selection operation management unit 150 further includes input result determining means for determining whether the input operation and the data input by the second answer selecting means finishes within a predetermined time managed by the timer means or not. The input result determining means outputs an input operation detecting signal when the second answer selecting means performs an effective input operation only in a case of input of an answer to the first question. The input result determining means outputs an input operation non-detection signal if no effective input operation is made before the end of the time-counting only in a case of third and the following questions.

The unit 150 further includes input result storing means responsive to the input operation detecting signal from the input result determining means for storing effectiveness/ineffectiveness of the input of the answer by the second answer selecting means to the first question, question number determining means connected to the input result determining means and responsive to the input operation non-detection signal from the input result determining means, for determining whether reading means which will be described later, should read input data by the first answering means stored in the first data storing means or not.

The unit 150 also includes reading means connected to the question number determining means and responsive to a signal output from the question number determining means for reading data of an answer to the latest question stored in the first data storing means, data setting means for applying the answer data read by the reading means to second data storing means which will be described later, second data storing means for storing answer data input by the second answer selecting means or data input by the data setting means, and second searching means for executing search after the end of the search by the first searching means, based on the data stored in the second data storing means and the data stored in the selected menu information storing means shown in FIG. 20.

The input result storing means serves, when the input of an answer to the first question by the second answer selecting means is effective, to receive a signal output by the input result determining means and store the same. The question number determining means searches the input result storing means in response to an input operation non-detection signal output from the input result determining means to retrieve a signal indicative of an effectiveness of an input operation by the second answering means with respect to the first question.

Only when the above-described signal is found to be stored, the question number determining means outputs a signal for commanding read of data from the first data storing means to the reading means which will be described later.

Figure 22:
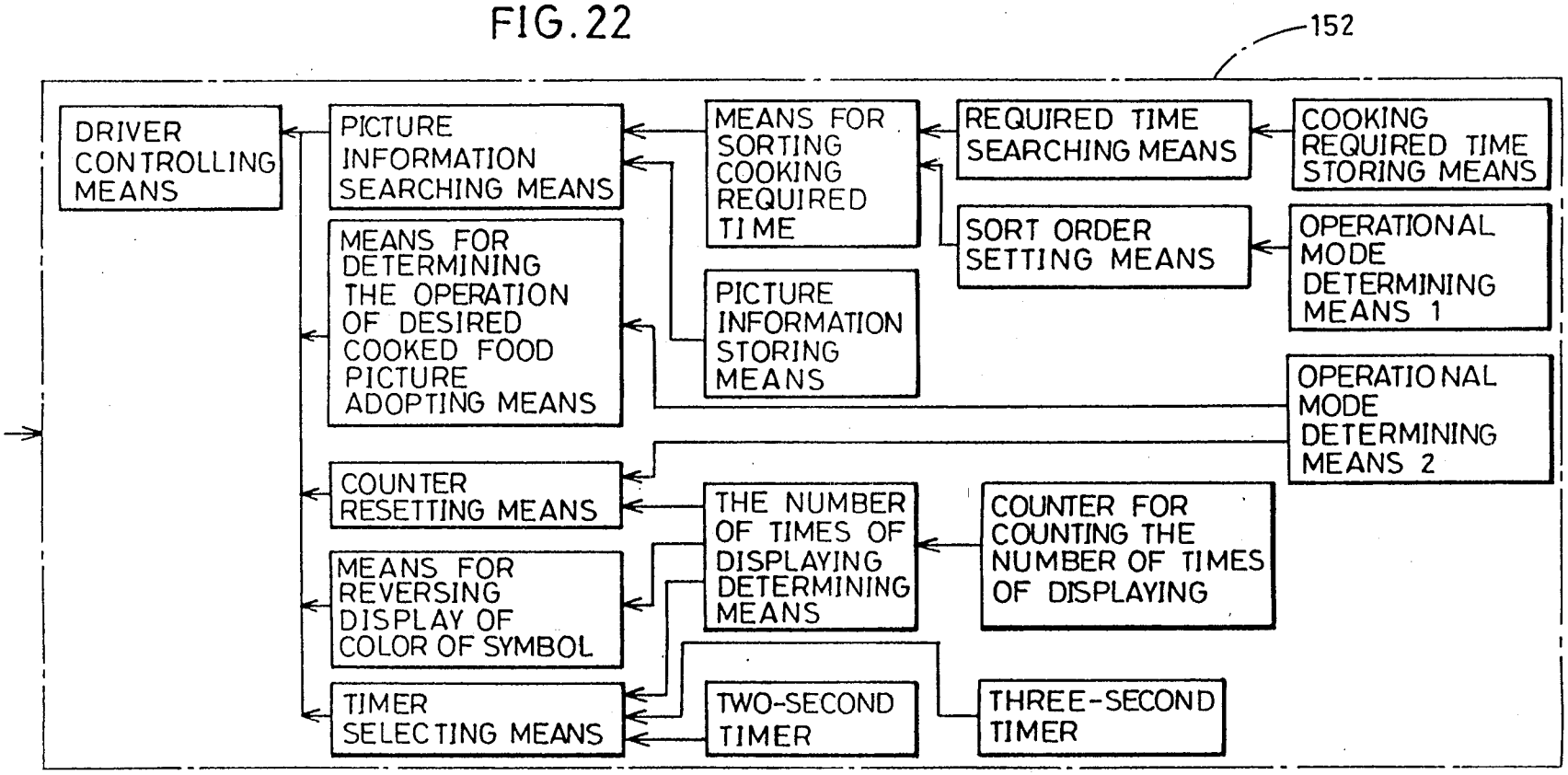
FIG. 22 is a functional block diagram of a unit for automatically switching the display picture.

With reference to FIG. 22, the unit 152 for automatically switching the display picture includes required cooking time storing means for storing menu codes of respective menus and data of time required for cooking the respective menus and stored associated with picture codes, and required time searching means for searching data of time required for cooking a selected menu among the required cooking time data stored in the required cooking time storing means. The unit 152 further includes first operational mode determining means for determining whether an operational mode of the microwave oven is a menu selection operation mode or a cooking mode and outputting the result thereof, sort order setting means for setting a sort order corresponding to an operation mode applied by the first operation mode determining means, required cooking time sorting means for sorting data of time required for cooking a selected menu in accordance with a sort order set by the sort order setting means, picture information storing means for storing picture information associated with a picture code of each menu, and picture information searching means for sequentially searching picture information corresponding to the picture codes from the picture information storing means in accordance with the picture code data corresponding to the order of the sorted required cooking time data.

The unit 152 further includes second operation mode determining means for determining whether an operation mode of the microwave oven is a cooking mode, a first main dish selection mode (preview mode), a second main dish selection mode (food material designating system), a first sub-dish selection mode (in a case of one designated item), or a second sub-dish selection mode (in a case of two designated items) and outputting a result thereof, and means for determining the operation of desired cooked food picture selecting means for determining whether a signal is applied by an input operation of a LOCK key (that is, means for selecting a picture of desired cooked dish).

The means for determining the operation of desired cooked dish picture selecting means detects a signal applied by an input operation of the LOCK key. Further, signal output from the second operation mode determining means represents the cooking mode, the second main dish selection mode or the first sub-dish selection mode, this means outputs a picture display end signal.

The unit 152 for automatically switching the display picture includes a counter for counting the number of times of the finished display of all the picture information based on a retrieved picture code, means for determining the number of times of displaying and the counter reset means. The means for determining the number of times of display outputs a predetermined signal to a counter reset means when the number of times of displaying counted by the counter is twice (comma) and to a means for determining display symbol color and a timer selecting means, which will be described later, when the number is once. The resetting means receives a signal indicative of the end of the second displaying from the number of times of display determining means and resets the count value of the number of times of display counter to zero when a signal output from the second operation mode determining means indicates the above-described cooking mode, second main dish selection mode or first sub-dish selection mode.

The unit 152 further includes means for reversing display of a symbol of an arrow in black on a white base at the time of the first display, into an arrow in white on a black base, in response to a signal indicative of the end of the first display supplied from the number of times of displaying determining means, a two-second timer, a three-second timer, timer selecting means connected to the two-second timer, the three-second timer, and the number of times of display determining means and responsive to a signal from the number of times of display determining means for selecting the three-second timer when the display signal is a signal indicative of the end of the first display and selecting the two-second timer when the display signal is a signal indicative of the end of the second display, and driver controlling means. The driver controlling means outputs, to the displaying means driver, a signal for controlling all of display picture information, a display order, a display time, a display interval, the number of times of display, a display content (symbol) and display end, of the picture to be output to the output portion 112 shown in FIG. 13 in response to the outputs of the picture information searching means, the means for determining the operation of cooked food picture selecting means, the counter resetting means, the means for reversing display symbol color and the timer selecting means.

The following display is made by a function of each of the above-described means in the unit 152 for automatically switching display picture. First, picture information of a plurality of menus selected by a user are sorted in a predetermined order according to a required cooking time and an operation mode corresponding to each picture information, thereby determining the order of display of picture. Secondly, a display time of each picture and a contrast and color of a display symbol are determined according to the number of times of the ends of all the picture displaying corresponding to all of the selected menus. Thirdly, an end of a predetermined number of times of display and an extension of the times of display are determined according to an operational mode of the microwave oven. Fourthly, effectiveness-/ineffectiveness of an operation of the desired cooked food picture selecting means (LOCK key) is determined according to an operation mode of the microwave oven and end/continuation of switching and displaying is determined based thereon. As described in the foregoing, the retrieved picture data is not mechanically and uniformly switched and displayed, but flexibly displayed by an objective-oriented switching and displaying method according to circumstances under which the data is used.

FIGS. 23 and 24 are diagrams schematically showing storage conditions of data in a sub-dish information data area (see the data area 104*f* of FIG. 12) of an IC card for selecting sub-dishes. Shown in FIG. 23 are sub-dish information data as proposed menus and shown in FIG. 24 are sub-dish information as alternative menus, which are separately displayed. Data for each sub-dish information includes a dish code as I.D. information, the frequency-of-use information as "attribute" information to be collated with input conditions, a required cooking time as auxiliary information for display picture display operation, and a cooked food picture code and a cooking program code as auxiliary information for output information search. The required time can be used also as "attribute" information to be collated with input conditions.

The dish code is to be specified in a sub-dish search operation which will be described later.

The frequency-of-use refers to the data indicative of the number of times of use of a cooking program for a dish. The data is updated when cooking information of the sub-dish is stored in the selected menu information storing means by user's pressing the LOCK key.

A required time refers to the data indicative of a time required for cooking the dish, that is, a total time period of a heating time and a preparation time. As will be described later, automatic switching and displaying of a plurality of menus is started from a menu requiring less time in a menu selection operation and from a menu requiring time in a reading operation for selection menu information in a heating mode. Sorting based on this required time data is carried out at the time of determining the order of menu display.

The cooked food picture code refers to the code information for specifying picture information of a cooked state of a menu specified by a dish code. The picture information of the cooked state of the menu can be obtained by searching picture information data area (stored in the data area 104*h* of FIG. 12) based on this code.

The cooking program code refers to the code information for specifying cooking program information for a menu specified by a dish code. Cooking program information for the menu can be obtained by searching the cooking program data area see the data area (104*g* of FIG. 12) based on this code information.

With reference to FIGS. 23 and 24, the arrangement of a prepared sub-dish menu is structured as follows such that a user's selection of conditions on an "interview" screen which will be described later can be reflected.

(1) Each menu is divided into the category of non-soup and the category of soup depending on its form. In addition, the respective menus are categorized into those having a cooking time equal to or more than 30 minutes and those of less than 30 minutes. The respective menus are further categorized as those so-called "heavy" and "light" associated with the degree of appetite of the user. Herein, "heavy" is directed to dish of a high calorie, both in material and cooking method, and "light" is related to a dish of low calorie both in material and cooking method.

Prepared as candidate menus meeting the input conditions are two kinds of menus, proposed menus and alternative menus as shown in FIGS. 23 and 24. When two sub-dishes are selected, one menu is ultimately selected for each of these menus. The determination is made by the conditions of the frequency-of-use selected by a user (a comparison of two menus).

FIG. 25 is a diagram showing an arrangement of a search data area of the IC card for selecting sub-dishes (see the data area 104*e* of FIG. 12). The arrangement diagram schematically shows decision logic which determines how input data is processed and how output data is determined. The arrangement diagram shown in FIG. 25 presupposes the following conditions.

More specifically, a main dish menu is selected which is specified by a main dish code MD-01. Further selected is "one soup+one non-soup" as the arrangement of the sub-dish.

Input data is modified according to a predetermined system when such a selection as follows is made in a user's answer in "interview."

(1) When "not designate" is selected, the input data is processed by "random number processing" on the assumption that either of the remaining two types of answers is selected.

(2) When "one item" is selected in an interview on a dish constitution, that is, "one soup" or "one dish" is selected, an input result of the conditions of the frequency of use is invalidated. Then, two kinds of candidate menus retrieved by the input data up to now, that is, a proposed menu picture, and an alternative menu picture are output as a search result.

In the arrangement diagram shown in FIG. 25, an item relating to a comparison between the frequency of use of the proposed menu and the alternative menu is shown only for explanation. With reference to FIG. 25, all of combinations of answers in the interviews are shown at addresses 2001 to 2027. It is determined in a manner described in the following, which of these two menus is to be output from a combination determining unit. At a stage where respective codes of the frequency of use are specified corresponding to dish codes of a proposed menu and an alternative menu (for example, $J_{29}$, $J_{30}$ etc.), data of the frequency of use of the corresponding dish codes are read from the sub-dish data area (see FIGS. 23 and 24). Then, the read values are compared with each other and a dish code corresponding to a code of the number of times-of-use satisfying an answer of an interview is read. Thus dish code is used as data of the combination determining unit.

It is assumed that a combination of sub-dishes selected corresponding to a main dish is set as a result of study from a view point of nutrition while reflecting results of an interview except for a condition of the frequency of use.

The following operation is carried out for the microwave oven according to the embodiment of the present invention having the above-described structure and the microwave oven operates as follows in accordance with the operation.

FIGS. 26 to 35 are flow charts of control operations of the microwave oven, which operations are performed under the control of the CPU 98 (see FIG. 9). In these diagrams, on the left side of the diagrams are shown flow charts of operations executed by a user and the CPU 98. On the right side is shown an operation procedure by the operator and at the middle are shown the contents to be displayed on the color liquid crystal display 85 (see FIG. 8), which are specifically indicated on the operation panel 81 combining the color liquid crystal display 85 and the transparent electrode switching sheet 83 to correspond to flow charts. Hereinafter, a procedure in flow chart is simply referred to as "step", an operation procedure as "operation step" and display contents as "display step." In some of the diagrams, either display or operation is shown.

Figure 26:
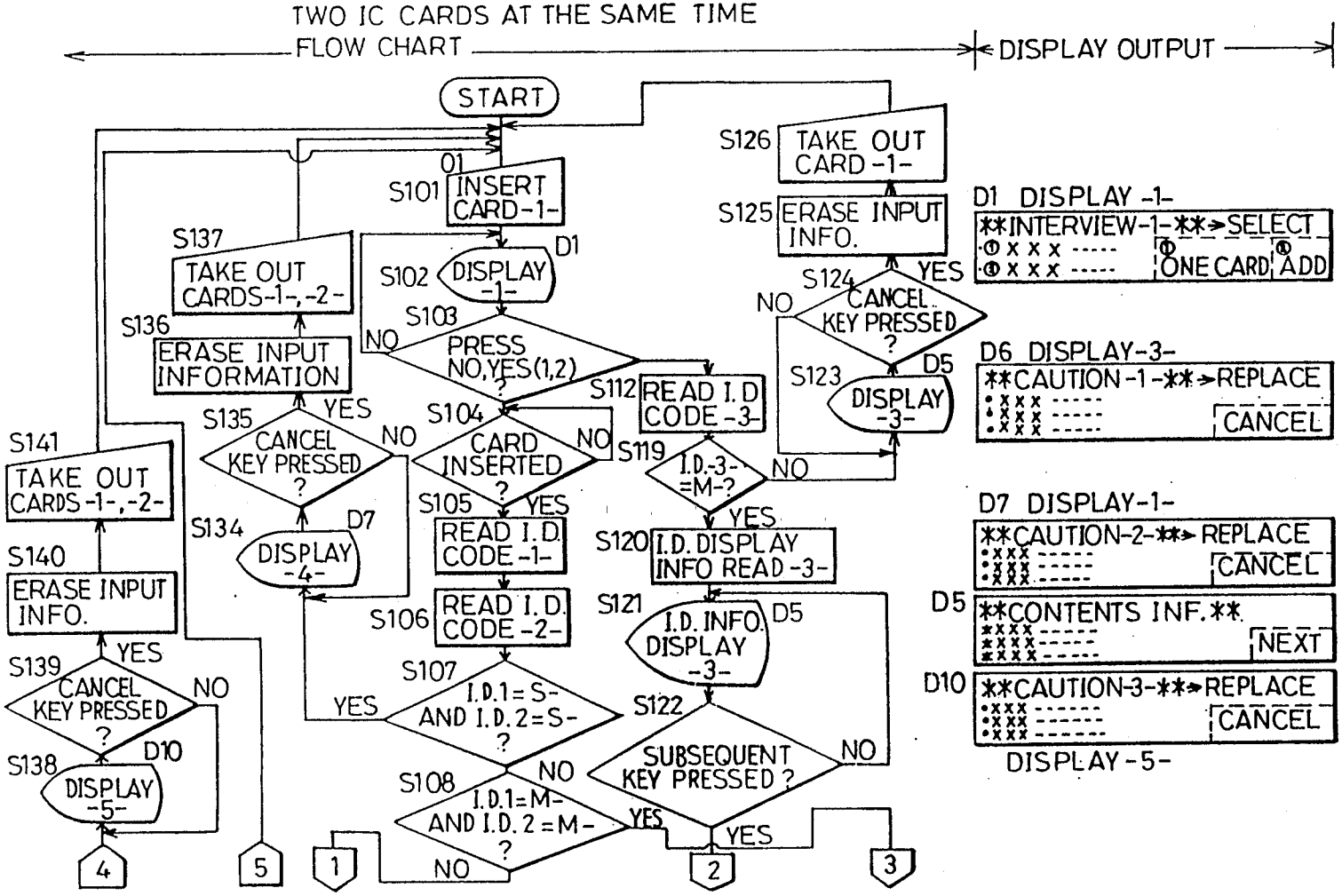
Figure 27:
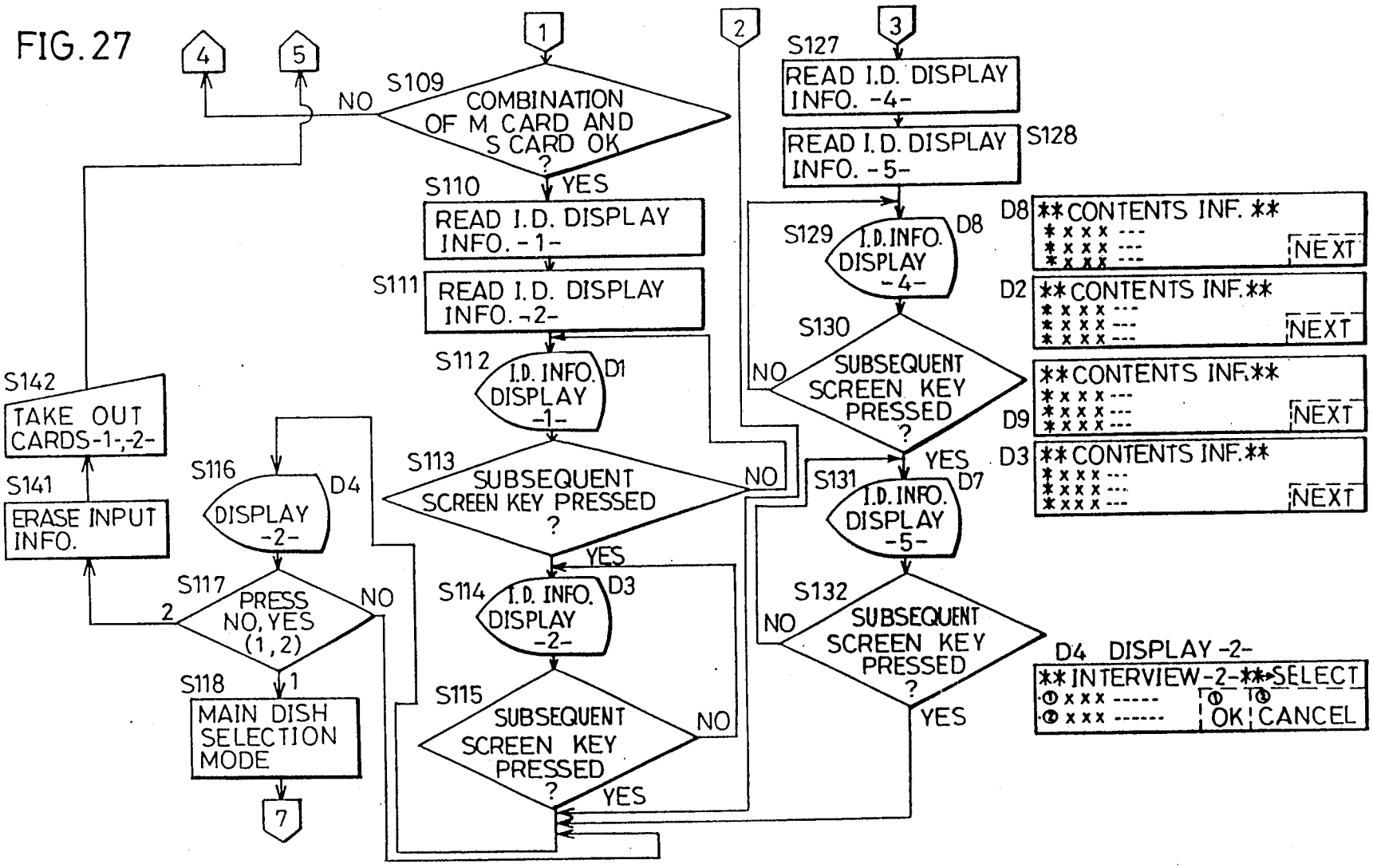

FIGS. 26 and 27, in the above-described flow charts, are diagrams for illustrating an I.D. code analyzing function and an I.D display information displaying function to be executed at the time of an insertion of an RAM pack or the IC card 101 shown in FIG. 9.

With reference to FIGS. 26 and 27, at step S101, a first IC card is inserted into either one of the slots 95 and 96 as an operation step O1. As a result, a circuitry connection is established between IC card and the display control unit 86.

At step S102, the display screen 1 is automatically displayed as the display step D1.

At step S103, a determination is made as to whether a user operates a certain key to select a processing or nor. If the determination result is NO, the control again returns to S102. When the determination result is YES, the control proceeds to step S104 or step S118 according to the contents of the key pressed. When the user selects "1," the control proceeds to step S118, while if he/she selects "2," the control proceeds to S104.

At step S104, a determination is made as to whether a second IC card is inserted or not, If it is inserted, the control proceeds to step S105. Otherwise, the state at step S104 is maintained until the IC card is inserted. The control proceeds to step S105.

At step S105, the I.D. code information (I.D. code 1) stored in the first IC card (card 1) inserted at step S101 is read. The control proceeds to step S106.

At step S106, the I.D code information (I.D. code 2) stored in the second IC card (card 2) whose insertion is confirmed at step S104 is read, whereby the control proceeds to step S107.

At step S107, determination a is made as to whether both of the I.D. codes 1 and 2 are codes indicative of cards for selecting sub-dishes (referred to as "S card"). The code is referred to as code (S). If the determination result is "YES," the control proceeds to step S134 and otherwise it proceeds to step S108.

At step S108, a determination is made as to whether both of the I.D. codes 1 and 2 are codes indicative of a card for selecting a main dish (referred to as "M card"). The code is referred to as code (M). When the determination result is "NO," the control proceeds to step S109, and otherwise it proceeds to step S127.

With reference to FIG. 27, a determination is made at step S109 whether an M card and an S card are appropriately combined with each other or not. This determination is made by collating an I.D. code of an application card indicative of a card to be combined, which code is read as I.D. code information of each card, with an I.C code of the other card. When the determination result is "YES," the control proceeds to step S110 and otherwise the control proceeds to S138 (FIG. 26).

At step S110, I.D. display information of a card with the I.D. code 1 is read. The control proceeds to step S111.

At step S111, I.D. display information of a card with the I.D. code 2 is read. The control proceeds to step S112.

At step S112, display information of a card with the I.D. code 1 is displayed as a display step D2. The control proceeds to step S113.

At step S113, determination is made whether a "subsequent screen" key is pressed or not which is displayed at the display step D2. If the determination result is YES, the control proceeds to step S114, and otherwise the control returns to step S112. When the control returns to step S112, the displaying is continued until the "subsequent screen" key is pressed.

At step S114, display information of a card with the I.D. code 2 is displayed as the display step D3. The control proceeds to step S115.

At step S115, a determination is made whether the "subsequent screen" key displayed at the display step D3 is pressed or not. If the determination result is YES, the control proceeds to step S116, and otherwise the control returns to step S114. When the control returns to S114, the displaying is continued until the "subsequent screen" key is pressed.

At step S116, the information of the display screen 2 is displayed at the display step D4. The control proceeds to step S117.

A determination is made at step S117 as to whether an "OK" key or a "CANCEL" key which is displayed on the display screen 2 is pressed or not. If the determination result is NO, the control returns to step S116 and the displaying is continued until either of the keys is pressed. When the "OK" key is pressed, the control proceeds to the main dish selection mode shown in FIG. 28 and downward. When the "CANCEL" key is pressed, the control proceeds to step S141.

When the control proceeds from step S103 to S118 in FIG. 26, the following processing is performed. At step S118, I.D. code information of the card 1 is read. Control proceeds to S119.

A determination is made at step S119 as to whether the I.D code 1 of the IC card 1 is a code (M) of the M card. When the determination result is YES, the control proceeds to the subsequent step S120, and otherwise the control proceeds to step S123.

At step S120, the I.D display information of the card 1 is read. The control proceeds to step S121.

At step S121, the I.D. display information of the card 1 is displayed as the display step D5. The control proceeds to S122.

A determination is made at step S122 as to whether the "subsequent screen" key displayed at the display step D5 is pressed or not. When the determination result is YES, the control proceeds to step S116 of FIG. 27, and otherwise the control returns to step S121. When the control returns to step S121, the displaying is continued until the "subsequent screen" key is pressed.

When the control branches from step S119 to step S123, the display screen 3 is displayed at step S123 as the display step D6. The control proceeds to step S124.

A determination is made at step S124 as to whether the "CANCEL" key displayed on the display screen 3 is pressed or not. If the determination result is YES, the control proceeds to step S125. In other cases, the control returns to step S123 to continue the displaying until the "CANCEL" key is pressed.

At step S125, erasure of input information (I.D. code 1) is executed. The control proceeds to step S126.

At step S126, the user takes out the inserted IC card following the information of the display screen 3. The control returns to step S101 to repeat the above-described processing at steps S101 and thereafter.

When the control proceeds from step S107 to step 134, the display screen 4 is displayed at step S134 as the display step D7. After step S134, the control proceeds to step S135.

A determination is made at step S135 as to whether the "CANCEL" key displayed on the display screen is pressed or not. If the determination result is YES, the control proceeds to S136 and otherwise it returns to step S134. When the control proceeds to S134, the displaying is continued until the "CANCEL" key is pressed.

At step S136, input information (I.D. codes 1 and 2) are erased because input is canceled. The control proceeds to step S137.

At step S137, the user takes out the inserted card following the message on the display screen 4. The control returns to step S101.

When the control proceeds from step S108 to step S127 (see FIG. 27), I.D. display information of the main dish card with the I.D code 1 is read at step S127. The control proceeds to step S128.

At step S128, the I.D. display information of the main dish card of the I.D. code 2 is read. The control proceeds to S129.

At step S129, the I.D. display information is displayed as the display step D8. The control proceeds to step S130.

A determination is made at step S130 whether the "subsequent screen" key displayed as the display step D8 is pressed or not. If the determination result is YES, the control proceeds to step S131, and otherwise the control returns to step S129. When the control returns to steps S129, the displaying is continued until the "subsequent screen" key is pressed.

At step S131, the I.D. display information is displayed as the display step D9. The control proceeds to step S132.

At step S132, determination is made as to whether the "subsequent screen" key displayed at the display step D9 is pressed or not. If the determination result is YES, the control proceeds to step S116 and otherwise the control returns to S131.

When the control proceeds from step S109 to step S138 (see FIG. 26), information of the display screen 5 is displayed as the display step D10 at step S138. The control proceeds to step S139.

At step S139, a determination is made as to whether the "CANCEL" key displayed on the display screen 5 is pressed or not. If the determination result is YES, the control proceeds to step S140 and otherwise it returns to step S138.

At step S140, erasure of the input information (I.D. codes 1 and 2) is carried out because the "CANCEL" key is pressed. The control proceeds to step S141.

At step S141, the operator takes out the inserted cards 1 and 2 following the instruction shown on the display screen 5. The control returns to step S101.

When the control at step S117 (see FIG. 27) branches to step S141, erasure of input information (I.D. display information 1 and 2, I.D. codes 1 and 2) is executed. The control proceeds to steps S142.

At step S142, the operator takes out the inserted cards 1 and 2. The control returns to step S101 (see FIG. 26).

Collation of the inserted cards is performed as described above.

When the operation for adaptation check of the above-described IC cards is finished, the control is automatically switched to a main dish selection operation mode.

With reference to FIG. 28, the main dish selection operation will be described. At step S202, a screen for designating the frequency of use is displayed as display step D202. The operation mode here is "count mode." The operation key indicates as "COUNT."

Three types of keys for selecting the frequency of use are prepared. A "SMALL" key is pressed for displaying a menu used zero to twice in a distinguishable manner, a "MIDDLE" key for displaying a menu used three times to five times in the same manner, and a "LARGE" key for displaying a menu used six times or more in the same manner. A key indicating "FREE" is pressed when no distinction among the menus is required according to the number of times of use.

At step S203 the user selects the frequency of use In this case, it is assumed that the "SMALL" key is pressed as the operation step 0201 to display a name of a menu the frequency of use of which is low in a distinguishable manner. The control proceeds to step S204.

At step S204, it is assumed that the operation key indicating by "COUNT" is pressed as the operation step 0202. As a result, the operation mode of the microwave oven is switched from the count mode to the main dish selection mode. The control proceeds to step S205.

At step S205, retrieval of a menu (cooking program) is executed which satisfies the conditions of the frequency of use designated by the key selected in the processing of step S203. The control proceeds to S206.

At step S206, a mode name "CATEGORY", which is one of mode names of the main dish selection mode and indicative of a mode for selecting menus by the menu names grouped for each of heating category, is displayed on the operation key portion as the display steps D203 and D205. Displayed on the remaining display screens are the menu codes (M-1, M-6 etc.) corresponding to a group of the menu names. On the right side of the group of the menu codes are displayed symbols (*) indicative of a menu belonging to the frequency of uses selected by the processing of step S203. The control proceeds to S207.

The user determines at step S207 whether the present mode should be switched to other mode for selecting a main dish. If the determination result is YES, the processing proceeds to step S218 of FIG. 30, and otherwise the processing proceeds to S208.

At step S208, the user determines whether another heating category should be selected or not. If the determination result is YES, the processing proceeds to step S213 of FIG. 29 and otherwise the processing proceeds to step S209. The present heating category is microwave heating category as shown at the display step D204 of FIG. 28. Other heating categories include grill heating and oven heating as described above.

At step S209, a menu selection key (the menu name display unit) desired by the user is pressed as the operation step S203. After the operation, the routine for checking whether the number of the designated menus is singular or plural is started. The routine, the details of which are shown in FIGS. 42 and 43, is provided on the assumption that two menu name selection keys may be pressed simultaneously. If the menu selected as a result of the checking is singular, the control returns to step S209. The control further proceeds to step S210 (see FIG. 29).

At step S210, picture of the finished state of the designated menu is displayed as the display step D206. The control proceeds to step S211.

The user determines at step S211 whether he likes the displayed menu or not and operates a predetermined key in accordance with the determination. If the determination result is YES, the processing proceeds to S309 shown in FIG. 31 and otherwise the processing proceeds to step S212.

The user determines at step S212 whether another heating category should be selected or not, and presses a predetermined key in accordance with the determination. If the determination result is NO, the control proceeds to step S218 of FIG. 30 and otherwise the control proceeds to step S213.

At step S213, the user presses the operation key, for example, the key indicated by the above-described heating category name "MICRO" as the operation step 04. The control proceeds to step S214.

At step S214, name of the subsequent heating category is displayed as the display step D207. With reference to the display step D207 of FIG. 29, the heating category name which was indicated by "MICRO" is changed to "GRILL." The menu name and the menu code name are also changed to "G-1, G-2, . . ." indicated in the menu belonging to the grill heating category. The control proceeds to step S215.

At step S215, the user presses a desired menu name selection key as the operation step 05. After the operation, a determination is made whether a designated menu is plural or not on the assumption that two menu selection keys may be pressed at the same time. The control proceeds to a routine the details of which are shown in FIGS. 42 and 43. If it is determined that the designated menu is not plural, the control returns to step S215. The control further proceeds to step S216.

At step S216, a picture of a finished state of the designated menu is displayed as the display step D209. The control proceeds to step S217.

The user determines at step S217 whether he likes the menu displayed or not and presses a predetermined key in accordance with the result. If the determination result is NO, the processing proceeds to step S218 of FIG. 30 and otherwise the processing proceeds to step S309 of FIG. 31.

In the foregoing description, the number of displayed candidate menus from one heating category is limited to one. However, it is also possible to display a plurality of menus.

The following is operation for displaying a picture of a finished state of another menu in the same heating category. Subsequent to the display step D206 of step S210, the function key "CANCEL" is pressed once. This operation returns the display to the display step D205 of step S206. This enables selection and display of other menus in the same heating category.

At step S218 of FIG. 30, a menu selection on a food material designation system is performed, which is another main dish selection operation. At step S218, the user presses the operational mode selection key indicated by "CATEGORY" as the operation step 0301. The control proceeds to step S301.

The operation mode is switched to the food material designation system selection mode at step S301. The control proceeds to step S302.

At step S300, "MATERIAL" is displayed as an operation mode name in place of "CATEGORY." "MAIN" indicating that the indicated food material is a main material, is displayed in place of the heating category name "GRILL" as the display step D302.

Picture of the food material is displayed as the display step D303. Although a main material is displayed by a single screen in the present embodiment, the main material may be divided and displayed in a plurality of screens so as to display various main materials when the storing means has a large capacity. A first screen for beef and pork, a second screen for poultry and a third screen sea food, for example. The control proceeds to step S303.

At step S303, the user presses a desired main material key as the operation step O302. In this example, it is assumed that "block of pork" is selected. The control proceeds to step S304.

At step S304, menu information satisfying the conditions is retrieved. The search conditions in this case are that a main material designated at the operation step O302 is used and that the conditions of the frequency of use designated at the operation step O202 (see FIG. 28) are satisfied. Output as a result of the search is a picture of a sub-material taken out based on a picture code of a sub-material included in the menu information satisfying the above-described conditions. The control proceeds to step S305.

At step S305, "SUB" is displayed on the operation key unit in place of the above-described "MAIN" as the display step D304 The display indicates that the displayed food material is a sub-material Further displayed is a picture of the searched sub-material as the display step D305. The control proceeds to step S306.

At step S306, the user presses keys for selecting desired sub-material, up to two items among the displayed pictures as the operation step O303. When the user cannot think of a sub-material corresponding to the selected main material, he or she only needs to press any blank key with no display of picture This operation is shown at the operation step O305 The control proceeds to step S307 (see FIG. 31).

At step S307, search of menu information is executed which satisfies predetermined search conditions In this case, the search conditions are that a designated menu material and at least one of designated sub-materials are included and that the designated conditions of the frequency of use are satisfied. Output as a result of the search is a picture of cooked state of the menu The processing proceeds to step S308 at the end of the search.

At step S308, processing for automatically switching and displaying pictures of cooked dish is carried out. The processing is shown as the flow charts in FIGS. 42 and 43. The details thereof will be described later. The control returns from the routine of automatic switching and displaying of pictures of cooked food to step S309 when a menu is selected among the displayed menus.

At step S309, the function key "LOCK" is pressed once as the operation step 0304. This operation relates to menu "selection" operation. If no desired menu is found among the displayed menus, the "CANCEL" key is pressed. This operation returns the display to a state of the display step D305 (see FIG. 30). Another pressing of the "CANCEL" key returns the display to the state of the display step D303 (see FIG. 30).

Subsequent to step S309, processing for storing data of the menu selected by the above processing is carried out at step S310. That is, picture information, a cooking program and a menu code of the selected menu are stored. The control proceeds to step S311.

At step S311, data is updated of the number of times of uses of the selected menu. The control proceeds to step S312.

At step S312, the operation mode is switched to the sub-dish selection mode. The automatic switching of the operation mode is possible only by the microwave oven according to the present embodiment, which allows simultaneous insertion of IC cards for selecting main dish and sub-dish. The control proceeds to step S401 shown in FIG. 32.

Figure 36:
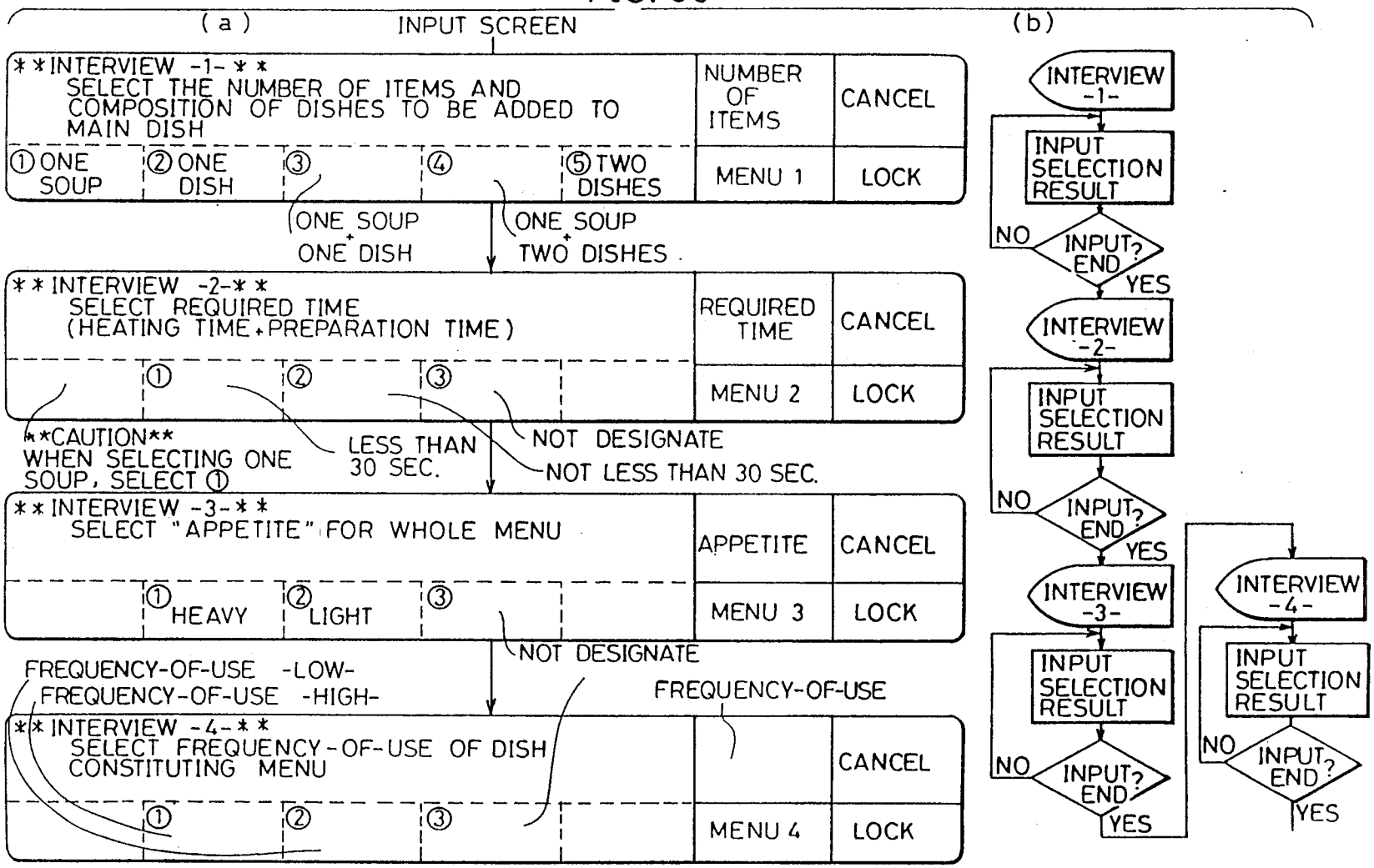
FIG. 36 is a schematic diagram showing a flow chart of input screen transition and input operation in a sub-dishes selection mode.

With reference to FIG. 32, processings at step S401 and downward relates to selection of sub-dishes. Prior to describing the operation flow, an input/output screen in the sub-dish selection mode will be briefly described. FIG. 36 shows an input screen. Four kinds of screens are prepared for asking a user for his intention in the microwave oven according to the present embodiment. Pressing of any of the display portions corresponding to the prepared answers switches the display to the subsequent screen. Input of an answer to the last screen (the fourth screen) starts execution of a search.

The microwave oven of the present embodiment prepares four kinds of input screens. However, the present invention, which is characterized by displaying and switching input/output screens, allows the kinds of input screens to be increased or decreased by increasing or decreasing the number of items in an interview with a user as required.

FIG. 36 (*b*) shows display of each input screen and a flow of operation and processing of a user.

Figure 37:
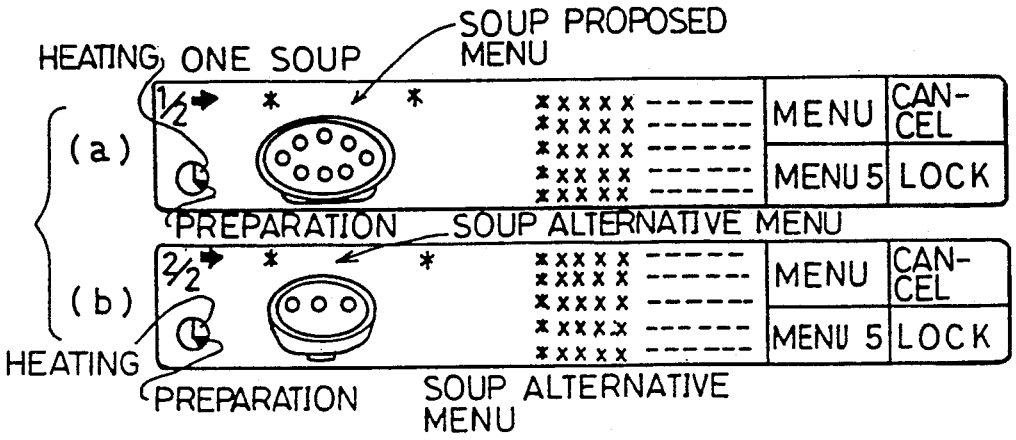
FIGS. 37 to 41 are schematic diagrams showing the output screen in the sub-dishes selection mode.
Figure 38:
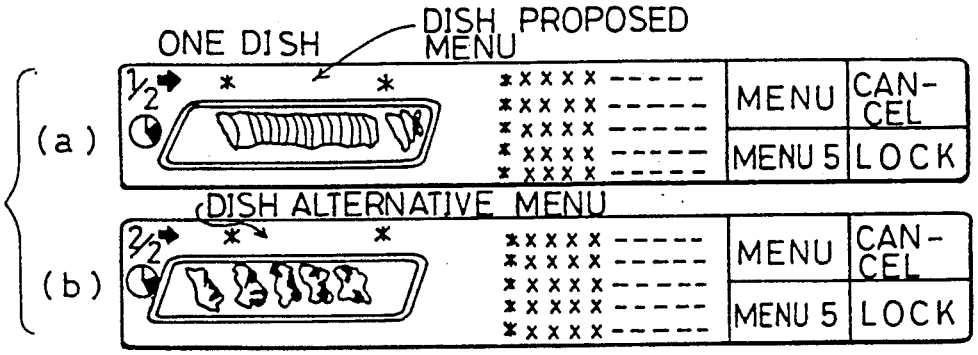

FIGS. 37 to 41 show examples of output screens. FIG. 37 shows an output screen with a single item as a selected sub-dish. FIG. 37 (*a*) shows a proposed dish, while FIG. 37 (*b*) shows an alternative dish.

Figure 39:
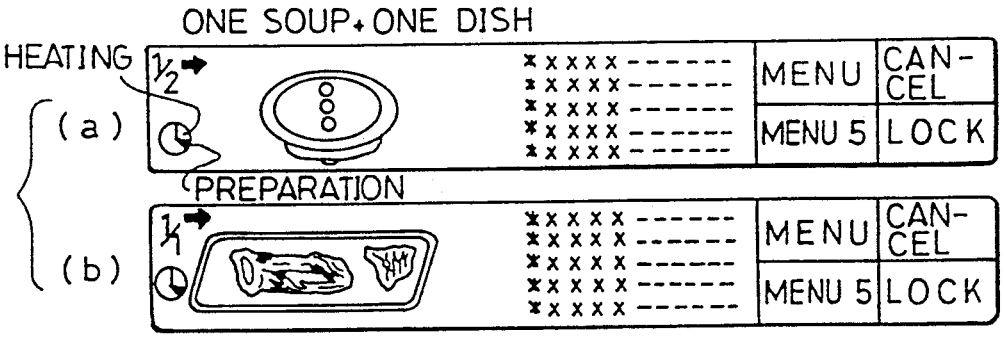
Figure 40:
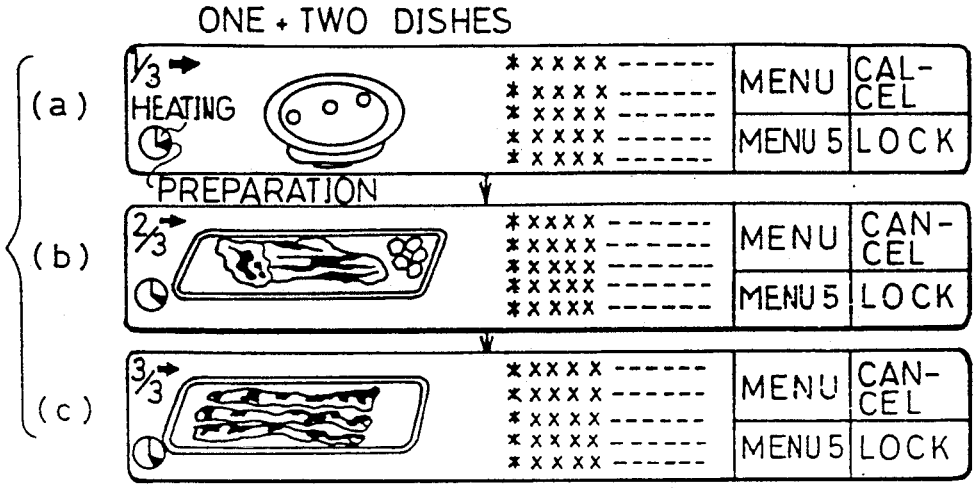
Figure 41:
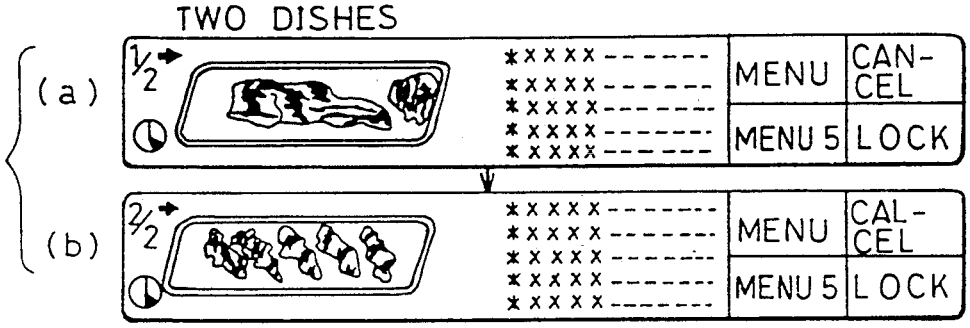

When the number of items of selected sub-dishes is plural, a pair of dishes is displayed as shown in FIGS. 39 to 41. Display of pictures of the respective dishes is made in the ascending order cooking time.

The information displayed on the screens shown in FIGS. 37 to 41 include a picture of a cooked food, character information, and a circular graphic symbol indicative of a heating time and a preparation time required for cooking each dish. The character information shown in FIGS. 37 to 41 have five kinds. However, with a large output screen, a display portion of the control unit can display more kinds of character information in more detail.

Again with reference to FIG. 32, the sub-dish selection operation will be described in detail. The operation mode is switched to the sub-dish selection mode at step S401. The control proceeds to step S402.

At step S402, a menu code of the menu selected by the main dish selection operation is read. The menu code is the one stored at step S310 of FIG. 31. The control proceeds to step S403.

At step S403, an input screen is displayed. As is already described with reference to FIG. 36 (*a*), four kinds of input screens are switched and displayed in response to a pressing of an answer key by a user at the display steps D403, D406, D409 and D412. In response thereto, the operation key is switched and displayed from the display steps D401 to D402, the display steps D404 to D405, the display steps D407 to D408 and the display steps D410 to D411.

Switching of the display of an input screen is executed by pressing an answer display portion in the input/output screen. In other words, the switching is performed by the operation steps 0401, 0402 and 0403 shown in FIG. 32. Pressing operation relating to a final answer, that is, execution of the operation step 0404, starts execution of a search.

Returning to step S403, a determination is made after the display of the input screen as to whether the answer is pressed at step S404 or not. If the determination result is YES, the control proceeds to step S405 and otherwise it returns to step S403. When the control proceeds to step S405, a determination is made as to whether display of all the input screens is finished or not. If the determination result is YES, the control proceeds to step S406, and otherwise it proceeds to step S414.

When the control proceeds to step S414, reading of the subsequent input screen information is performed. The control returns to step S403.

Repetition of the processing of the foregoing steps S403 to S405 and S414 leads to the above-described input screen switching and key pressing processing. The control proceeds to step S406 at the end of all the processings.

At step S406, retrieval of menu information of a sub-dish satisfying predetermined search conditions is executed. In this case, the search conditions are that a menu code of a selected main dish is included and that answers in the four types of interviews are satisfied. Output as a result of the search is a picture of a cooked state of a sub-dish.

After the search, the processing proceeds to the routine for automatically switching pictures of cooked foods. This processing is shown in FIGS. 42 and 43. When "one soup" or "one dish" is designated, and selection of a menu and operation therefor ends in the routine for automatically switching pictures of cooked foods, the control returns to step S408 (see FIG. 33). On the other hand, when the operator wants two or more sub-dishes, control returns from the automatic switching routine to step S408 irrespective of selection operation, when a series of displaying the picture of cooked food in the automatic switching routine is performed twice for a set of menus.

When the control returns from the automatic switching routine, the menu picture is displayed on the screen. When a single item is designated, the menu displayed at the time of execution of selection operation is displayed. One press of the "LOCK" key selects the displayed menu. In order not to select the displayed menu, the "CANCEL" key is pressed. Another press of the "CANCEL" key returns the control to the first input screen.

When two or more items are designated, the picture information of the initially displayed menu is first read, and then the menu picture is displayed on the screen. The menu selection operation is performed by pressing the "LOCK" key once as described above. Subsequently, the remaining menu picture is displayed. For selecting these subsequent menus, the "LOCK" key is pressed once in the same manner as described above. For not selecting the menu, the "CANCEL" key is pressed. When two items are selected, a picture of the remaining menus is displayed in the same manner as in operation of the "LOCK" key.

At step S409, display of a menu picture as described above is executed as the display steps D415, D413 and D414. The name of the operation mode displayed at the display step D413 is "MENU 5" in place of "MENU 4" of the display step D410. "MENU" is displayed at the display step D414 in place of "the frequency of use" displayed at the display step D411. The control proceeds to step S410.

At step S410, the user presses the "LOCK" key once. This operation signifies selection of a menu by the user. The control proceeds to step S411.

Data of the number of times of use of a selected menu is updated at step S411. The control proceeds to step S412.

At step S412, data of the selected menu is stored. The control proceeds to step S413.

A determination is made at step S413 whether an operation of selecting all the menus and processing of storing data thereof are completed or not. If the determination result is YES, the control proceeds to step S426 of FIG. 34 and otherwise the control proceeds to step S416 of FIG. 33.

At step S416, subsequent picture information is read. The control returns to step S409.

Figure 34:
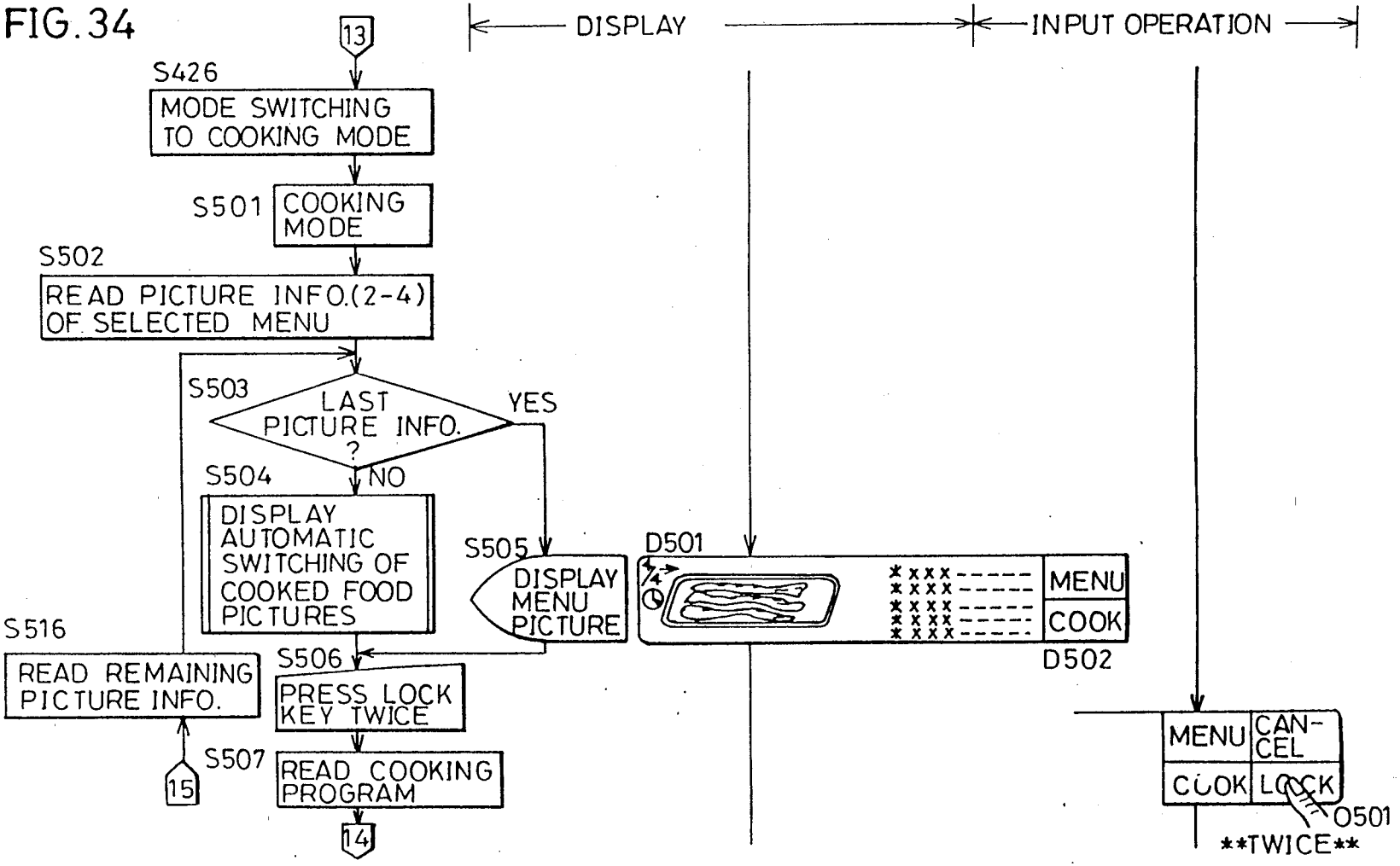

Steps S426 and subsequent steps of FIG. 34 correspond to a flow chart for illustrating operation in a cooking mode, a displaying flow chart and an input operation flow chart.

At step S426, switching of operation modes to a cooking mode is performed to enter a cooking mode at step S501. The control proceeds to step S502.

Picture information of the selected menu (picture information code) is read at step S502. The control proceeds to S503.

A determination is made at step S503 whether the read picture information is the last one or not. If the determination result is NO, the control proceeds to the routine for automatically switching and displaying pictures of cooked foods (see FIGS. 42 and 43) and otherwise the control proceeds to step S505.

The control returns from the automatic switching and displaying routine to step S506 by a user's one press of the "LOCK" key when a menu to be cooked is displayed in the automatic switching and displaying routine.

When the control proceeds from step S503 to step S505, a picture of the final menu is displayed as the display steps D501 and D502. The control proceeds to step S506.

At step S506, the user presses the "LOCK" key twice as shown in the operation step 0501. The control proceeds to step S507.

At step S507, a cooking program of the selected menu is read. The control proceeds to step S508 (see FIG. 35).

With reference to FIG. 35, the selected cooking program is transferred to the heating means control device (see FIG. 13) at step S508. The control proceeds to step S509.

At step S509, the user puts food in the chamber of the microwave oven. The processing proceeds to step S510 when the user finishes putting the food.

At step S510, the user presses the "COOK" key as the operation step 0502, indication of which key has been switched from the operation mode key by a mode switching at step S426, as shown at the display step D502 of FIG. 34.

Subsequently, heating operation is started at step S511. Displayed, in place of the picture of the cooked dish, on the display during the heating operation is cooking operation information included in a cooking program. The cooking operation information includes a target chamber temperature, a current temperature and the remaining heating time. The control proceeds to step S512.

At step S512, the heating operation is finished, together with the display of the cooking operation information. The control proceeds to step S513.

At step S513, a determination is made whether there is a menu left uncooked. If the determination result is YES, the control proceeds to step S516 (see FIG. 34) and otherwise the control proceeds to step S514.

At step S514, an operational mode is switched from the cooking mode to the clock mode. The control proceeds to step S515.

At step S515, the clock mode is started, wherein the time of the day is displayed, which display is not shown.

When the control proceeds from step S513 of FIG. 35 to step S516 of FIG. 34, reading of the remaining picture information is performed. Thereafter, the control returns to step S503 and the subsequent processings will be repeated.

With reference to FIGS. 42 and 43, operation of automatically switching and displaying pictures of cooked foods will be described, which has been referred to in the foregoing description. In the microwave oven according to the present invention, operation for displaying a picture of a cooked state of a menu is carried out at various stages. The operations are categorized into those relating to selection of a main dish, those relating to selection of a sub-dish and those relating to a cooking mode. In a flow chart showing processings corresponding thereto, the automatic switching and displaying routine is collectively shown The routine will be described in detail in the following.

With reference to FIG. 42, search of a picture code is executed at step S701 to read the picture code. The control proceeds to step S702.

A determination is made at step S702 as to whether the number of retrieved picture codes is plural or not. If the determination result is NO, the sub-routine is finished, and otherwise the control proceeds to step S703.

At step S703, processings for reading required time data stored corresponding to the retrieved picture codes is executed as shown in FIGS. 23 and 24. The control proceeds to step S704.

At step S704, a determination is made whether the current operational mode is a cooking mode or not. If the determination result is YES, that is, when the operational mode is a cooking mode, the control proceeds to S707 and otherwise it proceeds to step S705.

At step S705, processing is performed for sorting the required time data corresponding to the retrieved picture codes in an ascending order. The control proceeds to step S706.

At step S706, read of picture information is executed which is indicated by a picture code having the smallest one of the corresponding required time data values. The control proceeds to step S709.

When the control proceeds from step S704 to step S707, the required time data stored corresponding to the retrieved picture codes are sorted in a descending order. Then, the picture codes are sorted corresponding to the sorted required time data. The control proceeds to step S708.

At step S708, picture information is read based on a picture information code corresponding to the required time data having the largest value. The control proceeds to step S709.

At step S709, displaying is performed on the display according to the read picture information. The processing proceeds to step S710.

At step S710, a determination is made whether the user has pressed the "LOCK" key or not. When the determination result is YES, the control proceeds to step S724 and otherwise it proceeds to step S711.

A determination is made at step S711 whether two seconds have passed after the start of displaying. If the determination result is NO, the control returns to step S709 to continue displaying, and otherwise the control proceeds to step S712.

At step S712, picture display interval processing is executed. This processing proceeds to step S713 of FIG. 43.

A determination is made at step S713 whether one second has passed after the start of the picture display interval. If the determination result is NO, the control returns to step S712 to continue the interval processing, and otherwise the processing proceeds to step S714.

A determination is made at step S714 whether there is picture information left unread. If the determination result is YES, the control proceeds to step S719, and otherwise the control proceeds to step S715.

A determination is made at step S715 whether the entire picture information is displayed twice. If the determination result is NO, the control proceeds to step S720 and otherwise it proceeds to step S716.

At step S716, the picture display time t1 is set to 2 seconds. The control proceeds to step S717.

At step S717, a determination is made as to the current operation mode of the microwave oven. The control proceeds to steps S723, S728 and S718 when the operational mode is a cooking mode, a main dish selection mode and a sub-dish selection mode, respectively.

At step S718, the contents of the answer to the question screen 1 in the sub-dish selection mode is checked. A determination is made in accordance with the answer whether the number of designated items is "one soup" or "one dish." If the determination result is NO, the control proceeds to step S723 and otherwise the subroutine is finished to and the control returns to the calling routine.

If the control at step S710 branches to step S724, a determination is made whether the current operational mode of the microwave oven is the main dish selection mode or a preview mode. The preview mode, which is not yet been described, will be detail with reference to the figures later. In the determination result is YES, the control proceeds to step S711 and otherwise the control proceeds to step S725.

At step S725, the contents of the answer to the question screen 1 in the sub-dish selection mode is checked. In other words, a determination is made as to whether the designated number of items is "one soup" or "one dish." If the determination result is YES, the control proceeds to step S711 and otherwise it proceeds to step S726.

At step S726, a determination is made whether the current operational mode of the microwave oven is the cooking mode. If the determination result is No, the control proceeds to step S727 and otherwise it returns to the cooking mode.

It is also determined at step S717 whether the operational mode of the microwave oven is a mode of the food material designating system in the main dish selection mode. In this case, if the determination result is NO, the control returns to the sub-dish selection mode and otherwise it returns to the mode of the food material designating system.

When the control at step S714 branches to step S719, picture information is read corresponding to the picture code corresponding to the next in the sorted required time data. The control returns to step S709 of FIG. 42.

When the control branches at step S715 to step S720, processing is executed for reversing white/black of the area in which a black arrow is indicated on a white base within the display picture. The control proceeds to step S721.

At step S721, the display time t1 is set to three seconds. Thereafter, the control proceeds to step S722 of FIG. 42.

At step S722, the current operational mode of the microwave oven is determined. If the operational mode is the cooking mode, the control proceeds to step S708 and otherwise it proceeds to step S706.

When the control branches at steps S717 or S718 (both of FIG. 43) to step S723, the count of the number of displays of all the pictures is reset to zero. The control proceeds to step S722.

When the control branches at step S717 to step S728, a determination is made whether the current operational mode of the microwave oven is the preview mode in the main dish selection mode. The preview mode will be described in detail with reference to the figures later. If the determination result is NO, the control proceeds to step S723, and otherwise it returns to the preview mode in the main dish selection mode.

In the microwave oven according to the present invention, one IC card stores data relating to the main dish selection operation and the other IC card stores data relating to the sub-dish selection as described above. Then, based on data of the initially selected main dish, a single or a plurality of sub-dishes accompanying the main dish are selected. As a result, all of combinations of dishes (i.e. menus) to be served for one dining can be proposed to a user, which assists the user to prepare a menu.

As described in the foregoing, for one IC card storing data relating to main dishes, a plurality of IC cards can be prepared which store data of the accompanying sub-dishes. Conversely, it is also possible to prepare a plurality of IC cards for storing data of main dishes corresponding to one IC card for storing data of sub-dishes. This expands a function of assisting menu preparation, which function proposes a combination of a main dish and one or a plurality of sub-dishes.

While there exists a plurality of allowable combinations of the above-described IC cards for storing main dish data and IC cards for storing sub-dish data attached to the oven, there also exists combinations of cards which are not allowable cards. A function of checking the combinations is proposed, based on I.D. information stored in the IC cards. In addition, when an erroneous combination is found, it is possible to display the reason and message for dealing with the error, whereby a user can easily obtain a correct combination of cards. Therefore, a microwave oven can be provided which reliably assists in the preparation of menu.

Figure 45:
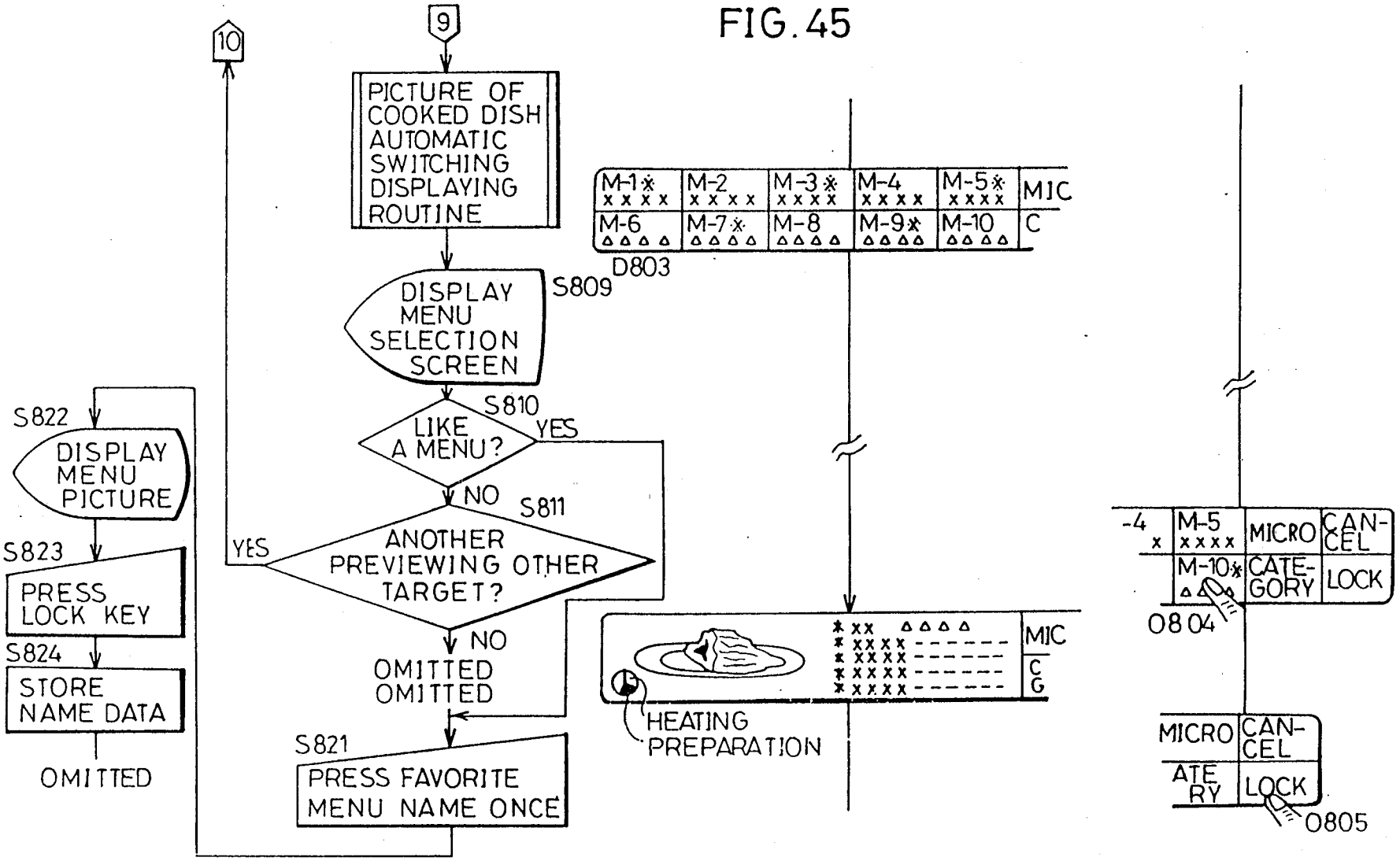
FIG. 45 is a flow chart of a program necessary for selecting a menu by designating the frequency of uses.

FIGS. 44 and 45 are flow charts showing another system of the menu name designation system of the main dish selection operation in the microwave oven according to the second embodiment of the present invention. This system is characterized by a mode referred to as "preview mode" as described above. The preview mode is a mode enabling a user to preview a menu as the prior stage to the main dish selection operation by automatically switching and displaying pictures of cooked state of menus whose names are displayed.

As already described, for an efficient use of the microwave according to the present invention, it is desirable for a user to have knowledge or cooking experience of a menu displayed by its name. However, if he or she does not meet such requirements, the user should execute trial-and-error operation for selecting an appropriate menu name. In the first embodiment wherein ten kinds of menus are prepared only for the heating category, it requires quite a time for finding a desired menu through the above-described selection operation.

The preview mode is directed to solving such a problem. The preview mode is intended for successively switching and displaying pictures of the menu prepared by menu names to provide a user with necessary knowledge for selecting a desired menu.

With reference to FIG. 44, similar to step S202 of the microwave oven according to the first embodiment of the present invention shown in FIG. 28, the control proceeds from step S118 of FIG. 27 to step S801 of the preview mode. Steps S801 to S805 correspond to steps S202–S206 of FIG. 28, respectively. Therefore, no detailed description thereof will be repeated here.

The user determines at step S806 whether the preview mode is to be used or not. If the determination result is YES, the control proceeds to step S807 and otherwise the control enters the processings at step S207 and subsequent steps which already have been described with reference to FIG. 28. Description of processings other than those of the preview mode will not be repeated here.

At step S807, menu type to be previewed is selected. When menus are to be previewed which are in a range of the frequency of uses selected at step S802, the processing proceeds to step S808 and conversely, when menus out of the range of the frequency of uses are to be previewed, the processing proceeds to steps S825.

At step S808, an arbitrary menu name display portion is pressed twice in succession among the menu names with the predetermined symbols (*) on the menu name screen displayed at step S805. This operation advances the control to the automatic switching and displaying routine which is already described with reference to FIGS. 42 and 43. Then, when two cycles of displaying of all the menu pictures are finished, the control returns from the automatic switching and displaying routine to step S809 (see FIG. 45).

At step S809, the same menu name screen as that of steps S805 is displayed. The control proceeds to step S810.

The user determines at step S810 whether there is a menu in the menu pictures displayed in the preview mode which he or she likes. If the determination result is YES, the processing proceeds to step S821 and otherwise the processing proceeds to step S811.

The user determines at step S811 whether another preview displaying is to be made or not and presses a predetermined key in accordance with the result. In this case, there could be a case where the user selects menu type other than that selected at step S807 and a case where the same menu type is repeatedly selected. If the determination result is YES, the control returns to steps S807 and otherwise it proceeds to such operation as change of the heating category and change of a menu selection mode. The later processing already has been described with reference to FIGS. 29 and subsequent figures and therefore no description thereof will be repeated here.

When the control proceeds from steps S810 to S821, the display portion on which the name of the menu that the user like is displayed, is pressed by the user once as shown in the operation step 0804. The control proceeds to step S822.

At step S822, a picture of a cooked state of the selected menu is displayed as shown in the display step D804. The control proceeds to step S823.

At step S823, the user determines adoption of the menu to press "LOCK" key as shown in the operation step 0805. The control proceeds to step S824.

At step S824, the data of the adopted menu is stored.

Again with reference to FIG. 44, when the control branches at step S807 to step S825, the user presses twice in succession an arbitrary menu name display portion without a symbol (*). Thereafter, the control shifts to the routine for automatically switching and displaying pictures of cooked foods (see FIG. 48) as described above. The following processings are not repeated here which are the same as those at steps S808 and subsequent steps.

In the above-described preview mode, picture displays of menu names displayed on one screen are divided into two types by designating the frequency of use. This division is intended for efficient evaluation between the menus by reflecting a user's intention at selecting a menu in view of the frequency of use and by reducing the number of display pictures per preview.

With such preview mode prepared, even if a user lacks sufficient knowledge concerning cooking information stored in an IC card, a picture of cooked state of a predetermined menu can be previewed by automatic switching and displaying, among a group of menus shown by their menu names without pressing all of the menu display portions. As compared with the conventional system on which respective menu name display portions are pressed by trial-and-error to find a desired menu, the preview mode reduces the number of operations and reduces a time period required for evaluating displayed information. As a result, comparison between the respective menu information with each other can be more effectively made.

Figure 46:
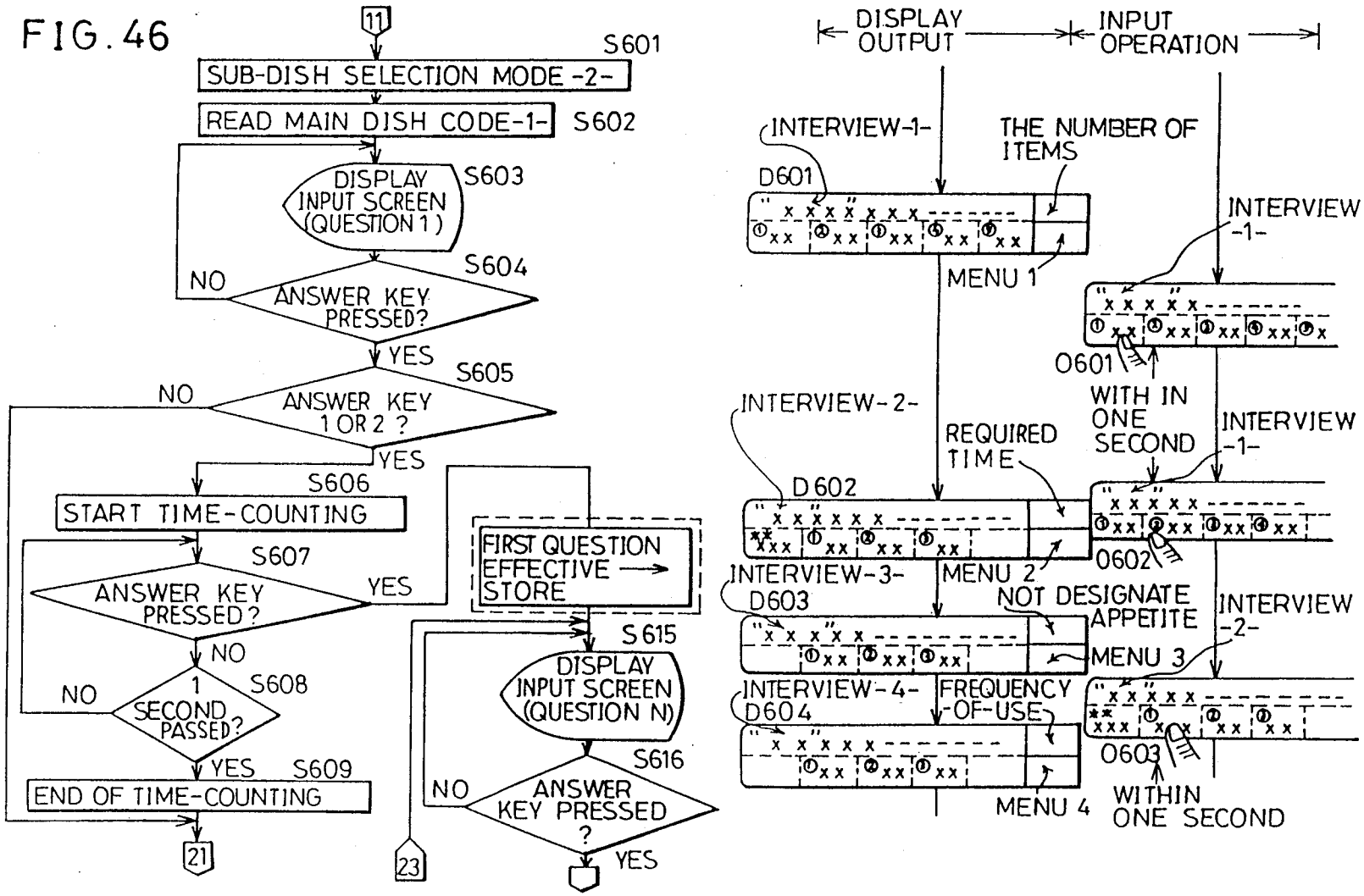
FIG. 46 is a flow chart of a program for inputting two answers to one input screen in the sub-dish selection mode.

With reference to FIGS. 46 an 47, a third embodiment of a microwave oven according to the present invention will be described. This embodiment is characterized in that a sub-dish selection operation is carried out on a system different from that of the sub-dish selection operation of the first embodiment. Other portions are the same as those of the first embodiment, and no detailed description will be repeated here.

Figure 47:
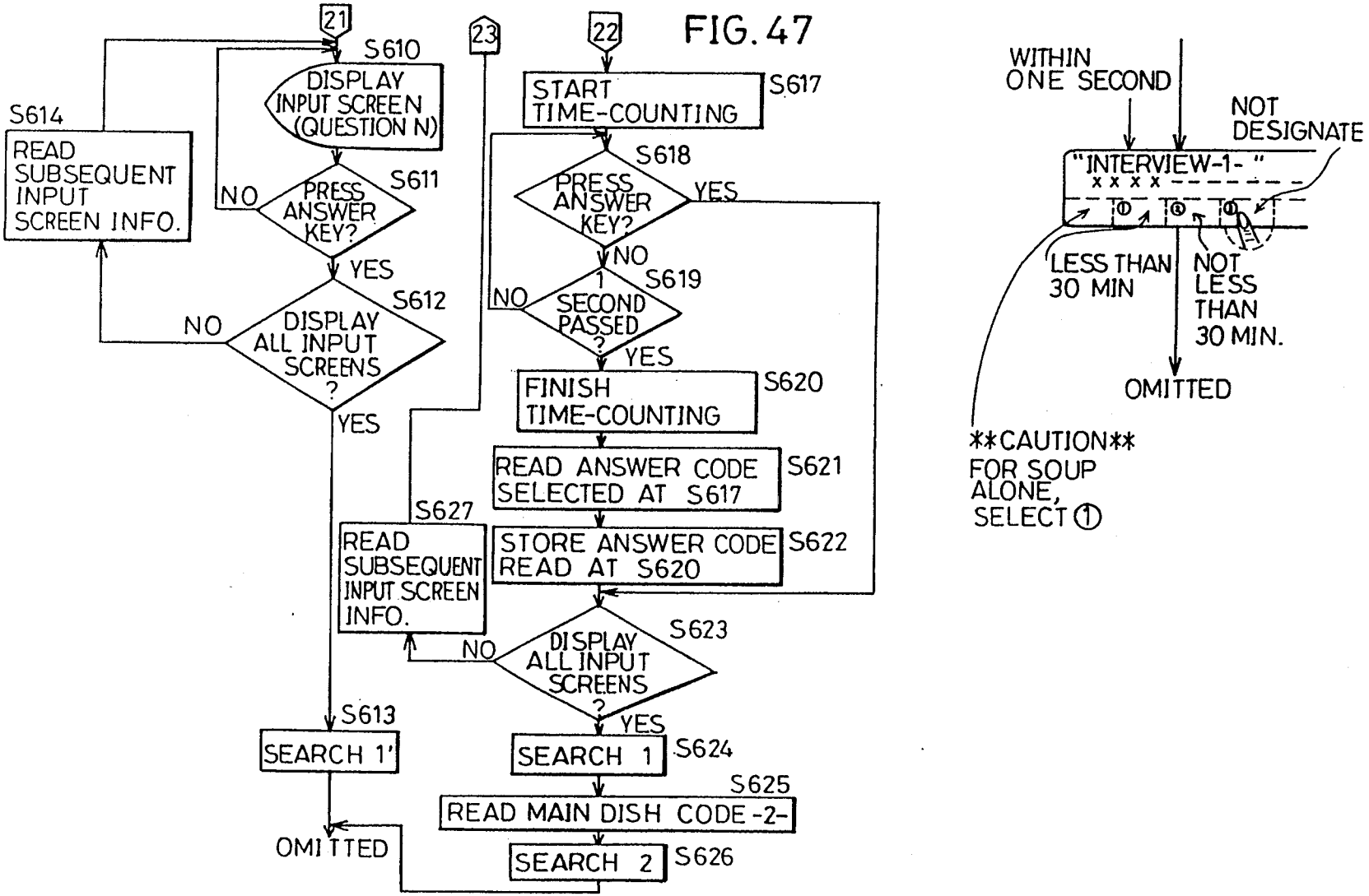
FIG. 47 is a flow chart of a program for inputting two answers in response to one question in the sub-dish selection mode.

In the system shown in FIGS. 46 and 47, at the time of selecting items, search by designating "one soup" and search by designating "one dish" are performed for selecting a combination of "one soup and one dish" in order to make search results more varied. In addition, in order that displaying of the above-mentioned four kinds of input screens is required only once for each, two kinds o selection of answers are prepared for each input screen.

It should be further noted that for the microwave oven according to the present invention, respective sub-dishes are selected in view of balance of nutrition, for example, as a dish singly accompanying a main dish selected as described above, or two dishes accompanying the main dish. Therefore, the contents of a dish proposed by the microwave oven differ from a case of selecting "one soup and one dish" to a case of designating "one soup" and "one dish" for selection. In addition, different answers can be selected for four input screens. Therefore, a variety of combinations can be achieved at selecting two sub-dishes. Similarly to a case where "one soup" and "one dish" are selected, various alternative menus are prepared for selecting "one soup" and "one dish" in this system. This provides more variety to selection.

Figure 31:
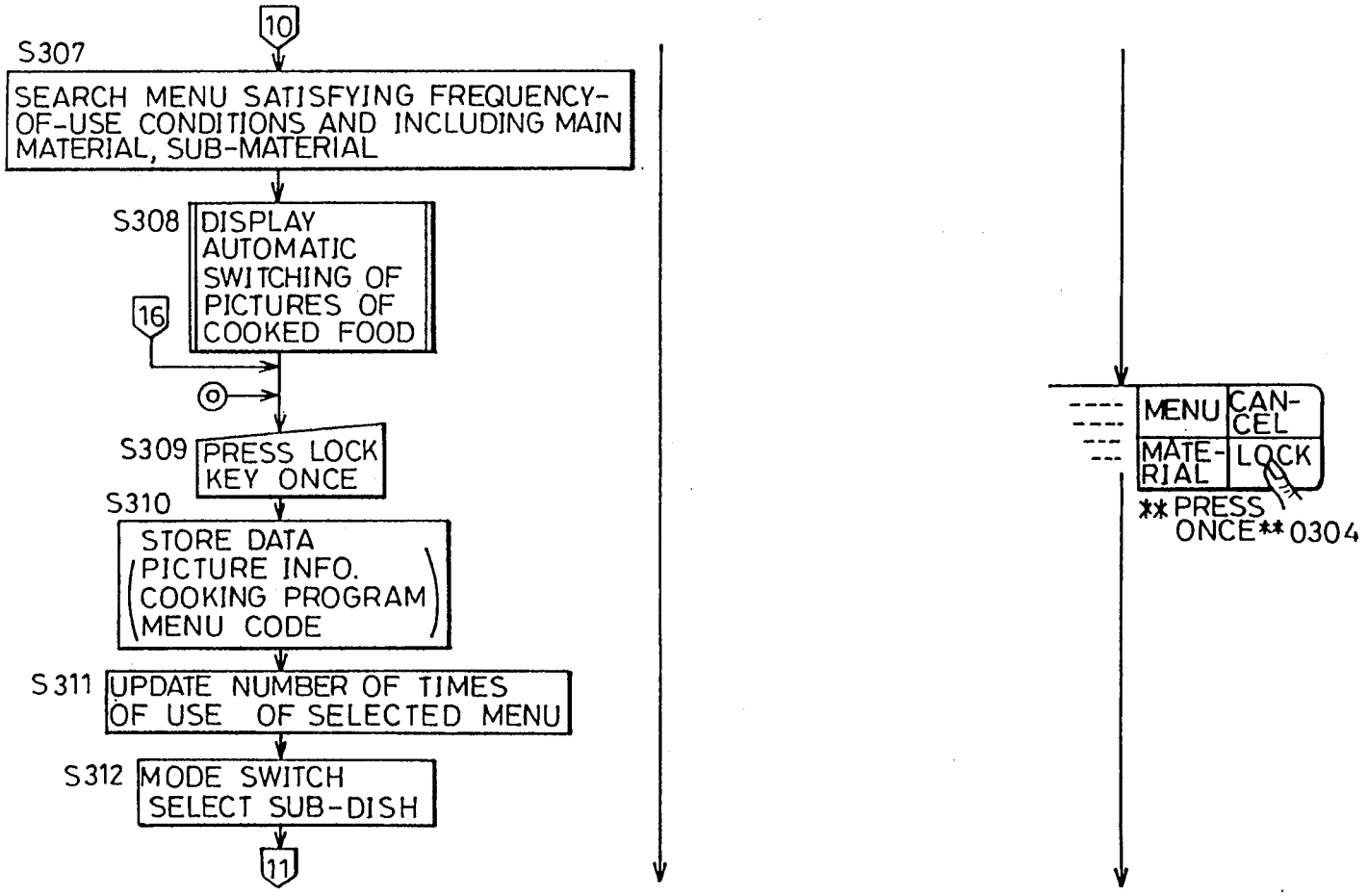
Figure 33:
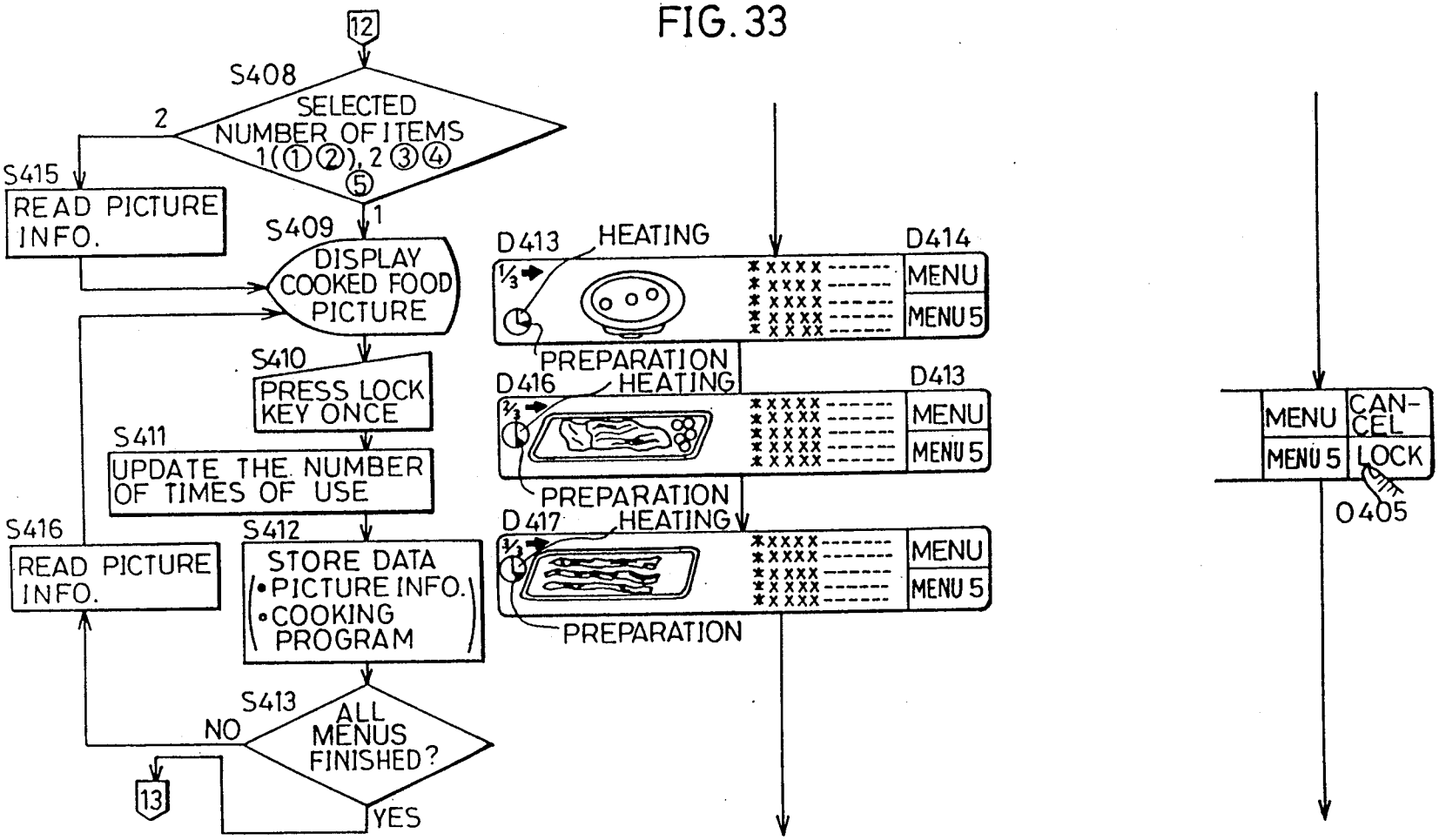

With reference to FIG. 46, similar to the first sub-dish selection operation shown in FIG. 32, the routine for selecting a sub-dish is executed immediately after step S312 shown in FIG. 31. At step S601, the operation mode is switched to the second sub-dish selection mode. The control proceeds to step S602.

At step S602, the code of the selected main dish is read. Subsequently at step S603, the first input screen is displayed as indicated in display D601.

A determination is made at step S604 whether an answer key is pressed by the user or not. If the determination result is NO, the control again returns to step S603 to continue displaying of the first input screen. If the determination result is YES, the control proceeds to step S605. It is assumed here that the user presses the "one soup" key as shown in the operation step 0601.

At step S605, a determination is made whether the pressed answer key is the "one soup" or the "one dish" key. If determination result is NO, the control proceeds to step S610 and otherwise the control proceeds to step S606.

At step S606, time-counting is started by the timer function. The control proceeds to step S607.

A determination is made at step S607, whether the answer key "one dish" or "one soup" is pressed or not. The answer key should be different from that pressed at step S605. If the determination result is YES, it is memorized that an effective answer is given to the first question and the control proceeds to step S610 and otherwise the control proceeds to step S608.

A determination is made at step S608 whether one second has passed since the start of the counting at step S606. If the determination result is NO, the control returns to step S607 and otherwise it proceeds to step S609.

Time-counting is finished at step S609. The control proceeds to step S610 of FIG. 47.

Again with reference to FIG. 46, at step S615, the second input screen is displayed as the display step S602. The control proceeds to S616.

At step S616, a determination is made whether an answer key is pressed or not. If the determination result is NO, the control returns to step S615 and otherwise it proceeds to step S617 (FIG. 47). Meanwhile, such questions as shown in the display steps D603 and D604 are displayed and the processings at the operation step 0603 and subsequent operation steps corresponding thereto are performed by the user.

With reference to FIG. 47, time-counting by the timer function is started at step S617.

Subsequently at step S618, a determination is made whether the user has pressed an answer key. If the determination result is YES, the control proceeds to step S623 and otherwise it proceeds to step S619.

At step S619, a determination is made whether one second has passed since the start of the time-counting at the step S617. If the determination result is NO, the control returns to step S618 and otherwise it proceeds to step S620. More specifically, if such operation by the user as in the operation step 0603 shown in FIG. 46 is followed by an input of an answer by the user as shown in the operation step 0604 of FIG. 47 within one second, the control proceeds from step S618 to step S623 and otherwise it proceeds to step S623 through the processing at steps S620 to S622.

At step S620, the time-counting by the timer function is finished. At step S621, the same data as that designated by the answer key pressed at step S617 is read as answer data of the input screen. Subsequently at step S622, the data read at step S621 is input as a second answer.

This processing has the following meaning. As is already described, the user determines a selection of "one soup" and "one dish" on the first input screen. The operation steps 0601 and 0602 of FIG. 46 show such selection. However, an operation of pressing an answer key corresponding to the secondly selected sub-dish is not performed in an operation of pressing an answer key on the second input screen. In this case, therefore, processing is executed on the assumption that the same answer key as that pressed for the first selected sub-dish is also pressed for the secondly selected sub-dish.

Subsequently at step S623, a determination is made whether all of the input screens are displayed. If the determination result is NO, the control proceeds to step S627 and otherwise it proceeds to S624.

At step S624, a first search processing is performed. The search is executed based on the data input by pressing the answer key first selected for a question of each input screen. The control proceeds to step S625.

At step S625, a second processing of reading a main dish is executed. The control proceeds to step S626.

At step S626, the second search processing is executed. The search is executed based on the data input by pressing a secondly selected answer key for a question of each input screen, or if there is no secondly selected key pressing, based on the data obtained by editing the data input by the first selected answer key pressing as a secondly selected search data. The following processing is the same as that of the first embodiment which is has already been described and therefore description of the processing is not repeated here.

When the processing proceeds from step S609 of FIG. 46 to step S610 of FIG. 47, one of the second to the fourth input screens is displayed at step S610.

Subsequently at step S611, determination is made whether the answer key is pressed or not. If the determination result is NO, the control returns to step S610 and otherwise it proceeds to step S612.

At step S612, determination is made whether display of all of the input screens is finished or not. If the determination result is NO, the control proceeds to step S614 and otherwise it proceeds to step S613.

At step S614, the subsequent input screen information is read. The control thereafter returns to step S610.

When the processing proceeds from step S612 to step S613, a search processing is performed at step S613. The following processings are the same as those in the first embodiment and therefore no description is given thereto.

When the processing branches from step S613 to step S627 of FIG. 47, the subsequent input screen information is read at step S627. Thereafter, the control returns to step S615 of FIG. 46 wherein the processings at step S615 and subsequent steps will be repeated.

By pressing a selection answer display portion with respect to a displayed question, switching of the four kinds of input screens in the sub-dish selection operation is performed subsequently to input of an answer Then, the input screen is switched to the subsequent input screen which is displayed. Therefore, inputting answers to questions is a repetition of a simple operation. It is therefore unlikely that an increase in the number of questions to be displayed deteriorates facility of input operation. Furthermore, questions are prepared in the form of a multiple choice. It is possible to mechanically select an answer. Therefore, it is not probable that determination for selecting an answer takes a long time. An answer input can be carried out smoothly.

In addition, a system is prepared, as described above, of inputting the number of items designating data by separately and successively pressing "one soup" and "one dish." According to this system, two answers can be input for each question by pressing a selection key twice for one input screen within a predetermined time. Therefore, the operation is more efficient as compared with a system on which a series of questions are displayed twice in succession and answers are given to each of the questions. When a second answer key pressing operation is not performed within a predetermined time, data of the first selection key is processed to generate a second answer to the input screen. Therefore, there is no possibility of incomplete input data caused by input omission. Because such incomplete input data will not occur, failure of switching of display to the subsequent screen will not occur either.

In addition, when a combination of "one soup" and "one dish" is selected apart from "one soup+one dish", combinations of sub-dishes obtained by the selections differ from each other. Therefore, a larger variation can be obtained in a combination of sub-dishes accompanying the same main dish. Furthermore, as described above, a sub-dish to be designated as a single item is associated with one proposed menu and one alternative menu. Since pictures of cooked state of these menus can be automatically switched and displayed, the user has a large choice.

When a plurality of menu data are retrieved, pictures of cooked states of these menus are switched and displayed on the display portion. The order of the display is based on a time required for cooking each menu. In the menu selection operation, for example, picture information is switched and d splayed in the ascending order of the cooking time, and in the heating operation, the picture information is switched and displayed in the descending order of the cooking time. In order to make a contrast clear between the required times, the total cooking time is shown in the circular graph in proximity to the cooked food picture information. The circular graph is divided into a heating time and cooking preparation time which are distinguished from each other by color.

By thus changing the order of display of the pictures according to an operation mode and a required time, required times of a plurality of menus can be relatively compared with ease and can be displayed in the most appropriate order according to the operation mode. Efficiency in determining a menu selection and execution of cooking can be significantly improved as a result.

In the above-described preview mode, the number of times of display of the entire pictures is twice in principle. Display of a second cycle requires a time period longer than that for the display of a first cycle. Therefore, display in the first cycle can be used for quickly observing each picture information, while display in the second cycle facilitates a reliable selection of a desired menu.

Furthermore, a symbol to be displayed in one block of the display picture is displayed in reverse in the second cycle. Therefore, the user can reliably recognize that the display of the first cycle finishes and display of the second cycle starts.

Such various improvements in switching and displaying of pictures can be made not only in the menu selection mode but also in the cooking mode. It is therefore possible to reliably carry out a command input operation (pressing the LOCK key twice in a case of the present embodiment) for loading the calling/heating operation control unit with the cooking program in the cooking operation requiring a large number of cooking data to be called (the number of menus).

Figure 48:
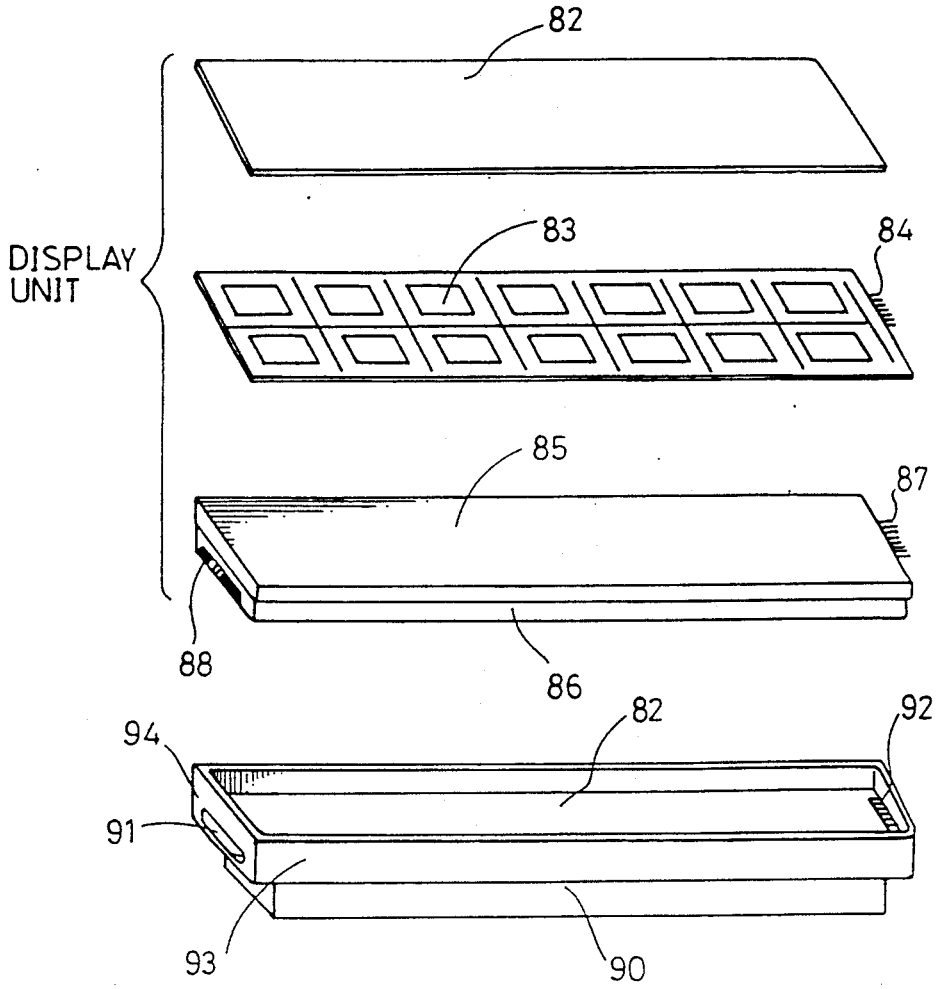
FIG. 48 is an exploded perspective view of a control unit of a microwave oven including one slot of an IC card according to another embodiment of the present invention.
Figure 49:
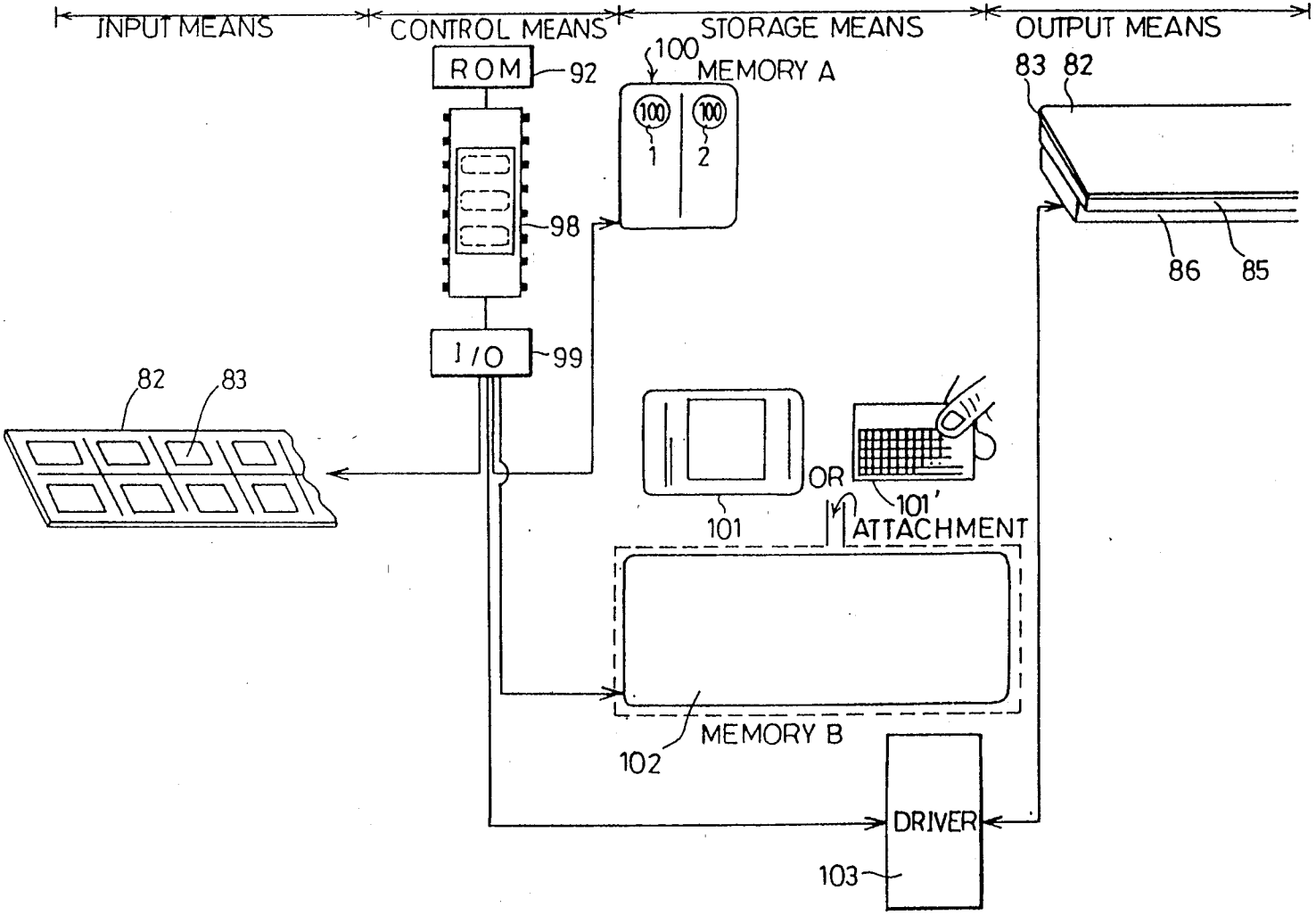
FIG. 49 is a block diagram of a control system of the microwave oven having such a control unit as shown in FIG. 48.

In any of the foregoing embodiments, shown is a microwave oven having slots into which two IC cards are inserted, as an example. However, the present invention is not limited thereto. As shown in FIGS. 48 and 49, for example, a microwave oven having only one slot for an IC card (slot 91) can be realized. With reference to FIG. 48, the microwave oven according to the present embodiment differs from the microwave oven of the first embodiment shown in FIG. 8 in that only one IC card slot 88 is provided in the display control portion 86 and that only one slot 91 for an IC card is provided on the side portion of the control unit panel 89. In other respects, the device shown in FIG. 48 is same that shown in FIG. 8. The same parts are given the same reference numerals and functions thereof are also the same. Therefore, detailed description thereof will not be repeated here.

With reference to FIG. 49, the structure of the microwave oven according to the present embodiment differs from that of the microwave oven according to the first embodiment shown in FIG. 9 in that it includes one main memory 102 in place of the main memories 102*a* and 102*b* of FIG. 9. The main memory 102 is structured by the IC card 101 to be inserted in the slot 91 (88) shown in FIG. 48.

With a microwave oven having only one slot, when information relating to main dish and sub-dish are separately stored in two IC cards as described above, the two IC cards should be alternately inserted in the microwave oven. Therefore, the microwave oven of the present embodiment operates by a program partially different from that of the microwave oven described in the first embodiment. The program will be described in the following with reference to FIGS. 50 and 51.

With reference to FIG. 50, at step S151, a user inserts a first card (card 1) into a slot 88 as the operation step 01. As a result, circuit connection is established between the card 1 and a display control unit 86.

At step S152, the I.D. code (I.D. code 1) of the card 1 is read.

At step S153, a determination is made whether the read I.D. code 1 has a value (S) indicative of a sub-dish card. If the determination result is YES, the control proceeds to step S171 and otherwise it proceeds to step S154.

At step S154, the I.D. display information is read and the control proceeds to step S155. At step S155, display information of the I.D. code 1 is displayed as the display step D1.

At step S156, a determination is made whether the displayed "subsequent screen" key is pressed or not. If the determination result is YES, the control proceeds to step S157 and otherwise it returns to step S155. When the control returns to step S155, the display processing is executed until the "subsequent screen" key is pressed.

At step S157, the display screen 1 is displayed as the display step D2. The control proceeds to step S158.

At step S158, a determination is made whether the "OK" key or the "CANCEL" key displayed at the display step D2 is pressed. If the "OK" key is pressed, the control proceeds to step S159 and if the "CANCEL" key is pressed, the control proceeds to step S175 and otherwise the control returns to step S157 to continue displaying processing until any of the above-described keys is pressed.

At step S159, the I.D. code 1 read at step S152 is stored. Then, I.D. code analysis and I.D. information display prior to the main dish selection operation are finished, the control proceeds to the main dish selection mode.

When the control proceeds from step S153 to step S171, the display screen 3 is displayed as the display step D5.

At step S172, determination is made whether the "CANCEL" key displayed at the display step D5 is pressed or not. If the determination result is YES, the control proceeds to step S173 and otherwise it returns to steps S171.

At step S173, erase of input finish data (I.D. code 1) is executed. The control proceeds to step S174. At step S174, the user takes out the input finish card (card 1). The processing returns to step S151.

When the control at step S158 proceeds to step S175, erase of the input finish data (I.D. code 1, I.D. display information 1) is executed. The control proceeds to step S176. At step S176, the user takes out the inserted card (card 1). The processing returns to step S151.

Figure 51:
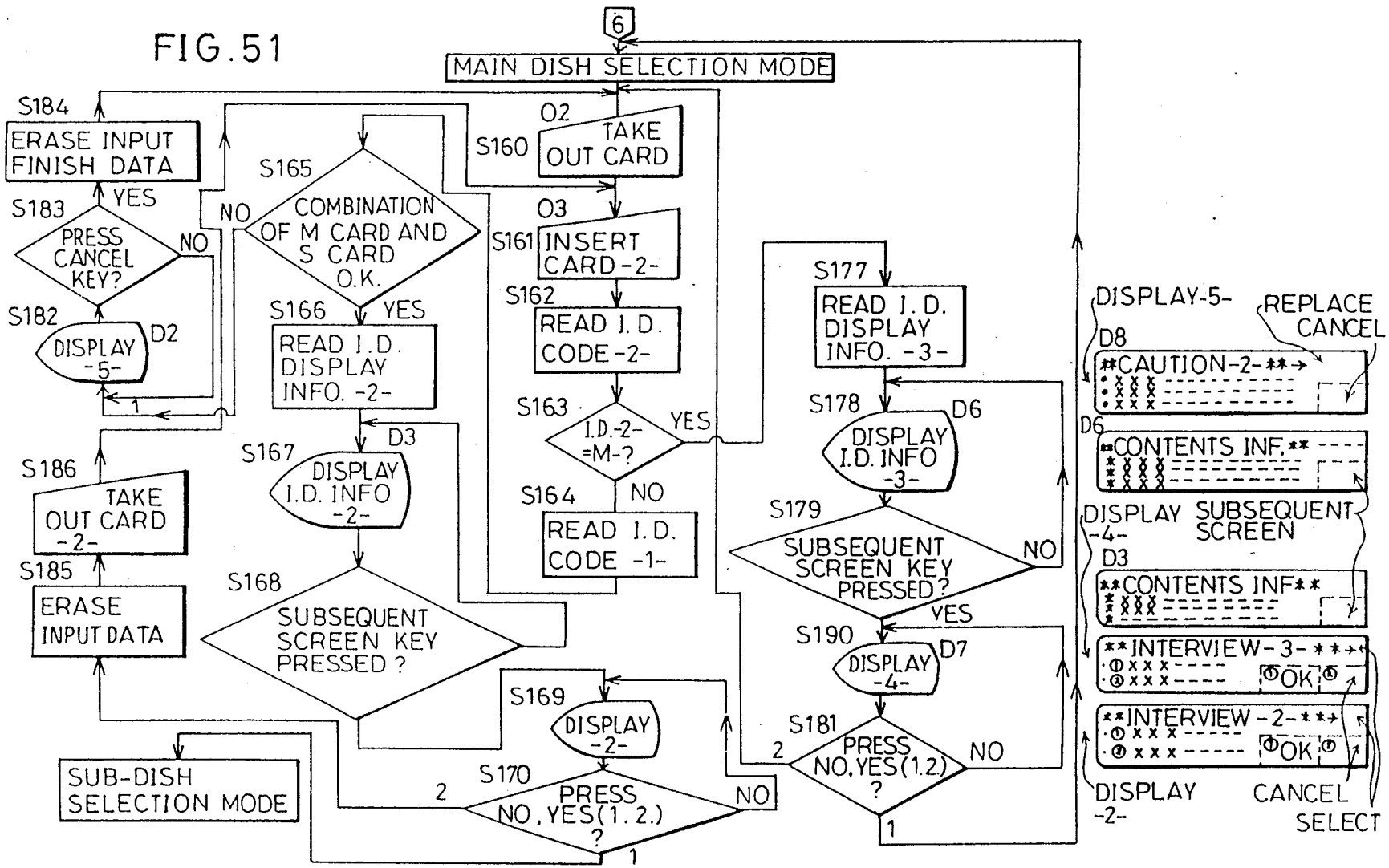
FIG. 51 is a flow chart of a program for checking adaptability of information stored in two inserted IC cards in a microwave oven having only one slot.

Steps S160 and downward of FIG. 51 show a flow chart for the main dish selection mode. At step S160, the user takes out the card (card 1) inserted at step S151 (FIG. 50) and the control proceeds to the subsequent step S161.

At step S161, the user inserts a new card (card 2). At step S162, the I.D. code (I.D. code 2) of the inserted card (card 2) is read. At step S163, a determination is made whether the I.D. code 2 of the inserted card (card 2) has a value (M) indicative of a card for main dish selection. If the determination result is YES, the control proceeds to step S177 and otherwise it proceeds to step S164.

At step S164, the I.D. code 1 stored at step S159 is read.

At step S165, a determination is made whether the I.D. code 1 and the I.D. code 2 are appropriately combined with each other or not. This determination is carried out by checking an "applicable card code" indicative of a card to be combined. The applicable card code is a part of the I.D. code information. If the determination result is YES, the control proceeds to step S166 and otherwise it proceeds to step S182.

At step S166, the display information of the card 2 is read. At step S167, the display information 2 is displayed as the display step D3.

At step S168, a determination is made whether the "subsequent screen" key displayed on the display screen is pressed or not. If the determination result is YES, the control proceeds to step S169 and otherwise it returns to steps S167.

At step S169, the display screen 2 is displayed as the display step D4. The control proceeds to step S170.

At step S170, a determination is made whether the "OK" key or the "CANCEL" key displayed on the display is pressed or not. If the "OK" key is pressed, the control proceeds to the sub-dish selection mode and when the "CANCEL" key is pressed, the control proceeds to step S185. When neither key is pressed, the display processing is continued until either one of the key is pressed. The sub-dish selection mode is the same as that of the first embodiment which has already been described.

When the control at step S163 proceeds to step S177, the I.D. display information is read. At step S178, the I.D. display information read at step 177 is displayed as the display step D6.

At step S179, determination is made whether the "subsequent screen" key displayed on the display screen is pressed or not. If the determination result is YES, the control proceeds to step S180 and otherwise it returns to step S178.

At step S180, the display screen 4 is displayed as the display step D7.

At step S181, a determination is made whether the "OK" key or the "CANCEL" key displayed on the display screen is pressed or not. If the "OK" key is pressed, the control proceeds to the above-described main dish selection mode and when the "CANCEL" key is pressed, the control proceeds to step S160. If neither key is pressed, the control returns to step S180 to continue displaying processing until either one of the key is pressed.

When the processing proceeds from step S165 to S182, the display screen 5 is displayed.

Subsequently at step S183, a determination is made whether the "CANCEL" key on the display screen is pressed or not. If the determination result is YES, the control proceeds to step S184 and otherwise it returns to step S182.

At step S184, erasing of the input data (I.D. code 2) is carried out. The control proceeds to step S160.

When the control proceeds from step S170 to step S185, the input data (I.D. display information 2) erasing processing is carried out. The control proceeds to step S186. At step S186, the user takes out the card 2. The processing thereafter proceeds to step S161.

A program having a control structure as described above enables a microwave oven having a single slot to execute a processing of selecting menus as is executed in the first embodiment by checking kinds and the insertion order of IC cards inserted in the slot. In this case, an IC card which stores sub-material selection information is allowed to remain inserted in the slot in the menu selection operation. Because sub-dish selection information stored in this IC card is directly accessible by the CPU 98, it is possible to store in the data area 100*b* of the memory 100 only menu codes of sub-dishes, among sub-dish data.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. Microwave oven comprising:

cooking means, including a microwave generator, for cooking food according to a cooking program, specifying a cooking procedure;

external memory attaching means for providing detachable attachment of both a first type and a second type external storing means, said first type external storing means for storing a plurality of kinds of main dish cooking information from cooking information relating to the cooking program and said second type external storing means for storing a plurality of kinds of sub-disk cooking information to be combined with the main cooking information in a menu, each of said plurality of kinds of main dish cooking information being related to at least one of said plurality of kinds of sub-dish cooking information;

main dish cooking information selecting means, operatively connected to the first type external storing means, for accessing a user selected one of said plurality of kinds of main dish cooking information stored in the first external storing means attached to said external attaching means;

sub-dish cooking information selecting means, operatively connected to the second type external storing means, for assisting a user, in preparation of a menu, in selecting sub-dish cooking information related to said accessed user selected main dish cooking information, said sub-dish cooking information being separately stored in said second type external storing means attached to said external attaching means;

menu storing means, operatively connected to the main dish cooking information selecting means and the sub-dish cooking information selecting means, for storing a series of cooking programs corresponding to the main dish and sub-dish selected by the user as a menu;

cooking controlling means, operatively connected to the cooking means and the menu storing means, for applying said cooking programs stored in said menu storing means to said cooking means in a predetermined order for execution of said cooking programs; and displaying means, operatively connected to the cooking controlling means, for displaying information to assist the user in preparing a menu by said main dish cooking information selecting means and said sub-dish cooking information selecting means and for displaying information relating to the cooking programs to be executed prior to execution of the cooking programs by said cooking controlling means.

2. The microwave oven of claim 1, wherein each of said first and second type external storing means stores identification information, identifying the first and second type external storing means as one of a first and second type external storing means, respectively, said first type external storing means further stores sub-dish cooking information for specifying sub-dish cooking information related to each of the plurality of kinds of main dish cooking information stored therein, said microwave oven further includes combination determining means for determining whether a combination of said first type external storing means and said second type external storing means attached to said external attaching means is a predetermined combination appropriate for menu preparation based on each said identification information, and said displaying means includes a combination displaying means responsive to the determination result of said combination determining means for displaying one of a plurality of predetermined confirmation messages for applicability of a predetermined combination.

3. The microwave oven of claim 2, further including attachment order determining means for determining whether said first type external storing means and said second type external storing means are attached to said external attaching means in a predetermined order, wherein said displaying means further includes attachment order confirmation displaying means responsive to the determination result of the attachment order determining means for displaying one of a plurality of the predetermined attachment order confirmation messages.

4. The microwave oven of claim 3, wherein said combination determining means includes:

inapplicable pattern storing means for storing a pattern of an inapplicable combination of the identification information of said firs type external storing means and the identification information of said second type external storing means, and coincidence detecting means for detecting a coincidence between the storage contents of said inapplicable pattern storing means and a combination of the information of said first type external storing means and the identification information of second type external storing means attached to said external attaching means, said displaying means includes treatment specification displaying means, responsive to the coincidence detection by said coincidence detecting means, for displaying a treatment specific message for specifying a predetermined treatment to be taken by the user with respect to said inapplicable pattern whose coincidence is detected.

5. The microwave oven of claim 4, wherein each of said plurality of kinds of main dish cooking information and said plurality of kinds of sub-dish cooking information includes picture information for expressing a picture relating to the main dishes and sub-dishes, and said displaying means further includes:

picture displaying means for displaying pictures relating to said main dishes and sub-dishes during menu preparation by the user and an execution of cooking programs by said cooking controlling means, and picture switching means for switching pictures relating to each of said main dishes and sub-dishes according to a predetermined picture display sequence corresponding to an operational mode and for sequentially applying the pictures to said picture displaying means when there are a plurality of pictures relating to said main dishes and sub-dishes to be displayed.

6. The microwave oven of claim 5, wherein each of said plurality of kinds of main dish cooking information and said plurality of kinds of sub-dish cooking information further includes cooking time information for specifying a required cooking time, and said displaying means includes display order defining means for arranging the information relating to said main dishes and sub-dishes in an order predetermined according to an operational mode and for applying the information to said picture switching means based on each of said cooking time information included in each of said plurality of kinds of main dish cooking information and said plurality of kinds of sub-dish cooking information during menu preparation by a user and an execution of said cooking program by said cooking controlling means.

7. The microwave oven of claim 3, wherein each of said plurality of kinds of main dish cooking information and said plurality of kinds of sub-dish information includes picture information for expressing a picture relating to the main dishes and sub-dishes, and said displaying means further includes:

picture displaying means for displaying pictures relating to said main dishes and sub-dishes during menu preparation by the user and an execution of cooking programs by said cooking controlling means, picture switching means, when there are a plurality of pictures relating to said main dishes and sub-dishes to be displayed, for switching each of said pictures relating to said main dishes and sub-dishes and applying the switched picture to said picture displaying means in accordance with a picture displaying sequence predetermined according to an operation mode.

8. The microwave oven of claim 7, wherein each of said plurality of kinds of main dish cooking information and said plurality of kinds of sub-dish cooking information further includes cooking time information for specifying a required cooking time, and said displaying means includes display order defining means for arranging the information relating to said main dishes and sub-dishes in an order predetermined according to an operational mode and for applying the arranged information to said picture switching means based on each of said cooking time information included in each of said plurality of kinds of main dish cooking and said plurality of kinds of sub-dish cooking information during menu preparation by said user and execution of said cooking programs by said cooking controlling means.

9. The microwave oven of claim 2, wherein said combination determining means includes:

inapplicable pattern storing means for storing a pattern of an inapplicable combination of the identification information of said first type external storing means and the identification information of said second type external storing means, and coincidence detecting means for detecting coincidence between the storage contents of said inapplicable pattern storing means and a combination of the identification information of said first type external storing means attached to said external attaching means and the identification information of said second type external storing means attached to said external attaching means, and said displaying means includes treatment specification displaying means, responsive to the coincidence detection by said coincidence detecting means, for displaying a treatment specific message for specifying a predetermined treatment to be taken by the user with respect to said inapplicable pattern whose coincidence is detected.

10. The microwave oven of claim 9, wherein each of said plurality of kinds of main dish cooking information and said plurality of kinds of sub-dish cooking information includes picture information for expressing a picture relating to the main dishes and sub-dishes, and said displaying means further includes:

picture displaying means for displaying said picture relating to the main dishes and sub-dishes during menu preparation by the user and execution of the cooking program by said cooking controlling means, and picture switching means for switching, when there are a plurality of pictures relating to said main dishes and sub-dishes to be displayed, said pictures relating to the main dishes and sub-dishes and for sequentially applying the switched pictures to said picture displaying means in accordance with a picture displaying sequence predetermined according to an operational mode.

11. The microwave oven of claim 10, wherein
each of said plurality of kinds of main dish cooking information and said plurality of kinds of sub-dish cooking information further includes cooking time information for specifying a required cooking time, and
said displaying means further includes display order defining means for arranging the information relating to said main dishes and sub-dishes in an order predetermined according to an operational mode and for applying the arranged information to said picture switching means based on each of said cooking time information included in each of said plurality of kinds of main dish cooking and said plurality of kinds of sub-dish cooking information during menu preparation by said user and execution of said cooking programs by said cooking controlling means.

12. The microwave oven of claim 2, wherein
each of said plurality of kinds of main dish cooking information and said plurality of kinds of sub-dish cooking information includes picture information for expressing a picture relating to the main dishes and sub-dishes, and
said displaying means further includes:
picture displaying means for displaying said picture relating to the main dishes and sub-dishes during menu preparation by the user and execution of the cooking program by said cooking controlling means, and
picture switching means for switching, when there are a plurality of pictures relating to said main dishes and sub-dishes to be displayed, the pictures relating to said main dishes and sub-dishes and for sequentially applying the switched pictures to said picture displaying means in accordance with a picture displaying sequence predetermined according to an operational mode.

13. The microwave oven of claim 12, wherein
each of said plurality of kinds of main dish cooking information and said plurality of kinds of sub-dish cooking information further includes cooking time information for specifying a required cooking time, and
said displaying means further includes display order defining means for arranging the information relating to said main dishes and sub-dishes in an order predetermined according to an operational mode and for applying the arranged information to said picture switching means based on each of said cooking time information included in each of said plurality of kinds of main dish cooking and said plurality of kinds of sub-dish cooking information during menu preparation by said user and execution of said cooking programs by said cooking controlling means.

14. The microwave oven of claim 1, wherein
each of said plurality of kinds of main dish cooking information and said plurality of kinds of sub-dish cooking information includes picture information for expressing a picture relating to the main dishes and sub-dishes, and
said displaying means further includes:
picture displaying means for displaying said pictures relating to said main dishes and sub-dishes during menu preparation by said user and execution of the cooking programs by said cooking controlling means,
picture switching means for switching, when there are a plurality of pictures relating to said main dishes and sub-dishes to be displayed, the pictures relating to said main dishes and sub-dishes and for sequentially applying the switched pictures to said picture displaying means in accordance with a picture displaying sequence predetermined according to an operational mode.

15. The microwave oven of claim 14, wherein
each of said plurality of kinds of main dish cooking information and said plurality of kinds of sub-dish cooking information further includes cooking time information for specifying a required cooking time, and
said displaying means further includes display order defining means for arranging the information relating to said main dishes and sub-dishes in an order predetermined according to an operational mode and for applying the arranged information to said picture switching means based on each of said cooking time information included in each of said plurality of kinds of main dish cooking and said plurality of kinds of sub-dish cooking information during menu preparation by said user and execution of said cooking programs by said cooking controlling means.

16. The microwave oven of claim 1, wherein
said plurality of kinds of sub-dish cooking information includes sub-dish cooking information belonging to a first category and sub-dish cooking information belonging to a second category, different from said first category,
said sub-dish cooking information selecting means includes:
search condition designating means for individually and successively designating conditions for searching said sub-dish cooking information belonging to said first and said second categories when selecting said sub-dish cooking information depending on said main dish cooking information already selected by said main dish cooking information selecting means,
said search condition designating means including:
question displaying means for applying, to said displaying means, a question for specifying one of a plurality of predetermined answers and for displaying the question in order to specify said individually and successively designated condition;
selective answering means for allowing the user to select one of said plurality of predetermined answers to answer to said displayed question,
prior operation detecting means for detecting a prior operation, of the user, of said selective answering means with respect to a displayed one of said questions,
subsequent operation detecting means, responsive to the detection of said prior operation by said prior operation detecting means, for detecting whether the user performs a subsequent operation of said selective answering means within a predetermined time of the detection of said prior operation, and
sub-dish cooking information searching means for searching said plurality of kinds of sub-dish cooking information belonging to said second category based on the result of said subsequent operation.

17. The microwave oven of claim 16, wherein said search condition designating means further includes following operation assuming and detecting means, responsive to said subsequent operation detecting means failing to detect a subsequent user operation of said selective answering means which follows within a predetermined time of the detection of said prior operation, for deducing that a same answer as chosen in the prior operation is made in the following operation, and for applying the same answer to said sub-dish cooking information searching means.

18. The microwave oven of claim 1, wherein the first type external storing means is one of a first integrated circuit card and a random access memory card and the second type external storing means is one of a second integrated circuit card and a random access memory card, separate from the first.

19. The microwave oven of claim 18, wherein the external memory attaching means includes at least two attaching slots, one for each of the first and second external storing means.

20. The microwave oven of claim 18, wherein the external memory attaching means includes a single attaching slot for alternately attaching each of the first and second external storing means.

* * * * *